US007784406B2

(12) United States Patent
Chisena

(10) Patent No.: US 7,784,406 B2
(45) Date of Patent: Aug. 31, 2010

(54) TRAIN-TO-PLATFORM GAP MITIGATOR

(76) Inventor: Michael P. Chisena, P.O. Box 7619, Garden City, NY (US) 11530

( * ) Notice: Subject to any disclaimer, the term of this patent is extended or adjusted under 35 U.S.C. 154(b) by 231 days.

(21) Appl. No.: 12/116,078

(22) Filed: May 6, 2008

(65) Prior Publication Data

US 2008/0276832 A1 Nov. 13, 2008

Related U.S. Application Data

(60) Provisional application No. 60/928,922, filed on May 11, 2007.

(51) Int. Cl.
*B61B 1/00* (2006.01)

(52) U.S. Cl. ..... 104/28; 104/30; 105/443; 105/449; 105/458

(58) Field of Classification Search ..... 104/27–31; 105/443–450, 458
See application file for complete search history.

(56) References Cited

U.S. PATENT DOCUMENTS

| | | | | | |
|---|---|---|---|---|---|
| 4,081,091 | A * | 3/1978 | Thorley | 414/545 |
| 4,110,673 | A * | 8/1978 | Magy et al. | 318/466 |
| 4,168,134 | A * | 9/1979 | Pohl | 414/545 |
| 4,176,999 | A * | 12/1979 | Thorley | 414/540 |
| 4,251,179 | A * | 2/1981 | Thorley | 414/545 |
| 4,270,630 | A * | 6/1981 | Karkau | 187/200 |
| 4,583,466 | A * | 4/1986 | Reddy et al. | 105/447 |
| 4,771,698 | A * | 9/1988 | De Kermadec et al. | 104/30 |
| 5,299,904 | A * | 4/1994 | Simon et al. | 414/541 |
| 5,357,869 | A * | 10/1994 | Barjolle et al. | 105/436 |
| 5,382,130 | A * | 1/1995 | Kempf | 414/540 |
| 5,439,342 | A * | 8/1995 | Hall et al. | 414/545 |
| 5,575,222 | A * | 11/1996 | Sauer et al. | 105/458 |
| 5,683,221 | A * | 11/1997 | Ablabutyan | 414/540 |
| 5,775,232 | A * | 7/1998 | Golemis et al. | 105/458 |
| 6,167,816 | B1 * | 1/2001 | Lavery et al. | 105/458 |
| 6,305,897 | B1 * | 10/2001 | Budd et al. | 414/540 |
| 6,341,563 | B1 * | 1/2002 | Gal et al. | 104/28 |
| 6,360,668 | B1 * | 3/2002 | Rauch | 104/30 |
| 6,948,903 | B2 * | 9/2005 | Ablabutyan et al. | 414/557 |
| 7,007,961 | B2 * | 3/2006 | Leitner et al. | 280/166 |
| 7,163,221 | B2 * | 1/2007 | Leitner | 280/166 |
| 7,178,467 | B2 * | 2/2007 | Le Bellec et al. | 105/458 |
| 7,293,467 | B2 * | 11/2007 | Shank et al. | 73/780 |
| 7,516,703 | B2 * | 4/2009 | Tazreiter | 105/443 |
| 7,551,995 | B2 * | 6/2009 | Heigl et al. | 701/36 |
| 2003/0056686 | A1 * | 3/2003 | Morlok | 105/443 |
| 2006/0175791 | A1 * | 8/2006 | Kaempe | 280/166 |
| 2006/0267308 | A1 * | 11/2006 | Decker et al. | 280/166 |
| 2007/0200313 | A1 * | 8/2007 | Tazreiter | 280/166 |
| 2008/0250966 | A1 * | 10/2008 | Hirtenlehner | 105/444 |
| 2008/0276832 | A1 * | 11/2008 | Chisena | 105/458 |

* cited by examiner

*Primary Examiner*—S. Joseph Morano
*Assistant Examiner*—Jason C Smith
(74) *Attorney, Agent, or Firm*—Hoffmann & Baron, LLP

(57) ABSTRACT

An improved gap filler in the form of a single plate or a plurality of plates attached to the train car exterior or emanating from below train car vestibule floor which permits transit line system operator to utilize one device to obtain any desired gap minimization at every train car door in a trainset relative to its corresponding platform edge at all stations on its transit line regardless of platform and/or track configuration while simultaneously adhering to its gap clearance standards pertaining to safe passage of any train within its fleet through any station.

30 Claims, 33 Drawing Sheets

Front View Plate 1 Closed

Top View Plate 1 Open

Front View Plate 1, 2 and 3 Closed

Top View Plate 1, 2 and 3 Open

Interlocking Plate
Section A-A

Front View Plate 1, 2 and 3 Closed

Top View Plate 1, 2 and 3 Open

Front View of Slotted Opening with
Plate Concealed Under Vestibule Floor

SECTION A-A

SECTION B-B

TRAIN-TO-PLATFORM GAP MITIGATOR

CROSS-REFERENCE TO RELATED APPLICATIONS

This application claims the benefit of U.S. Provisional Application No. 60/928,922 filed May 11, 2007, the contents all of which are incorporated herein by reference.

FIELD OF THE INVENTION

The present invention generally relates to a new and improved method to minimize the gap between a train car doorway and train station platform.

BACKGROUND OF THE INVENTION

1. Introduction

The gap is the horizontal space between the edge of the platform and the edge of the rail car door and the vertical difference from the top of the platform and the top of the rail car door. A horizontal gap of some size between a train and the train station platform is necessary to allow the safe passage of trains through stations. If the horizontal gap is too narrow, the dangerous potential exists that the train could strike the platform thereby causing train derailment, injury to commuters and damage to both the train and the platform. The complexities of any potential solution to gap minimization, while setting and maintaining an acceptable gap, is an extremely complicated process affected by the confluence of factors pertaining to variations in car body widths and lengths for typical freight and passenger rail vehicles, track curvature and platform configuration. The problems and solution analysis associated with the passenger boarding process are exacerbated due to the necessary use by freight trains or other specialized equipment of the same track utilized by commuter trains.

Presently, the only federal law mandating that there be any standard for the width of the gap between the train car and platform edge for purposes of passenger safety in boarding and alighting a train is the Americans with Disabilities Act (ADA) with the implementing regulations of the U.S. Department of Transportation (DOT).

The ADA became law on Jul. 26, 1990. All transit line systems, subject to the law's applicability, must take into account the ADA when giving consideration to new station construction, station modernization, retrofitting of existing fleet and purchase of new train cars. This federal law, with its accompanying DOT regulations initially adopted in 1991, became the first statutory mandate prescribing a maximum gap width standard for the protection of commuters with disabilities while boarding and alighting trains.

The existing regulations of the DOT, in part, incorporating the ADA Accessibility Guidelines (ADAAG) created by the Architectural and Transportation Barriers Compliance Board (Access Board), implementing the mandates of the ADA generally specify that there be a horizontal gap of no more than 3" between train car doorway and the platform in rapid rail, light rail, commuter rail, intercity rail and high speed rail systems.

The regulatory language as to light rail, commuter rail and intercity rail systems presently provides, in part, that where meeting the horizontal gap requirement is not operationally or structurally feasible the use of mini-high platforms, carborne or platform-mounted lifts, ramps, bridge plates or similarly manually deployed devices meeting DOT specifications is then permitted.

According to current DOT regulations, a recipient of DOT funds under any program or activity cannot exclude from participation in such program or activity any qualified individual with a defined disability and must provide such service in the most integrated setting that is reasonably achievable. In rail transportation, the accessibility solution which accomplishes the providing of such services to the disabled in the most integrated setting must be selected by the carrier.

The norm for new commuter and intercity rail stations, according to DOT regulations, is a platform running the full length of the passenger boarding area of the station that permits level boarding to all accessible cars of trains stopping at the station thereby avoiding segregated service by permitting passengers with disabilities to have access to all train car doorways of all cars. In 2005, the DOT reported that meeting and/or maintaining the 3" horizontal gap is likely to be unfeasible for transit line system operators in most commuter and intercity rail stations.

In 2006, the DOT proposed to thus modify its existing 3" horizontal gap rule at applicable intercity and commuter rail stations such that, where it is not feasible to meet it, the platform design shall be coordinated with rail cars so as to provide full train length level entry boarding with the horizontal gap to be no greater than 10" on tangent track and 13" on curves with bridge plates and other devices to be used as permitted by the DOT. No final rule has yet been made.

The Federal Railroad Administration (FRA), an agency of the DOT, also concluded in 2006 that the 3" horizontal gap requirement specified by the ADA regulations is probably impossible for intercity and commuter rail systems to meet even at stations where only passenger trains are operated.

In response to the need to manage the gap from all perspectives, the federal government, state governments, rail industry associations and transit line systems are currently in the process of developing standards to manage gap safety.

Present state laws and rail industry standards, which relate to the gap distance between the train and the platform, have as their focus the prevention of a train crashing into a fixed station platform during normal operations and were not developed from the perspective of the gap to be crossed by the commuter when boarding or alighting the train. Such gaps are necessary to take into account the normal variability or tolerance in the position of a rail car with the platform in a dynamic system. Tolerance applies to every aspect of any rail system such as, but not limited to, its platform configuration, track structure and fleet; further, it contains both horizontal and vertical components. The distance between the train car and the platform is affected by horizontal components. The height of the car floor in relationship to the platform is affected by vertical components. The tolerance of each factor which affects horizontal or vertical components cumulatively determines each component's respective total variability or tolerance stack. All efforts to manage and minimize both the horizontal and vertical gap must take into account the practicability of minimizing the individual tolerance factors.

The horizontal components affecting gap width are generally acknowledged to be the location of the platform relative to center line of track, variation in track gauge, width of the rolling stock, rail car position relative to center line of track, variation within the rail car suspension, curvature of track and car body roll.

Utilizing mechanical engineering concepts, the tolerance of each factor affecting the horizontal components must be analyzed to determine total variability. According to statistical analysis, this calculation of the tolerance stack determines the required minimum horizontal, that is, side clearance distance to be maintained in order to avoid a worst case scenario of a platform strike. Such will occur if every horizontal component affecting gap width were to be at extreme limits of working tolerances and all were simultaneously acting in the same direction. It is crucial that the side clearance gap be of sufficient width such that the probability of a train colliding with the platform edge approaches zero.

Any horizontal gap minimization attempt from the commuter perspective must be counter-balanced by the impact, if any, which each respective mitigation measure has on the horizontal components which comprise the tolerance stack so as not to exacerbate the probability of a train to platform strike. The interplay between and among the horizontal components affecting gap width and the overall tolerance stack must be understood and analyzed when any attempt is made to mitigate the gap the commuter must cross when boarding or alighting the train by a minimization measure which deals with one or more horizontal components.

Considerations to have the horizontal gap distance be as narrow as possible for the commuter to cross while attempting to achieve and/or maintain compliance with the gap width mandates of the ADA and DOT regulations must be critically juxtaposed against the necessary side clearance distance to be maintained between platform and train required to prevent a catastrophic platform strike by the train.

Simply stated, government and the rail industry today are faced with perplexing gap dilemmas which appear to be irreconcilable. The federal government presently mandates a 3" maximum gap width derived from the commuter perspective only while its DOT has been forced to acknowledge this requirement is presently impossible to meet by intercity and commuter rail systems. State governments have legislated, and the rail industry has adopted, a necessarily larger gap width standard developed solely from a train clearance perspective.

All transit line systems thus face a seemingly unavoidable and unsolvable predicament, the radically divergent components of which are, to have the gap width the commuter must cross be as narrow as possible while simultaneously needing to maintain a side clearance gap width as broad as required to facilitate the safe passage of every type of rail car in its fleet through a station. Superimposed on this quandary are gap width standards developed and maintained from differing perspectives: the existing federal mandate in the ADA providing generally a very narrow 3" horizontal gap width to protect commuters with disabilities; mirror imaged against this are state laws and rail industry safety recommendations providing larger gap width standards for train clearance purposes.

2. Background of the Related Art

Gap widths in train stations along the plurality of routes of a transit line system are not uniform in size. It is functionally inadequate to analyze the issue and formulate solutions solely from the perspective of considering every train station within a transit line system as having a uniform gap width along its entire platform.

Each train car doorway of every train has its own gap width issues dependent, in pertinent part, upon its positioning in the line of a trainset, the setback of the platform from the track, platform and track configuration, and the location within each station at which that particular train car doorway opens when the train comes to a stop.

Thus, a differing set of gap width issues must be readily addressable for that same train car doorway at each station the train stops at on every route within the system.

The problem and its attendant solution is made further complex due to the fact that any particular train car may be routinely transferred from one route to another route within the transit line system and which action will present differing gap size issues for each train car doorway of that train on its new route.

It is further pertinent to consider that a transit line system does not necessarily operate with only one type of train car but its fleet may include cars having varied characteristics and different dimensions within the context of passenger service as well as a rail freight operation.

Superimposed upon any particular solution to be considered by any one transit line system is the fact that terminals, stations along a route, and large segments of track may be shared in certain situations with other carriers having fleet differing in size and shape.

Therefore, the prevailing thought is that no single gap solution will work for any transit line system.

A multi-faceted flexible remediation program specifically geared to each transit line system's specialized needs and requirements is the only addressable solution to this most complex set of variables.

Related art reveals numerous attempts at mitigating the above mentioned gap problem. There is no device which functionally addresses gap mitigation solutions for the varying sized gaps existing at each train car doorway with its corresponding train station platform edge of every train of a trainset at every station along a train's route. The devices known to exist claiming to respond to the need for gap mitigation are universally burdened by the common deficiency of having a singular non-flexible approach and thereby being unable to address the goal of mitigating every sized gap at every train car doorway with its corresponding station platform.

The use of a bridge plate device which rests on the station platform to span the gap is disclosed in various patents. For example, U.S. Pat. No. 5,357,869 to Barjolle et al., discloses a bridge plate device housed fully within the thickness of the train car vestibule floor. U.S. Pat. No. 5,775,232 to Golemis, et al., discloses a bridge plate device extending from a so-called "cartridge" design mounted under the train car door. U.S. Pat. No. 6,167,816 to Layery, et al., discloses a bridge plate improvement patent to Golemis, supra.

Common to the above three patents is the housing of the plate component below the train car vestibule floor. In order for the device to be operative, the stowed position of the plate must be higher than the corresponding top of the station platform such that the platform edge can be totally cleared by the device horizontally extending from the train. Disadvantageously, device utilization presumes that for the entire length of each train station platform, the platform must be lower than each train car doorway throughout the entire transit line system or the device cannot be used.

A further distinctive disadvantage is the preset operating position of the device limiting its extension to one predetermined length. There is no disclosure of any provision for varying the length of the device extension into the horizontal plane during train operation for it is the sole purpose of the apparatus to bridge the gap by coming to rest upon the platform. The device can be recalibrated to a different length but, most importantly, this cannot take place during the train's on-going route and must be accomplished during non-operating maintenance conditions. There is no disclosed capability for the device to adjust its length of extension into the horizontal plane between the train and the station platform while the train is on its route.

Further, the distance to be traveled by the device in the horizontal plane is preset at the same length for every train car doorway of the train in the trainset sufficient for every platform to be bridged. The preset distance must obviously be greater than the widest gap existent within the entire transit line system.

Given this undeniable fact and that the actual gap widths at every train car doorway vary in size, and in view of the preset singular length into the horizontal plane to be traveled by each such device, it is axiomatic that the bridge plate at each train car doorway of all trains in the trainset does not overlay the adjoining station platform for a common distance. Thus, the bridge plate type device will unnecessarily overlay the station platform at a plurality of different lengths varying train car doorway to doorway thereby creating an unwarranted and jigsaw-like series of tripping hazards along the entire platform adjacent to the train.

In abandoned U.S. patent application Ser. No. 10/254,929 to Morlok filed Sep. 26, 2002, same discloses extension plates, within the context of a purported new entranceway design covering doors, steps, and other components, which in its activated horizontal position rests upon the platform thereby forming a bridge plate. The bridge plate is housed against the exterior of the train car door and is lowered into position so that it rests on the platform. If the plate does not function according to design, an obvious hazard has been created due to the very location of the device against the exterior of the train car doorway thereby preventing door opening and closing procedures with consequent train delays. No disclosure is made of any embodiment permitting the train operator to utilize the extension plates to cover varying sized gaps, without overlapping the station platform, as it is the purpose of the inventor to bridge the platform with the device.

A common disability of all bridge plate type devices, regardless of its stowed position, is created by the very nature of the apparatus having necessarily to rest upon the train station platform. The sides of the device as well as the front extending edge, even if contoured, are in such position where commuters purposely crowd to board the train simultaneously with those who seek to exit the train car. This problem is exacerbated during the commuter morning and evening rush hours. Commuters do not board or alight the train by walking in a straight path from or to the train car vestibule floor and the platform but take any conceivable path at any angle. The probability of a misstep with resultant injury is heightened by the use of a bridge plate type device.

More importantly, such devices do not address the need, without use of an apparatus which lays upon the train station platform with the attendant problems associated therewith, to mitigate different sized gaps at each doorway of each train on a trainset in every station on a train line's route. Upon activation, the device extends into the crowd. Crowds gather in the area near the expected doorway location before the train comes to a stop in the station. As aforementioned, a tripping hazard is caused due to the introduction of an apparatus on a crowded platform.

Further, timing concerns have not been anticipated, or if so, are not taken into consideration in the implementation of the device pertaining to transit line scheduling. Timing sequence of device activation and deactivation must be taken into account when considering gap solutions.

All related art bridge plate devices suffer from the common deficiency of not being able to specifically address different sized gaps that a train at each train car doorway will encounter while that train is on its route and are relegated to use a one size fits all simplistic approach of having to reach and overlay the station platform.

Given this unalterable fact, the length of the device must be greater than the maximum gap width within the transit line system in order to bridge the platform and further can only be used where each train car doorway at each train station for the entire transit line system is higher than the top of the corresponding platform edge.

Thus, for the entire length of the platform at each train station on all routes within a transit line system, the platform must be lower than each train car doorway of each train in the system's fleet, or the bridge plate type device cannot be used. Therefore, such devices do not have practical use and cannot provide any measurable and meaningful gap solution.

U.S. Pat. No. 7,178,467 to LeBellec, et al., discloses a "strip" apparatus gap filler which is attached to an area of the train below the standard threshold plate so as to fixedly extend outward from the side of the train. The distance that the strip outwardly extends is selected by the user. The train, thus, on its entire route travels with this extension apparatus. The length of the extension can be modified during maintenance. No adjustment is provided for during train operation. An obvious disadvantage of this type device is the probability of unwanted collision between the device and various objects, including the station platform, it can potentially come into contact with during the train's route. Thus, the selected fixed length of the extension would have to be severely limited by normal and expected operating conditions of any train.

This device and any others of its kind fail to take cognizance of the absolute necessity for any transit line system to maintain strict adherence to its gap clearance standards to ensure safe passage of all its fleet through every train station on its entire route system without the potential of damage to the train and the platform and without creating potential for injury to commuters.

3. Gap Mitigation Considerations by Mass Transit and Railroad Systems

The entity in charge of the planning, operation and maintenance of a transit line system must take into consideration gap minimization measures by giving due consideration to the following points of critical analysis:

(1) the differing sized gaps existent within each train station on the train line as measured for each train car door when the train is stopped at each train station.

(2) the consideration of time constraints in the activation and deactivation of any such gap minimization device relative to maintenance of the train line schedule critical to movement of passengers in order to avoid transit congestion especially during the morning and evening rush hours.

(3) the differing gap minimization problems on each train line route as well as on the train line system which the operating entity seeks to address voluntarily or must address due to public demand, governmental directive or law.

(4) the retrofitting of the device of the present invention to the train cars then in use on the transit line system by a cost efficient method.

(5) the age and condition of its existing trains within its transit line system and corresponding needs to replace the older, out-of-date, and/or poorly conditioned trains with new trains then to be properly equipped with gap minimization devices.

It is apparent that the issue of passenger safety, which has come to the national forefront of discussion and concern, has been caused by the focus of attention presently being raised due to the increasing number of gap related incidents causing serious injuries to commuters.

Railroad officials have as their goal the reduction of risk of commuter injuries consistent with the reduction of gaps, wherever possible on their respective rail line systems, sufficient to allow for the safe passage of trains.

Thus, presently the complex problem pervades the entire railroad industry, domestically and internationally, as to the safest methodology to ensure commuter safety during the boarding and alighting process at stations, while simultaneously, duly and properly balancing the absolute necessity for maintaining the appropriate gap required for the safe passage of all trains within its system.

As such, what is needed is a device which simultaneously accomplishes the dual goal of permitting all rail line systems to achieve and/or maintain gap width clearance mandates set in law, by industry standards or recommendations and/or by the rail line system itself ensuring the safe passage of all trains through each of its stations within its system while providing gap mitigation as may be required by law or otherwise necessary to facilitate passenger safety in boarding and alighting trains regardless of size of any existing gap along its route resulting from any cause.

SUMMARY OF THE INVENTION

The device of the present invention facilitates the goal of the train line to minimize every horizontal gap, regardless of size, on every train route within its entire transit line system through utilization of the flexibility offered by the various embodiments of the device while maintaining adherence to the system's side clearance standards and requirements.

The device of the present invention permits every rail carrier to operationally provide from the horizontal perspective full train length level entry boarding as now, or as may be, mandated by the ADA and its accompanying DOT regulations at each train car doorway of every train forming the trainset when stopping at every station on its train line regardless of track type thereby providing full integrated service to all cars to all persons with disabilities. Utilization of the invention's device will permit each rail carrier including, but not limited to, light rail, commuter rail and intercity rail systems to provide full train length level entry boarding, as stated above, without the necessity of attempting to demonstrate to any applicable governmental oversight authority that it is not operationally or structurally feasible to meet the horizontal gap requirement thereby requiring an authorized alternative means to provide accessibility.

Indeed, the device's use will result in the rail carrier being able to comply with any horizontal component of level entry boarding at each train car doorway, no matter what the gap width mandate may be, as mitigation can be achieved from the door's threshold to the platform edge itself.

By use of the device, a rail carrier will be able to provide service to those with disabilities in the most integrated setting reasonably achievable, and the service thus provided will be totally consistent with any nondiscrimination mandate of the ADA and its corresponding DOT regulations.

Contrary to the current opinion of the rail industry and government oversight entities that meeting and/or maintaining the 3" horizontal gap component of full train length level entry boarding is unworkable, the device's use will now make this mandate feasible at rail station platforms in commuter and intercity rail modes.

The device of the present invention permits a rail carrier to minimize the horizontal gap which the commuter must cross without negatively impacting any of the tolerance factors which comprise the horizontal components affecting gap width and, thus, does not affect the necessary side clearance distance to be maintained at all times between platform and train so as not to contribute in any manner to the probability of a train strike of the platform.

There can be retrofitted to the passenger train rail cars contained within the fleet of all transit line systems those embodiments of the device of the present invention as selected by the transit line system operator. All rail cars to be manufactured can be designed to incorporate those embodiments of the device of the present invention as selected by the transit line system operator.

A device to minimize any sized gap existent between a train car doorway and the station platform is disclosed consisting of a single plate or plurality plates removably coupled to the train car's exterior adjacent to or below its threshold plate or, in the alternative, emanating from below train car vestibule floor, and selectively capable of deactivation and activation by design. The plate component of the device is attached solely to the train car and not to the station platform.

In its deactivated state, the device is positioned in a designated area so as not to interfere with train operation or public safety. In its activated state, the device is positioned to extend outward into the horizontal plane with the vestibule floor of the train car and its threshold plate towards edge of the train station platform thereby minimizing the gap between the train door and the platform.

The operation of the device has no effect upon the side clearance standard under which all train line systems operate pertaining to the necessary gap determined by each system as required between the train and the platform to ensure safe passage through the station without striking the platform. The reason for this is simple: dependent upon device design mode selected, the device need not be activated until the train is about to or has come to a complete stop in the station. When the device is deactivated, the train then may start-up again to leave the station.

The plate[s] of the device are to be constructed from a suitable weather resistant rigid material, such as titanium or steel, capable of being stowed in a deactivated state as disclosed, being readily moved into an activated position as disclosed, supporting all anticipated body weight of persons moving on the plate[s] to get on and off trains, and being readily moved back into a deactivated state as disclosed.

By the use of the device of the present invention, all transit line systems operating any mode for carrying passengers will be able to:

(1) provide for commuter safety by minimizing the horizontal gap where existent between train and platform edge while simultaneously having no impact upon any of the horizontal components affecting gap width inclusive of its most basic factor which is the distance to be maintained between center line of track and platform.

(2) substantially reduce the existing fears and safety concerns of potentially new and existing commuters as to distinct possibility of tripping, stumbling, falling, and/or being pushed into the "black hole" of a gap while boarding or exiting the train resulting in being crushed by a train, sustaining severe and permanent injuries, being electrocuted, or losing one's life.

(3) mitigate the risks of a gap related accident to those who especially need our care and constant vigilance, such as our children, our senior citizens, and persons with mental and physical disabilities who presently may experience deprivation of freedom to travel due to concerns about safely boarding and alighting trains.

(4) be in compliance with the present or any future mandate of the ADA and its corresponding DOT regulations as to horizontal gap width requirements relative to passenger boarding and alighting trains without otherwise retrofitting trains in their existing fleet, without station platform or track modification measures having to be undertaken or considered at existing or newly planned stations and without necessity of applying for application of any equivalent facilitation or other like provisions under DOT rules implementing the ADA.

(5) provide from the horizontal perspective full train length level entry boarding consistent with the nondiscrimination mandate of the ADA at each train car doorway of every car of every train in the fleet at every station on its line such that passengers with disabilities will not only have access to segregated service as may be offered while boarding or alighting the train at only certain doors of certain cars at certain stations including service which may be limited by availability of train personnel and/or number and type of manually deployed devices required to assist all in need.

(6) maintain by choice any of its existing side clearance standards as to the distance between platform edge and train to ensure safe passage for all trains passing through any station.

(7) achieve and/or continue in compliance with present or any future state laws and rail industry standards or recommendations for train clearance on tangent track and curve track so as to prevent catastrophic occurrences where trains crash into fixed station platforms during normal operations without having to modify track or station platforms in an attempt to accomplish gap mitigation goals from perspective of commuter safety.

(8) retrofit various embodiments of the device of the present invention on its existing passenger train fleet.

(9) consider purchase of new trains in the fleet only designed to utilize the various embodiments of the device of the present invention without the necessity for the transit line system to singularly require design changes and other modifications which may tend to increase overall purchasing costs in order to meet goal of commuter safety while simultaneously providing for safe passage of trains through stations.

(10) realize multi-million dollar savings from not having to spend taxpayer monies for gap related infrastructure modifications thereby allowing for utilization of budget resources to other priority projects.

Undeniably, government and the rail industry will directly benefit from the use by rail carriers of the device of the present invention.

The federal government can reasonably conclude that the key objective of the ADA and its DOT regulations to ensure the nondiscriminatory provision of transportation services to individuals with disabilities shall have been met.

Within the context of requiring that service to the disabled be provided in the most integrated setting reasonably achievable, the device's use will allow the DOT and its agencies, including the FRA and the Federal Transit Administration, to properly reach the conclusion that the accessibility solution actually providing such service in the rail setting can now with certainty be chosen.

Prospectively, the DOT and its agencies should not be faced with the challenge of having to consider rail carrier requests, except in the most rare of circumstances, for an alternative accessibility approach not involving level entry boarding from the horizontal perspective to be provided to the disabled given that use of the device reasonably assures that full train length level entry boarding, as now or as in the future may be required by ADA regulations, at every train car doorway will have been achieved.

With all rail carriers finally being able to provide level entry boarding as stated above, the DOT need not consider or implement any rule changes increasing the gap width requirements now set forth in ADA regulations thereby protecting to the fullest extent reasonably possible the safety of the disabled commuter and all other commuters by retaining the moderate 3" horizontal gap standard.

State governments and rail industry associations, in any effort to maintain the narrowest horizontal gap for the commuter to cross, need not contemplate or recommend any modifications to any train side clearance standards including its most basic component being the location of the platform relative to center line of track. This will indisputably result in multi-million dollar taxpayer cost savings.

Accordingly, in one preferred embodiment, a device to mitigate the gap existent between a train car door and a train station platform includes a plate assembly communicating with a threshold of a train car door, the plate assembly providing a continuous support structure for passage between a train car door and a train station platform edge. Preferably, the plate assembly is movable between a first state wherein at least one plate of the assembly is positioned away from the train station platform edge and a second state wherein the at least one plate is positioned toward the train station platform edge to mitigate the gap.

Of course, it will be appreciated by one skilled in the art that any and all embodiments of the device of the present invention can be incorporated in the design for any new class of train as well as can be incorporated in any amended, modified or supplementary design for any existing class of trains.

Additional features and advantages will be readily apparent from the following detailed description, the accompanying drawings and the claims.

BRIEF DESCRIPTION OF THE DRAWINGS

Like reference symbols in the various drawings indicate like elements.

DETAIL DESCRIPTION OF THE PREFERRED EMBODIMENTS

1. Definitions and Assumptions

Figure 1:
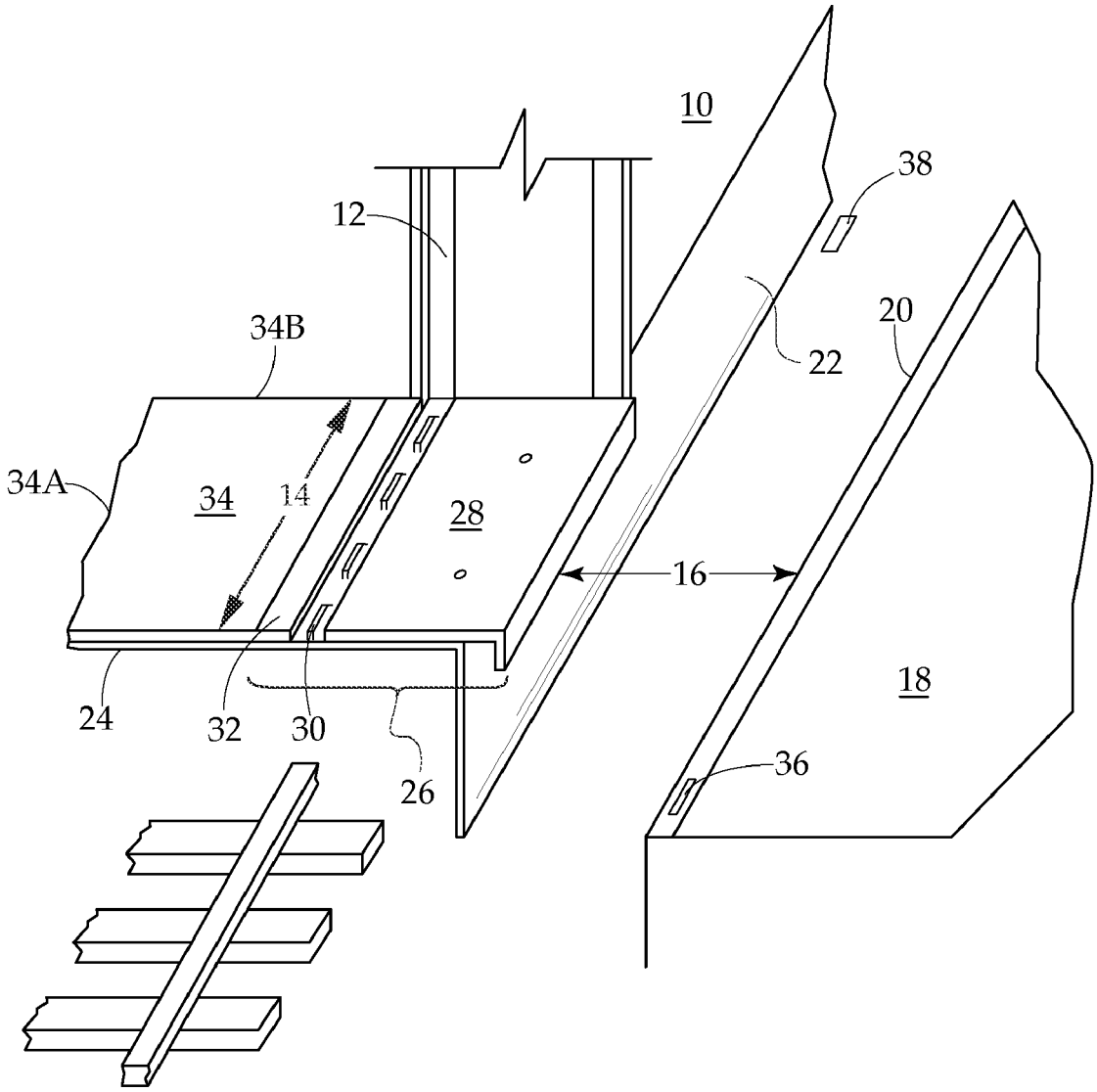
FIG. 1 is a side perspective view depicting gap between a current model train car showing partial vestibule floor area, doorway, threshold plate, outer carriage, undercarriage and a train station platform with edge.

Referring to FIG. 1, the present invention addresses the need for a device which will minimize the space, commonly referred to as "the gap" 16, between the edge of a train station platform 18 and the train 10 itself while in the station for purposes of passengers to board and alight.

A horizontal gap 16 of some size is necessary to allow the safe passage of trains. If the gap 16 between the train 10 and platform 18 is too narrow, the train 10 could strike the platform 18.

The concept of full train length level entry boarding pertains to a platform running the full length of the passenger boarding area of the train station permitting passengers with disabilities to board at all accessible train car doorways stopping at the station; it contains both a horizontal component measured from each doorway to its corresponding platform edge and a vertical component measured from the platform in coordination with the train car entrance.

The term "side clearance" shall mean the necessary horizontal gap clearance distance measured from platform edge to rail car door threshold required to safely operate all trains in the fleet at authorized speeds through every station on all train lines within a transit line system.

Reference to a train 10 shall mean a subway car or a railroad car or a plurality of subways cars or railroad cars forming the trainset.

A trainset is the number of cars on a particular train.

Reference to a train line or transit line system shall mean a subway transit line system or a railroad transit line system.

A train line or transit line system consists of one route or a plurality of routes for the train to travel from its originating rail terminal to its destination rail terminal.

Every train line by definition has multiple train stations on its route.

On any such train route, there is a plurality of train stations at which the train is scheduled to stop for purposes of passengers to board and alight.

All references to a train stopping at a train station shall mean for the purposes of having passengers board and alight the train.

Train car vestibule floor 34 is that area within a train car extending across its width from doorway 14 on one side to the corresponding doorway 14 on the opposite side. That part of the train car vestibule floor 34 closest to or adjacent to the train car doorway 14 is referred to as the outer perimeter 34A. That part of the vestibule floor 34 closest to or adjacent to the passageway to the commuter seating area is referred to as the inner perimeter 34B.

A threshold plate 26 is a metal step at the edge of the vestibule floor 34 whose length covers the distance of the entire door opening 14 and in width extends on both sides of the door 12 when closed. Typically, there is affixed to the threshold plate 26 a track guide 30 a/k/a a door track to facilitate movement of the door over the threshold plate 26 when the door 12 is opened and closed. That part of the threshold plate 26 to the interior of the door 12 when it is closed shall be referred to as threshold plate interior 32. That part of the threshold plate 26 to the exterior of the door 12 when it is closed shall be referred to as threshold plate exterior 28. It is removably coupled by any known means such as by bolts, screws or rivets to the car floor.

For all passengers to "cross the gap" the following procedure is assumed: when boarding, they do so by crossing the gap 16 from the station platform 18 and then proceed through the adjacent train car doorway 14 over the threshold plate 26 onto the train car vestibule floor 34; when alighting, they do so from the train car vestibule floor 34 and cross the gap 16 by proceeding through the adjacent train car doorway 14 over the threshold plate 26 onto the station platform 18.

The device has equal application to a below ground, ground level and elevated train line.

The device can be utilized on trains traveling within train stations on tangent (straight) track and/or curved track. Further, the device can be utilized on trains traveling on tracks that are banked, that is, with one rail slightly higher than the other, known as "super-elevation". This is necessary to maintain stability when achieving desired operating speeds.

The term "Train Gap Information" (hereinafter "TGI") refers to all pertinent gap information for every train within the fleet of a transit line system relating to its potential stopping at every train station on its route as required for the operation of a proprietary computer application program necessary for utilization of the present invention's device.

The term "Gap Device Computer Program" (hereinafter "GDCP") is the proprietary computer application program to be developed for each transit line system whose function is the operation of the present invention's device on all trains within its fleet based on TGI.

The term "Trainset Device Master Controller" (hereinafter "TSDMC") is a computer onboard each trainset being a primary interface communication, pursuant to GDCP, for receipt of instructions transmitted from transit line computer system and which controls device operation on that train.

"TGI-LUT" refers to relevant TGI data to be communicated, pursuant to GDCP, from the transit line's computer system to the TSDMC required for the operation of the present invention's device on its route.

The term "Train Car Device Controller" (hereinafter "TCDC") refers to a device to be located within the interior or on the exterior of each train car of the trainset being a secondary interface communication, pursuant to GDCP, for receipt of instructions from the TSDMC for the operation of the present invention's device within that train car.

"TCDC-LUT" refers to relevant TGI-LUT to be communicated, pursuant to GDCP, from the TSDMC to the TCDC required for the operation of the present invention's device within each train car on its route.

The term "Gap Device Door Controller" (hereinafter "GDDC") refers to a device to be located within the interior or on the exterior of each train car of the trainset being a tertiary interface communication, pursuant to GDCP, for receipt of instructions from the TCDC for the operation of the present invention's device at each train car doorway of each train of the trainset on its route.

"GDDC-LUT" refers to relevant TCDC-LUT to be communicated, pursuant to GDCP, from the TCDC to the GDDC required for the operation of the present invention's device at each train car doorway of each train forming the trainset on its route.

The term "Route Gap Signal Devices" (hereinafter "RGSD") are devices to be strategically positioned along the tracks of the transit line system or, in the alternative, to be incorporated as a component within existing signal devices now stationed alongside the train line's tracks, acting as an alternative to, or in conjunction with, a primary interface communication, pursuant to GDCP, for receipt of TGI-LUT and instructions transmitted from transit line computer system and transmittal of same to each trainset's TSDMC.

2. Gap Information into Transit Line System Computer

Figure 2:
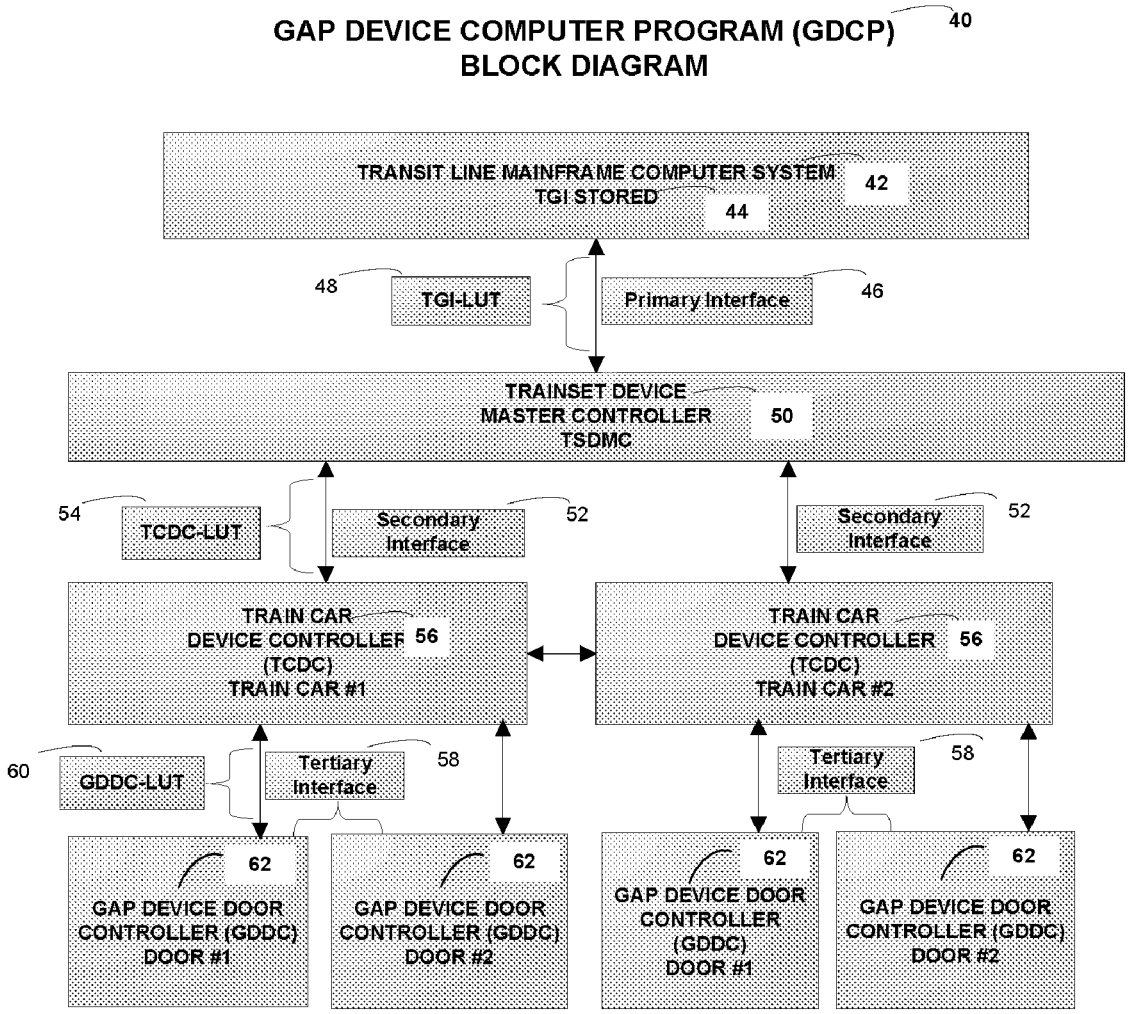
FIG. 2 is a block diagram for the Gap Device Computer Program (GDCP) according to the present invention.
Figure 6:
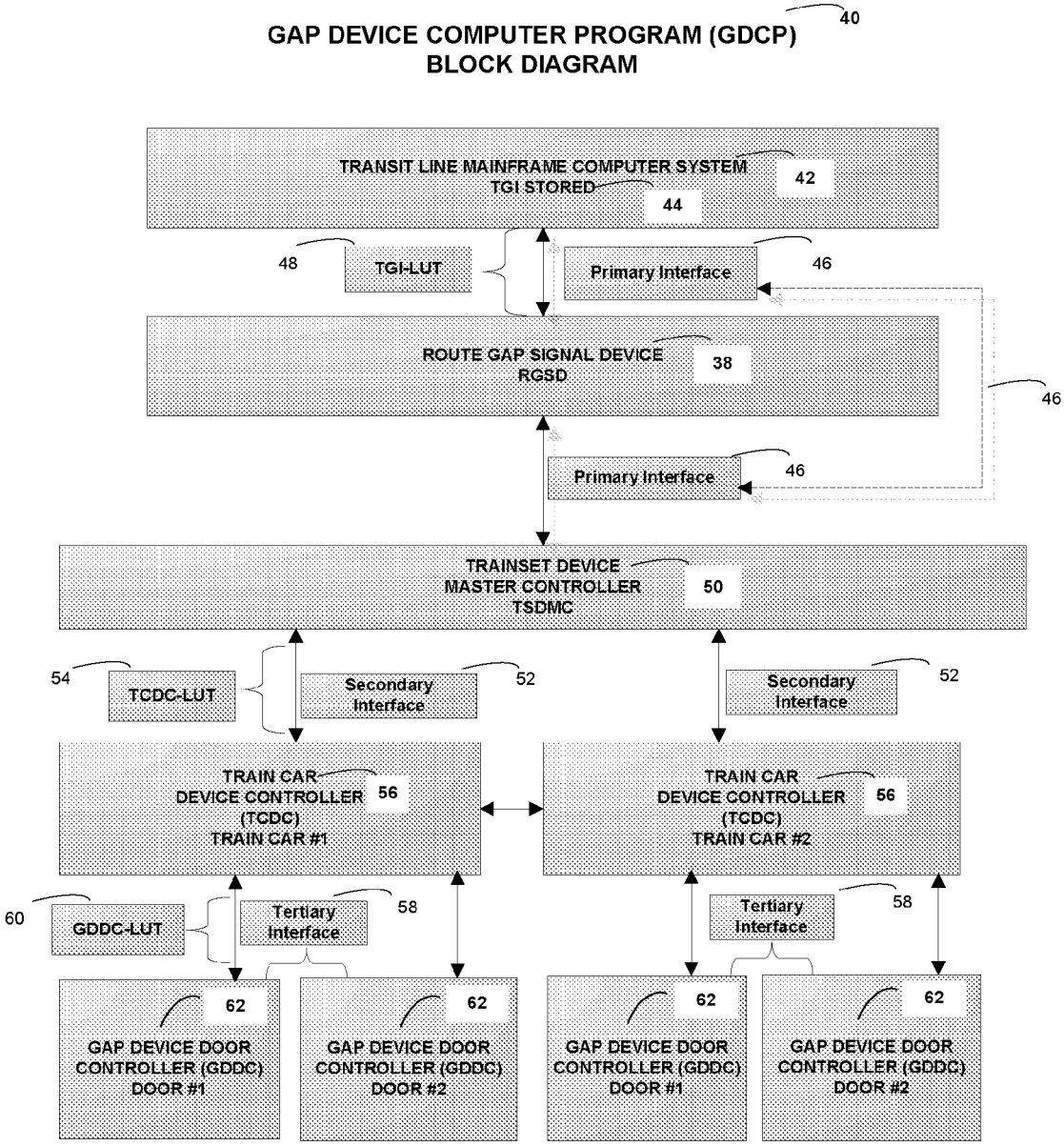
FIG. 6 is a block diagram for the Gap Device Computer Program (GDCP) utilizing the alternative of Route Gap Signal Devices according to the present invention.

The GDCP 40, as shown in FIGS. 2 and 6, is written in accordance with known procedures to be configured pursuant to which the TGI below described is to be stored into the train line's computer system 42, and relevant information is then to be selectively transmitted to the appropriate computer system onboard each train as well as in combination, or, in the alternative, to signal devices now existent or to be installed adjacent to the tracks of the transit line system.

The following TGI 44 is to be stored into the aforementioned GDCP 40 housed in the transit line system's computer system 42:

(1) the name of each train station for the entire transit line system.

(2) the identification number assigned to each train car in its fleet by the train line.

(3) the scheduled daily route for each train on the transit line system inclusive of the name of the stations at which the train is scheduled to stop on that particular route and the stations along that particular train's then particular route at which the train is not scheduled to stop.

(4) the number of train cars forming the trainset and the sequential order of the train cars by aforementioned identification number forming the trainset for each trainset's scheduled daily route.

(5) the gap distance 16 from the train car doorway 14 of each train car forming each potential trainset to its corresponding platform edge 20 at every conceivable location within each train station at which a train on each planned route is scheduled to stop. This is commonly referred to in the railroad industry as "platform edge measurements."

(6) the actual gap distance 16 from each train car doorway 14 of each train car forming the trainset to its corresponding platform edge 20 as calculated based on the stopping location of the train 10 at each station on its then actual route with determination to be then made as to utilization of those embodiments of the device of the present invention as installed on that train.

(7) the manner of activation of the device of the present invention and its component parts for each train at each train station on that train's planned route within the transit line system.

(8) coordination of activation and deactivation of the device of the present invention with functioning of train's door opening/closure operating system such that the device must be activated as planned prior to door opening and consequent door closure prior to device deactivation.

(9) coordination of activation and deactivation of the device of the present invention with functioning of train movement.

(10) priority override systems to control activation and deactivation of the device of the present invention and its component parts.

3. TGI Transmittal—Relevant TGI from Transit Line Computer System to Trainset

As shown in FIG. 2, the GDCP 40 is to be programmed to communicate from the transit line system's TGI 44 appropriate data, that is, TGI-LUT 48 required for each train forming the trainset relative to that trainset's then particular route. This communication is to be through a primary wireless interface network 46 to the TSDMC 50.

Preferably, the TSDMC 50 will be positioned in the car of the train's engineer; however, the final placement of such device will be in the discretion of the transit line system's operator.

In one preferred embodiment of the present invention, there will be a single TSDMC 50 located in the trainset. Yet in another preferred embodiment of the present invention, there can be a plurality of TSDMC 50 located within the trainset. By the use of a plurality of TSDMC 50 within the trainset, these computers will operate as a redundant system. Further, this redundant system will effectively permit the plurality of TSDMC 50 to communicate with one another via a wireless or primary interface application device. The advantages of such redundant system will facilitate the transfer of information and ensure the functionality of the device of the present invention in case of a singular or multi TSDMC 50 malfunction or failure.

4. TGI-LUT Transmittal from Trainset to Each Train Car

Figure 4:
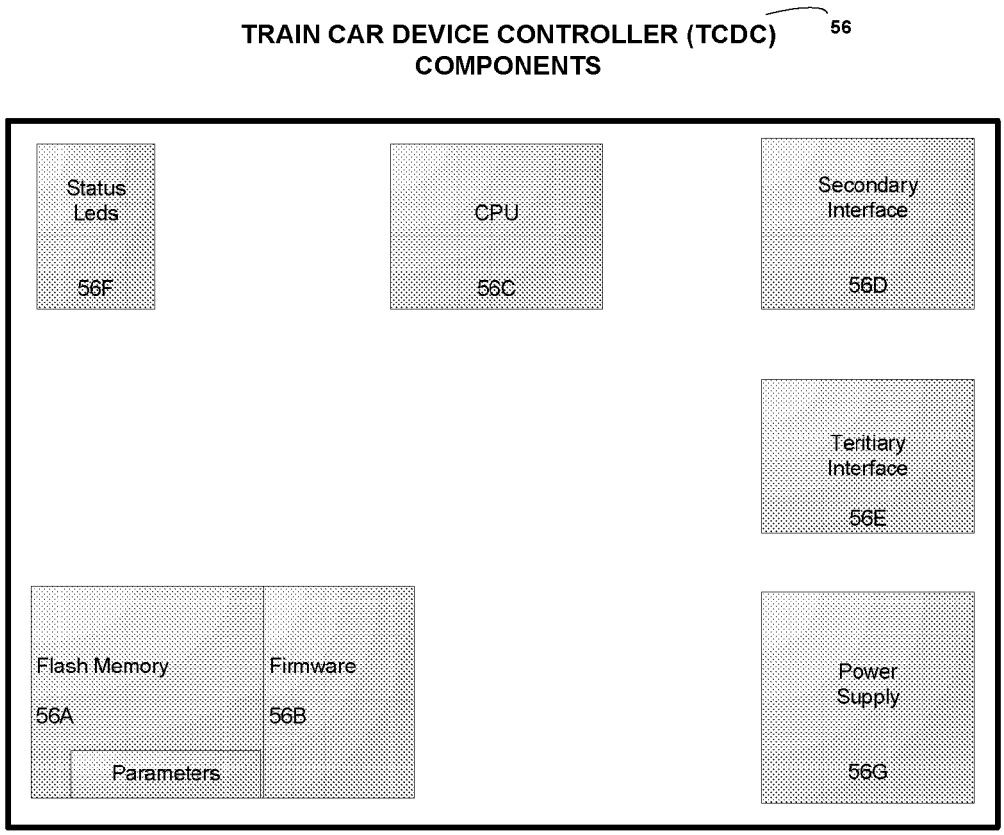
FIG. 4 is a block diagram for Train Car Device Controller (TCDC) components according to the present invention.

As shown in FIG. 2, in accordance with the transit line system's GDCP 40, appropriate TGI-LUT 48 relevant for each train car of the trainset, that is, TCDC-LUT 54, is communicated from the TSDMC 50 through either a secondary wireless interface network or by an interface cable connection 52 to a central processing unit 56C, referred to in FIG. 4, housed within the TCDC 56 component.

The TCDC 56 is preferably a component to the device of the present invention required in the operative aspects and conditions thereof.

In certain preferred embodiments, such as with plate structures one through seven, hereinafter described, the TCDC 56 shall be removably coupled by any known means such as by bolts, screws or rivets, to the exterior of the train car as hereinabove mentioned.

Figure 7:
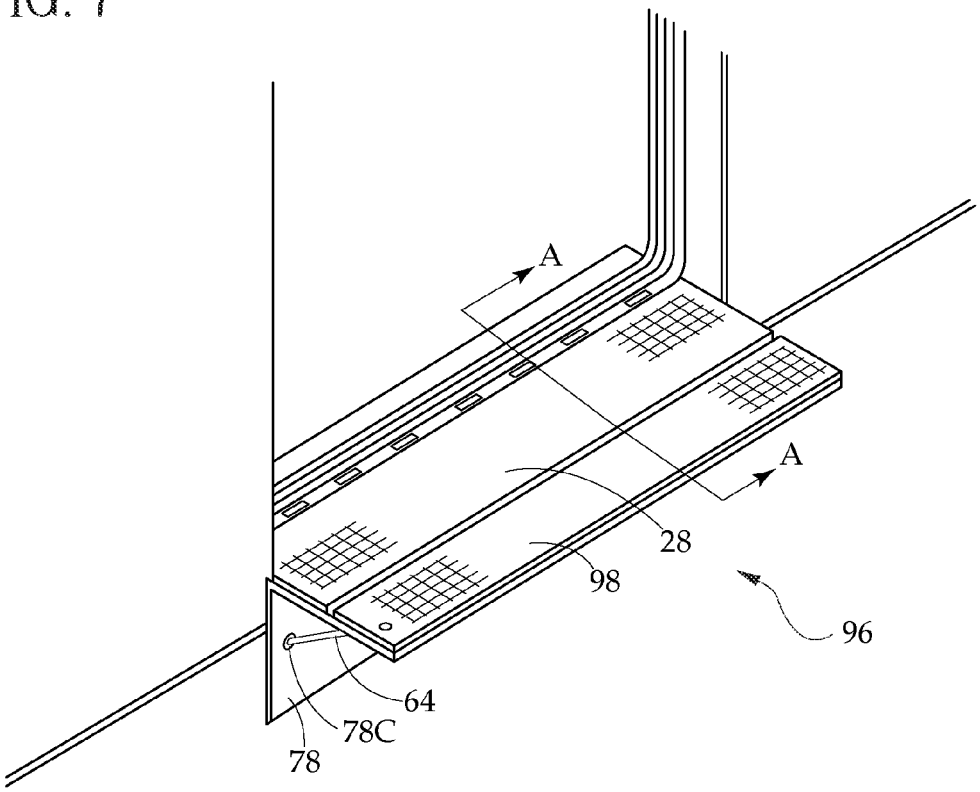
FIG. 7 is a first plate structure according to present invention depicting side and exploded perspective views of a single plate, with hinge, mounting plate and mechanical motion device, in activated position symmetrical with threshold plate.
Figure 7:
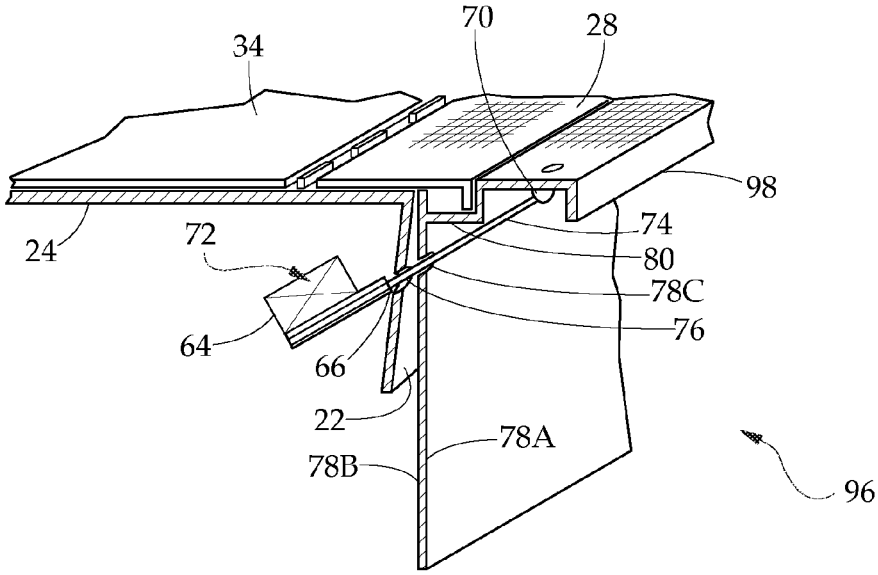
Figure 8:
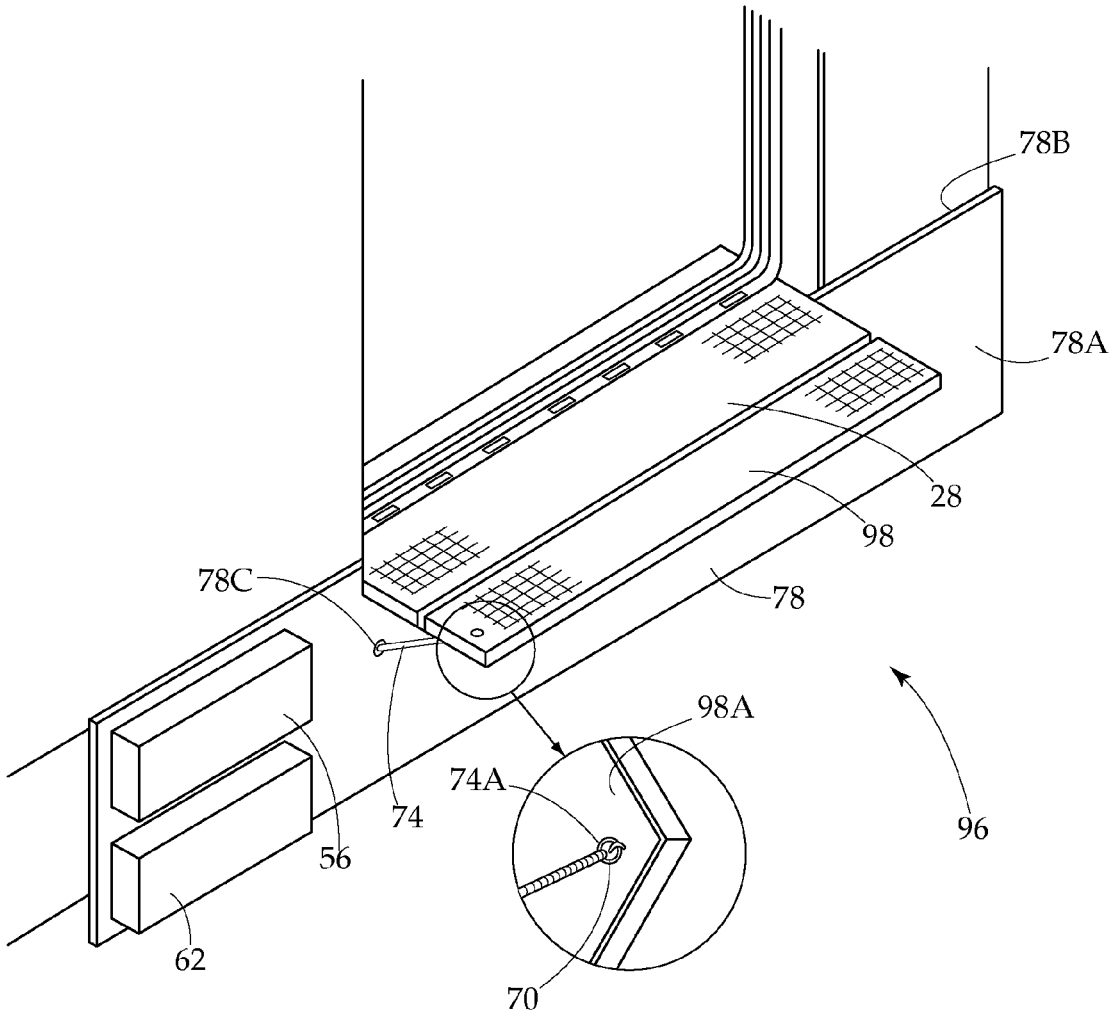
FIG. 8 is a side perspective view of the first plate structure shown in FIG. 7 with exploded view of hinged bracket attachment of said mechanical motion device to plate structure and further depicting positioning of Train Car Device Controller and Gap Device Door Controller components on said mounting plate according to device of present invention.

In yet other preferred embodiments, as shown in FIG. 8, such as with plate structures one through sixth, hereinafter described, the TCDC 56 shall be removably coupled by any known means, such as by bolts, screws or rivets, to a plate, preferably a mounting plate 78, as hereinafter described and as shown in FIGS. 7, 8, 10-16, which itself is removably coupled by any known means, such as by bolts, screws or rivets, to the exterior of the train car 10 and preferably below the threshold plate 26 of each train car doorway 14.

Now referring to FIG. 4, the Preferred Components of the TCDC 56 are, but not limited to, the following:

Flash Memory 56A—Flash memory, sometimes called flash RAM, is a type of semiconductor device that combines important features of both memory and storage. It is utilized to store system parameters and firmware.

Firmware Program 56B—A computer firmware program is an example of computer proprietary code that prescribes the actions (computations) that are to be carried out by a computer. Most firmware programs consist of a loadable set of instructions which determines how the computer will react to user and device input when that program is running, i.e. when the instructions are loaded.

Central Processing Unit (CPU) 56C—a programmable logic device that performs all the instruction, logic, and mathematical processing in a computer. Its microchip is installed on a motherboard and acts as the computer's brain-performing calculations and coordinating the hardware components. It contains all logic circuitry that performs the instructions of a computer's programs. The CPU is to accept commands from the TSDMC 50 and will follow these instructions by sending appropriate signals to the GDDC 62.

Secondary Interface 56D—component receiving commands and status instruction from TSDMC 50 for TCDC 56 and, in turn, communicating status information back to TSDMC 50 through a secondary wireless or wired interface connection conduit 52.

Tertiary Interface 56E—component sending commands and status instruction from TCDC 56 to the GDDC 62 and, in turn, receiving status information back from GDDC 62 through a tertiary wireless or wired interface connection conduit 58.

Status LEDS 56F—provides status of the sensor components of the GDDC 62.

Power Supply 56G—this is the power source for the TCDC 56.

5. Relevant TGI-LUT Data Transmittal from Train Car to Each Train Door

As shown in FIG. 2, pursuant to the GDCP 40, the TCDC-LUT 54 communicated to the TCDC 56 is to be compartmentalized such that there is to be communicated from said data relevant information, that is, GDDC-LUT 60 which solely relates to the operation of the device of the present invention at each such train car door. This communication is to be through either a tertiary wireless interface network or by an interface cable connection 58 to the GDDC 62 component.

The GDDC 62 is preferably a component to the device of the present invention which shall house various controls and sensors required in the operative aspects and conditions thereof.

In certain preferred embodiments, such as with plate structures one through seven, hereinafter described, the GDDC 62 shall be removably coupled by any known means such as by bolts, screws or rivets, to the exterior of the train car as hereinabove mentioned.

In yet other preferred embodiments, as shown in FIG. 8, such as with plate structures one through sixth, hereinafter described, the GDDC 62 shall be removably coupled by any known means, such as by bolts, screws or rivets, to a plate, preferably a mounting plate 78 as hereinafter described, which itself is removably coupled by any known means, such as by bolts, screws or rivets, to the exterior of the train car 10 and preferably below the threshold plate 26 of each train car doorway 14.

Figure 5:
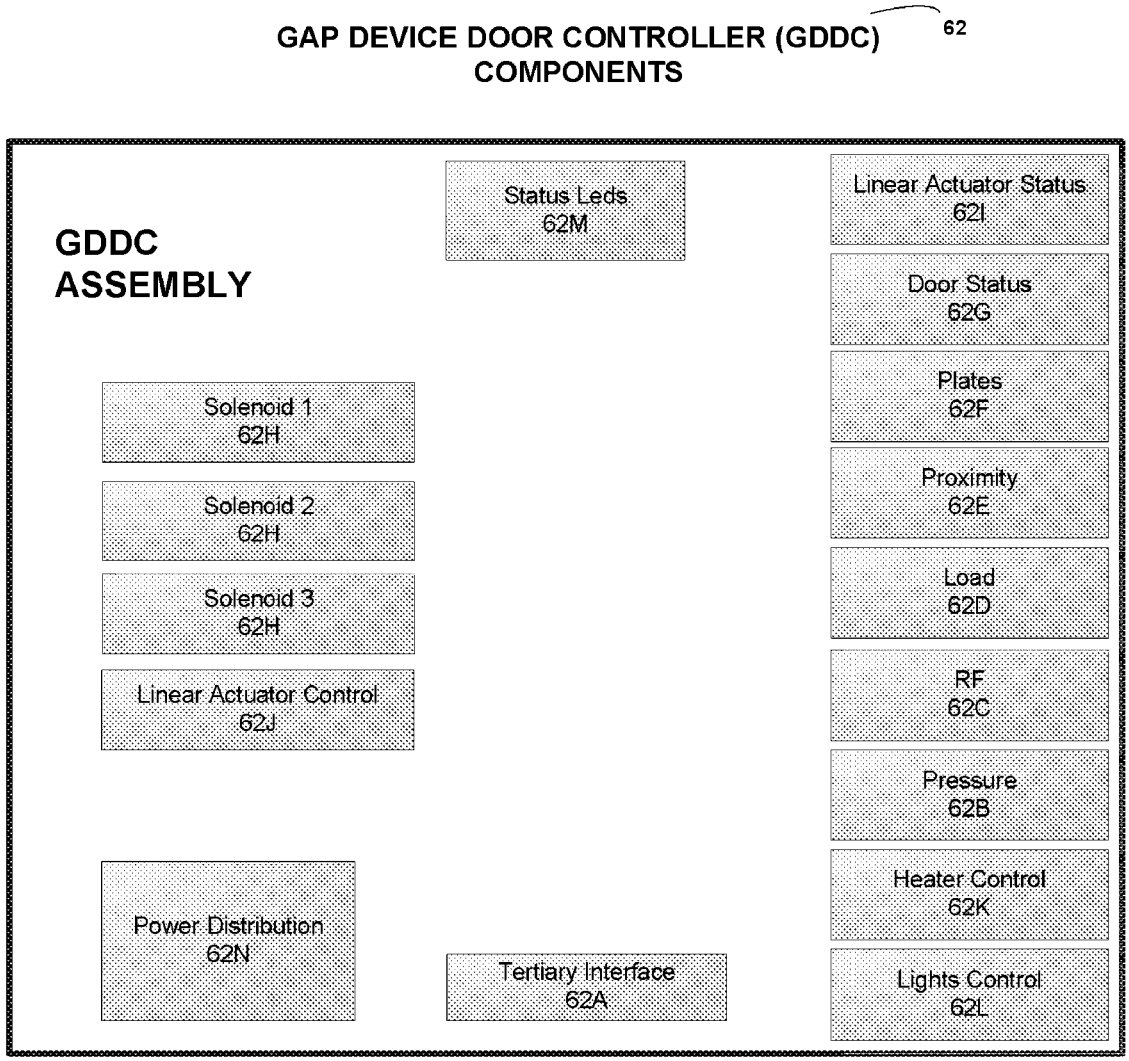
FIG. 5 is a block diagram for Gap Device Door Controller (GDDC) components according to the present invention.
Figure 9:
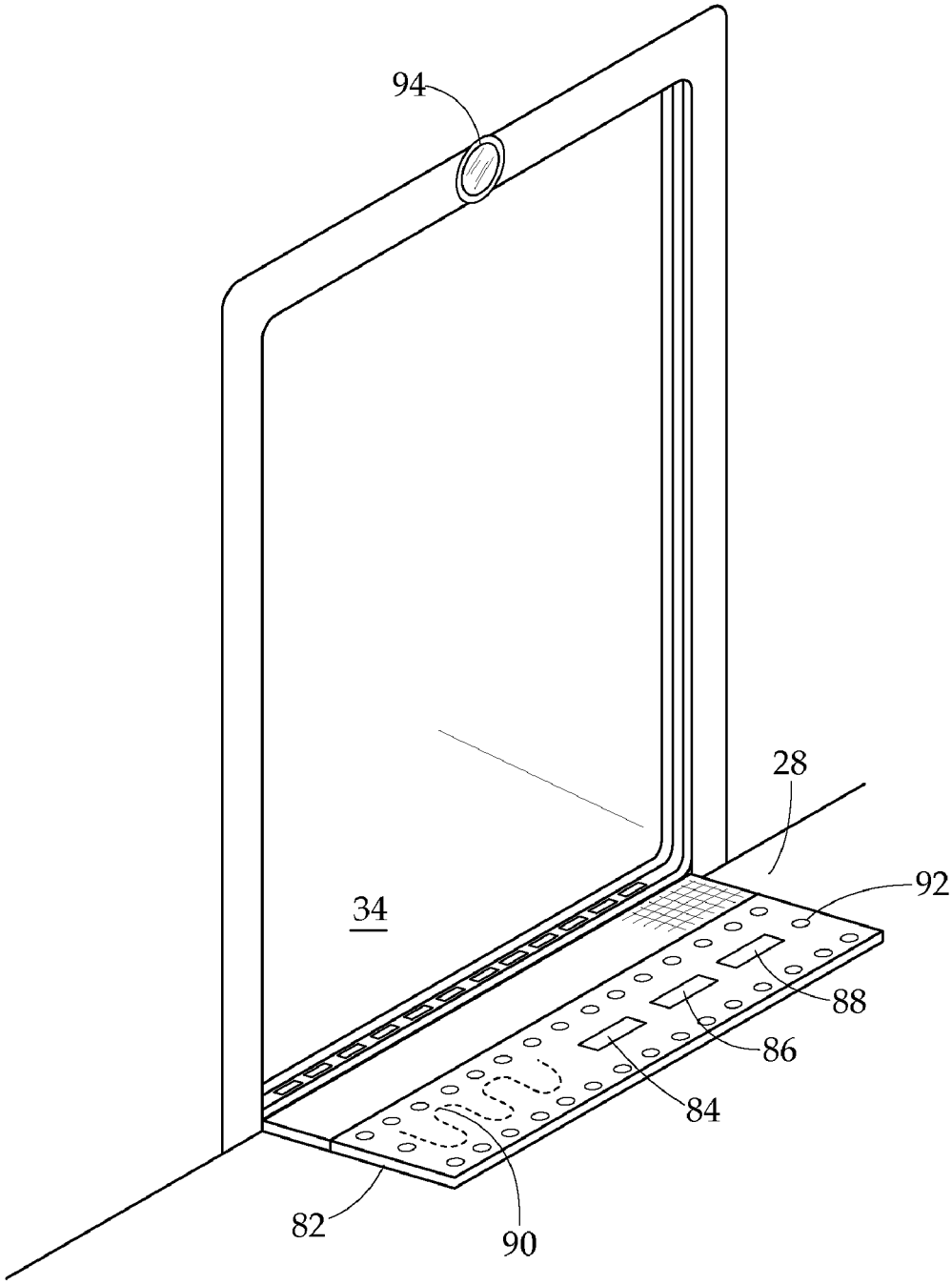
FIG. 9 is a top perspective view of the first plate structure shown in FIG. 7 with exploded view depicting location of camera and various sensors and apparatus on and within said plate structure according to the device of the present invention.

Now referring to FIGS. 5 and 9, the Preferred Components of the GDDC 62 are, but not limited to, the following:

Tertiary Interface 62A—component receiving commands and status instruction from TCDC 56 for GDDC 62 and, in turn, communicating status information back to TCDC 56 through a tertiary wireless or wired interface connection conduit 58.

Pressure Sensor 62B—to monitor the hydraulic or pneumatic pressure (if utilized) required to activate and support the mechanical motion devices which are the driving mechanism for the plate component of the device of the present invention.

Radio Frequency (RF) Sensor 62C—to monitor status of persons or objects located on or adjacent to the present invention's device to alert train personnel as to proper activation and deactivation as well as actions of public.

Load Sensor 62D—to monitor status of this plate component 84 to ascertain if plate deactivation can safely occur and, if not, train personnel alerted to investigate.

Proximity Switch 62E—this is a sensor which will signal to a corresponding component 86 on each plate during the activation process if there be any obstruction to its intended path and, if so, all plates sought to be activated will return to deactivated and stowed position. If an obstruction is located during the deactivation process, the proximity switch sensor or other like device will minimize and/or prohibit further device movement with train personnel then to be alerted by visual and/or audio means to investigate.

Plate Sensor 62F—through its corresponding plate component 88, informs status and location of device plate components in their deactivated and stowed position and functionality during activation process and deactivation process.

Door Status 62G—monitors all doors in the train car to ensure coordination between each door and corresponding device of the present invention as to door opening/closure with device activation/deactivation.

Mechanical Motion Device Control 62H—if pneumatic or hydraulic mechanical motion device utilized to drive and support the device of the present invention, this valve controls release of air or fluids to the mechanical motion device when the device is sought to be activated and deactivated.

Linear Mechanical Motion Device Status 62I—to monitor speed and position of the mechanical motion device relative to its functionality with plate components of embodiment under train vestibule floor.

Linear Mechanical Motion Device Control 62J—if electrical power utilized to drive and support the device of the present invention, this supplies electrical power utilized to drive and support the device of the present invention during activation and deactivation.

Heat Control Sensor 62K—if alternative of heating element 90 is supplied to the plate component of the device of the present invention, this will ascertain status of the heat source to make certain it is properly working to specification and will regulate heat to ensure correct temperature.

Light Control 62L—if alternative of a light supply 92 is provided to work in conjunction with the plates of the present invention, this shall monitor functionality status and check candle power in accordance with design specifications.

Status Leds 62M—provides status of the sensor components of the GDDC 62.

Power Distribution 62N—this is the power source for the GDDC 62 circuitry.

6. Relevant TGI Transmittal Through Route Gap Signal Devices

In one preferred embodiment, as shown in FIG. 6, as an alternative to, or in conjunction with the above described procedure, in accordance with the transit line system's GDCP 40, the TGI-LUT 48 is to be communicated through a wireless interface network 46 to the RGSD 38.

As each train travels on its particular route, the RGSD 38 will communicate through said wireless interface network 46 to the train's TSDMC 50 onboard computer system as to which station the train is next scheduled to stop in order for the train's onboard computer to then signal for and receive from the RGSD 38 the TGI-LUT 48 and then communicate TCDC-LUT 54 to the TCDC 56 through a secondary interface connection 52 to the TCDC 56, and then the TCDC 56 further communicates GDDC-LUT 60 through a tertiary interface connection 58 to the GDDC 62, as previously described.

It will be appreciated by one skilled in the art, that in either of the preferred embodiments of the present invention, the above communications from the GDCP 40 in the transit line system's computer 42 to the TSDMC 50 computer within the trainset and to the TCDC 56 and GDDC 62 in each train car is transmitted via a wireless, wired or any known device within the industry via an interface network connection. This communication occurs via specified frequency channels set forth by the transit line system's operator. These frequencies are consistently transmitted, received and analyzed by the various devices of the present invention previously described.

Preferably the GDCP 40 shall be written to provide the following priority override systems and, correspondingly, the transit line system must provide appropriate wireless or wired interface connections to carry out the following protocols:

(a) malfunctioning or failure of the TSDMC 50 such that TCDC-LUT 54 can be communicated directly from the transit line system's computer 42 to the TCDC 56.

(b) malfunctioning or failure of the TCDC 56 in a particular train car such that GDDC-LUT 60 can be communicated to the appropriate GDDC 62 from another TCDC 56 or, in the alternative, directly from TSDMC 50 or the transit line system's computer 42.

(c) malfunctioning or failure of any GDDC 62 such that GDDC-LUT 60 can be communicated to the device of the present invention normally controlled by said GDDC 62 from the appropriate TCDC 56, or by the TSDMC 50, or by the transit line system's computer 42.

(d) malfunctioning or failure of all above priority override systems, then to permit activation and deactivation of the device, or shut-down of the device, manually by trainset personnel.

7. Device Activation and Deactivation

Referring collectively to FIGS. 2-6, pursuant to the GDCP 40, the GDDC-LUT 60 communicated to the GDDC 62 shall preferably be activated and deactivated according to the following protocol.

Figure 3A:
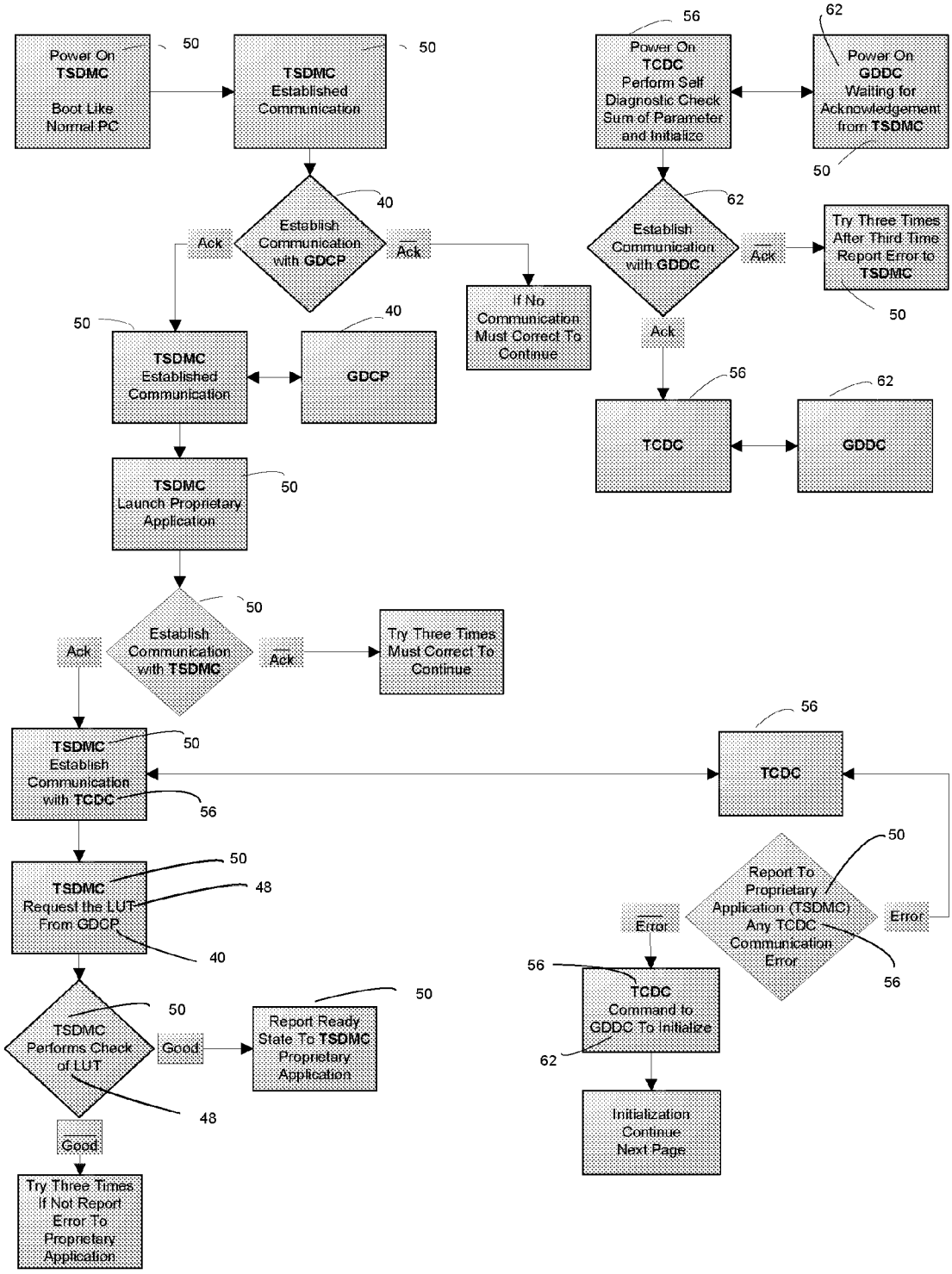
FIGS. 3A-3F collectively is the decision tree logic flowchart for the proprietary computer application program according to the present invention.
Figure 3B:
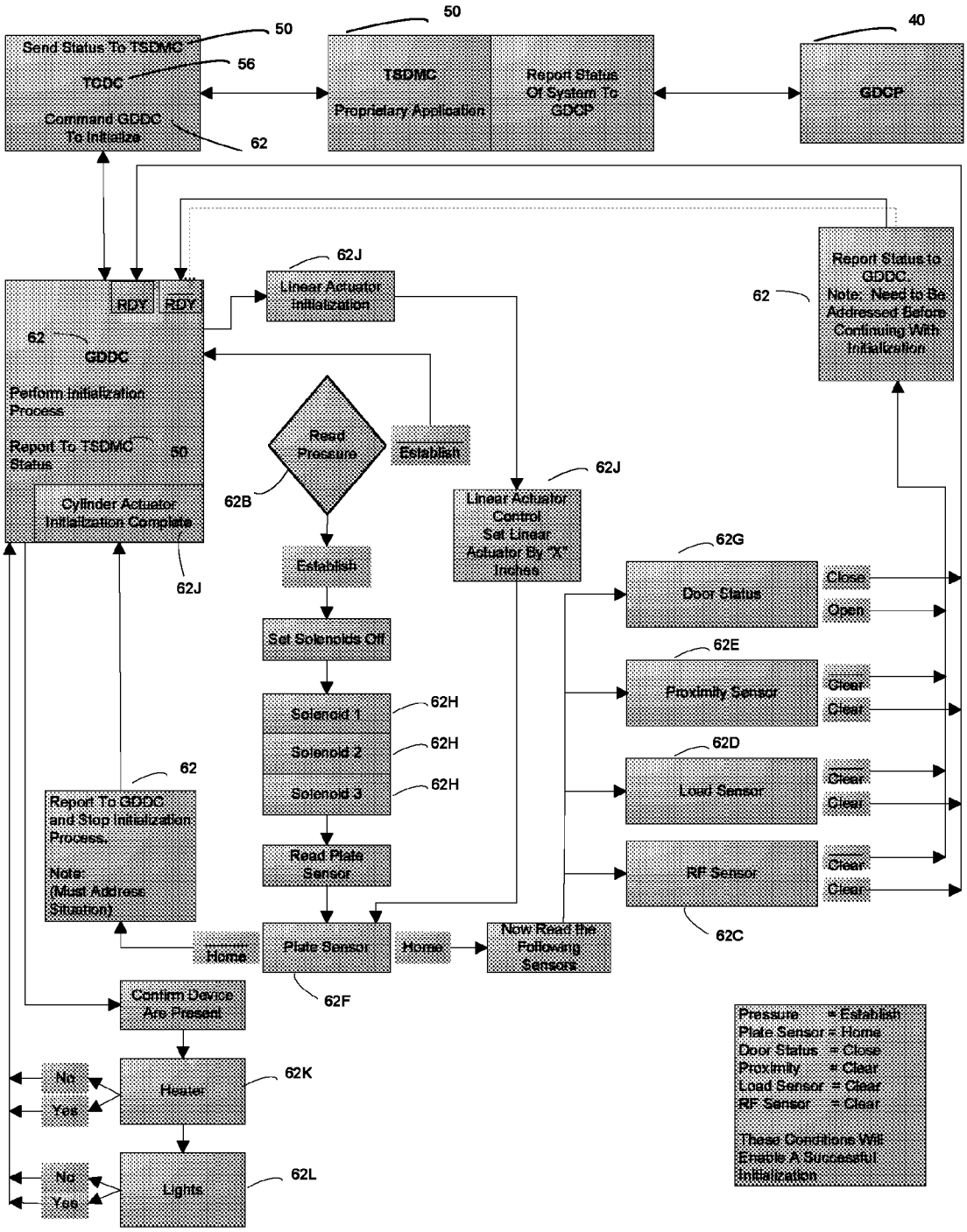
Figure 3C:
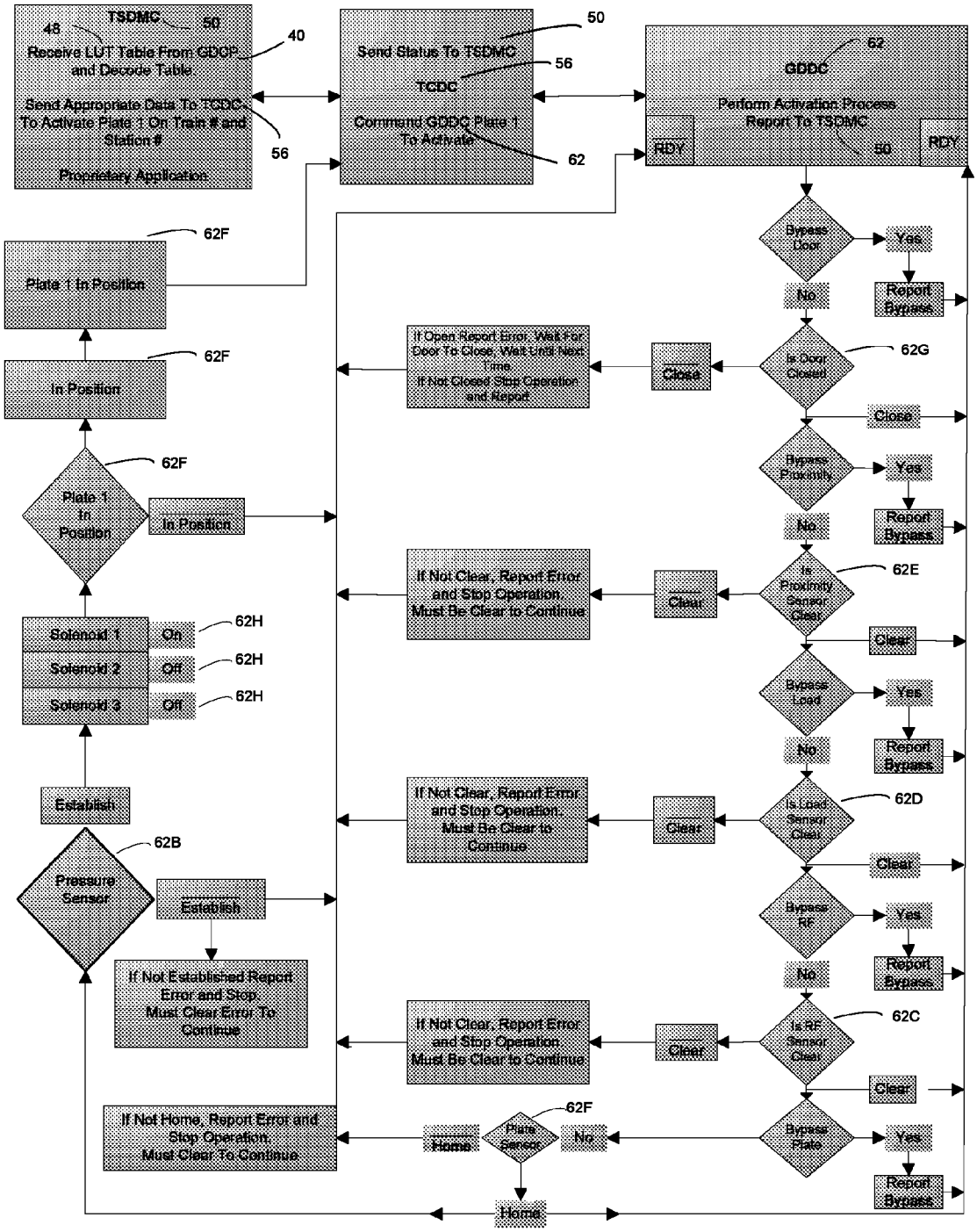
Figure 3D:
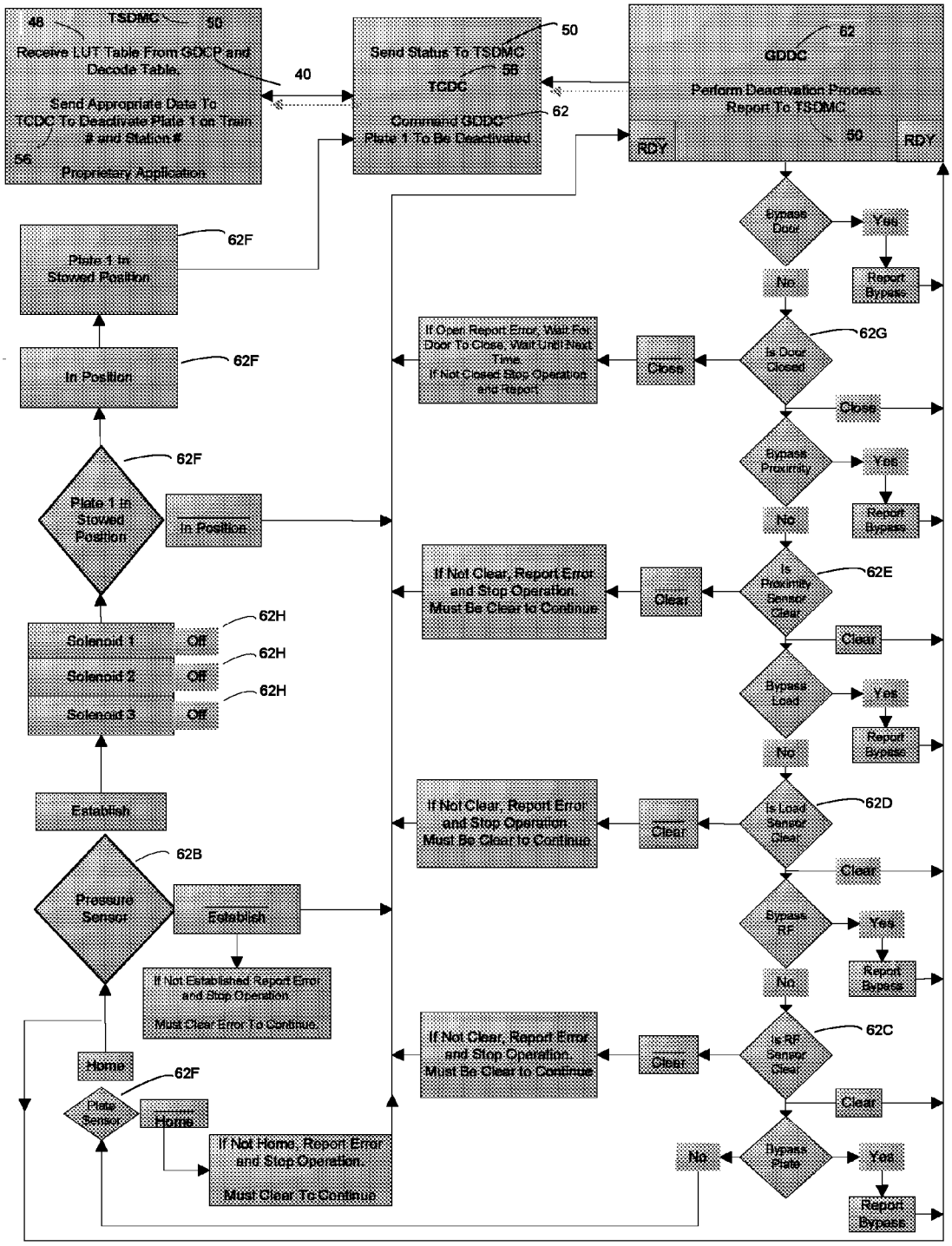
Figure 3E:
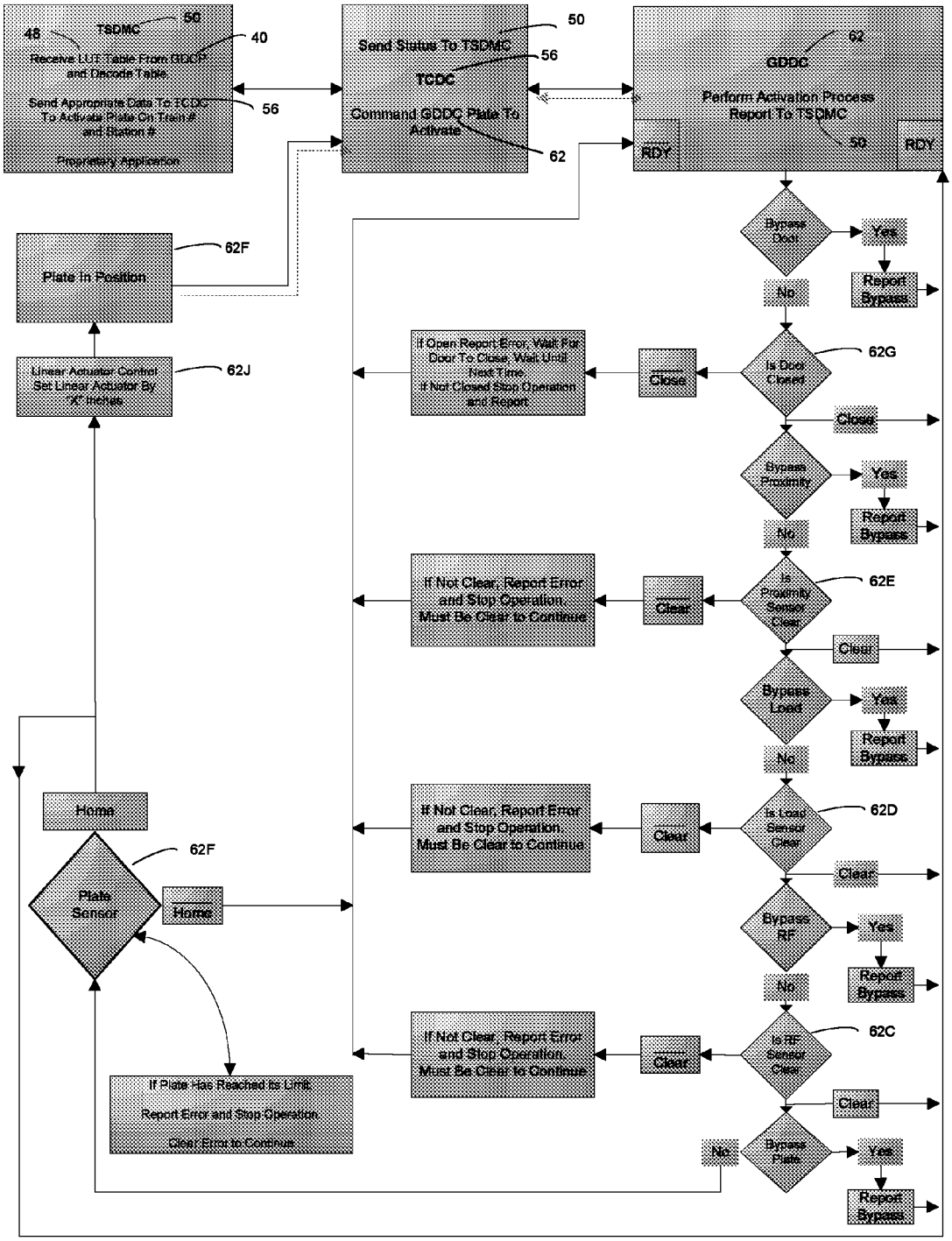
Figure 3F:
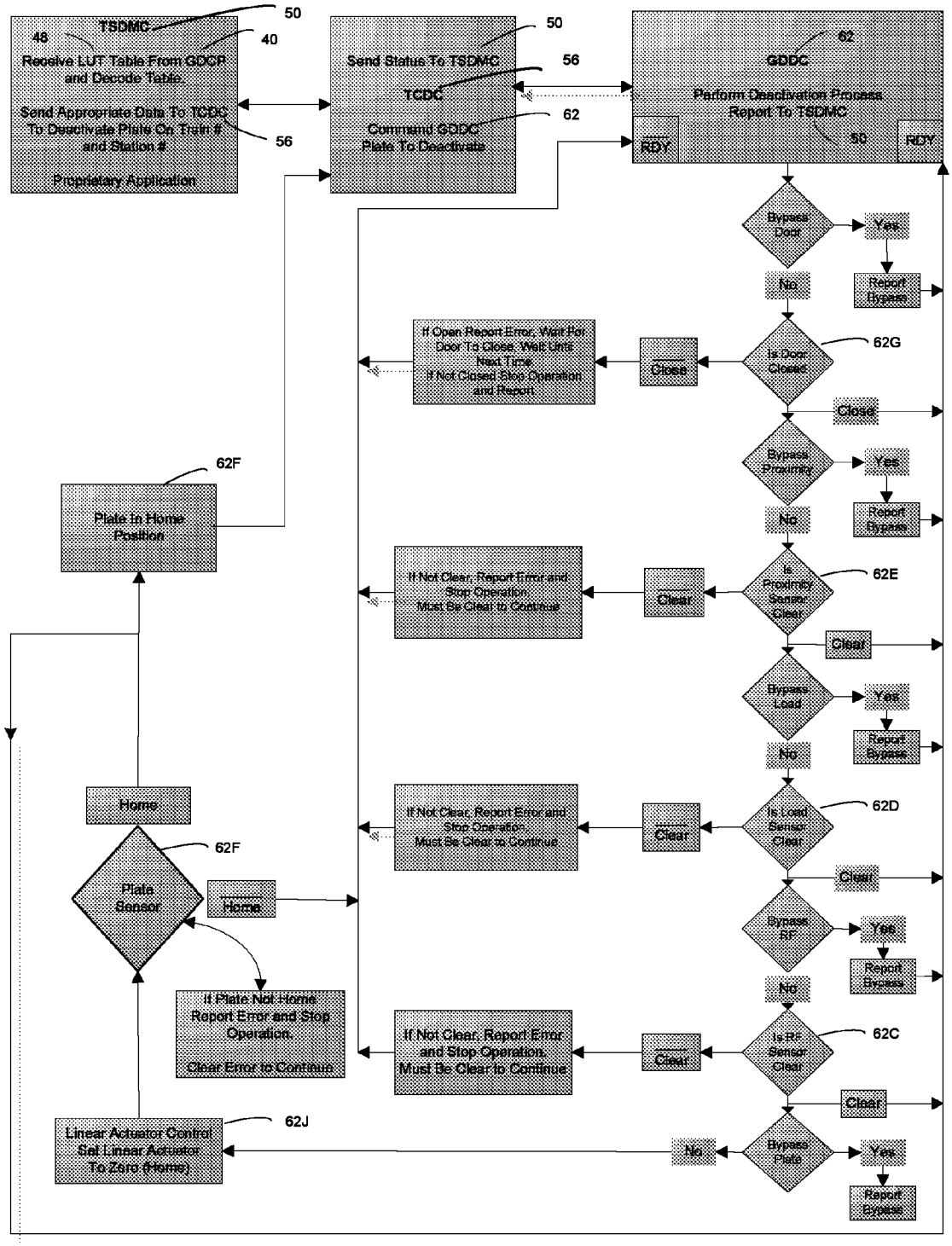

The device of the present invention's boot-up and initialization processes for all plate structures first through seventh are shown in FIGS. 3A and 3B; the activation and deactivation processes for plate structures first through sixth are shown in FIGS. 3C and 3D; and the activation and deactivation processes for the seventh plate structure are shown in FIGS. 3E and 3F.

The computer firmware program 56B housed within the flash memory 56A component of the TCDC 56 shall via its central processing unit 56C appropriately signal from its tertiary interface component 56E through a tertiary interface communication system 58 to the corresponding tertiary interface connection 62A housed within the GDDC 62 that the device is to be moved from its deactivated and stowed position and become activated.

Preferably, the signal shall be routed through the GDDC's tertiary interface connection 58 to either the appropriate solenoid control valves 62H (if pneumatic or hydraulic mechanical motion device is used) or linear control system 62J (if electrical mechanical motion device is used) governing the working of the mechanical motion devices 64.

Preferably, said control valves 62H and linear mechanical motion device control 62J are housed within the GDDC 62. Further, all components of the TCDC 56 and the GDDC 62, as described hereinabove, must be in proper working function and, if so, the activation process will further continue. Upon receipt of the affirmative signal to activate, the solenoid valves 62H or the linear control system 62J, as the case may be, will cause release of air or fluids (if pneumatic or hydraulic mechanical motion device used) or electrical power (if linear mechanical motion device used) through hoses or conduit to certain mechanical motion devices removably coupled to each plate component of the device of the present invention and which release shall cause activation of each such plate component sought by the train line operator to be activated.

In accordance with the transit line system's GDCP 40, when signal is provided to commence device activation, the device will then be singularly and independently deployed at each door 12 of each train car of the trainset thereby accommodating desired gap minimization at that particular platform edge 20 corresponding to that particular train car door 12.

The aforesaid mechanical motion devices 64 are further described hereinafter.

When it is desirable for plate deactivation, preferably same is to generally occur in the following manner. The TCDC's computer firmware program 56B through its CPU 56C shall signal to the aforementioned appropriate solenoid valves 62H/linear control system 62J to draw back the air, fluids or electrical power, as the case may be, from the mechanical motion devices and which function shall cause deactivation of each activated plate component and the consequent return to its deactivated and stowed position.

All plate structures of the device of the present invention shall be activated and deactivated in accordance with the above described procedures.

8. Mechanical Motion Device

Preferably, the device of the present invention shall be comprised of a component that creates mechanical motion by converting various forms of energy to rotating or linear mechanical energy. Each plate component of the present invention shall preferably have at least one such appropriately positioned mechanical motion devices forming a part thereof. The number of mechanical motion devices so utilized will be determined by the transit line system operator. The mechanical motion device shall serve a two-fold purpose, that is, to facilitate movement in the activation and deactivation processes of the plate component of the present invention's device as well as to provide support for said plate component in its deactivated and activated positions.

Preferably, the mechanical motion device 64 is an actuator, as shown in FIGS. 7, 11, 14, 20, 21, 22 and 28. The type of actuator shall consist of either a linear actuator, hydraulic actuator or pneumatic actuator. Of course, it will be appreciated by one skilled in the art that such mechanical motion device component of the present invention is not limited to the type of mechanical motion devices previously described and that various other types of mechanical motion devices may be utilized to enable activation/deactivation of the device of the present invention.

Figure 11:
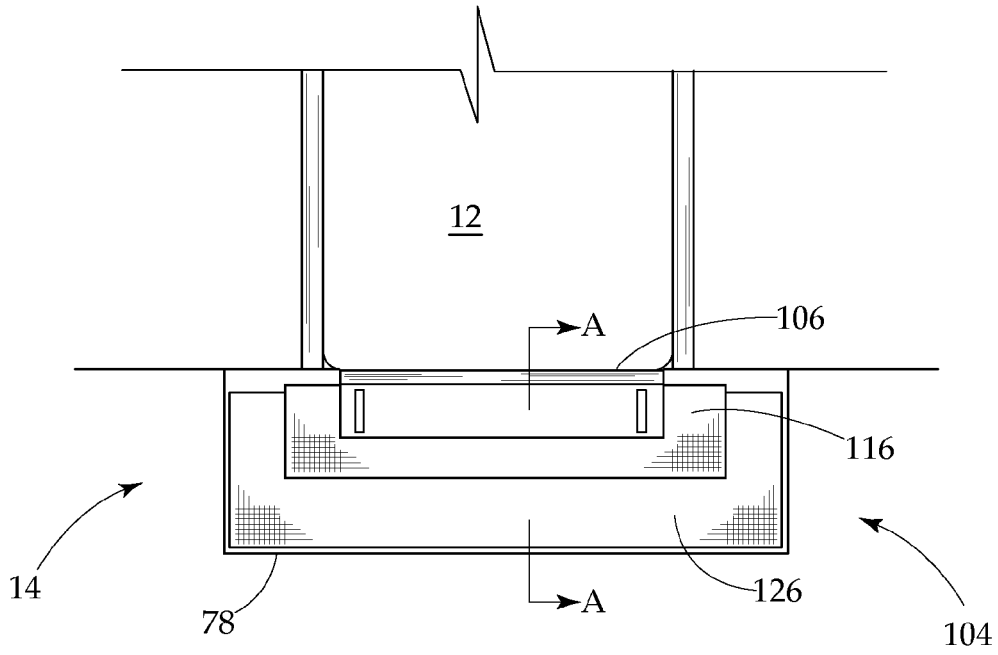
FIG. 11 is a third plate structure according to present invention depicting front and exploded side perspective views of its grooved plate structure, with hinge, mounting plate and mechanical motion device, showing first plate activated with second and third plates deactivated.
Figure 11:
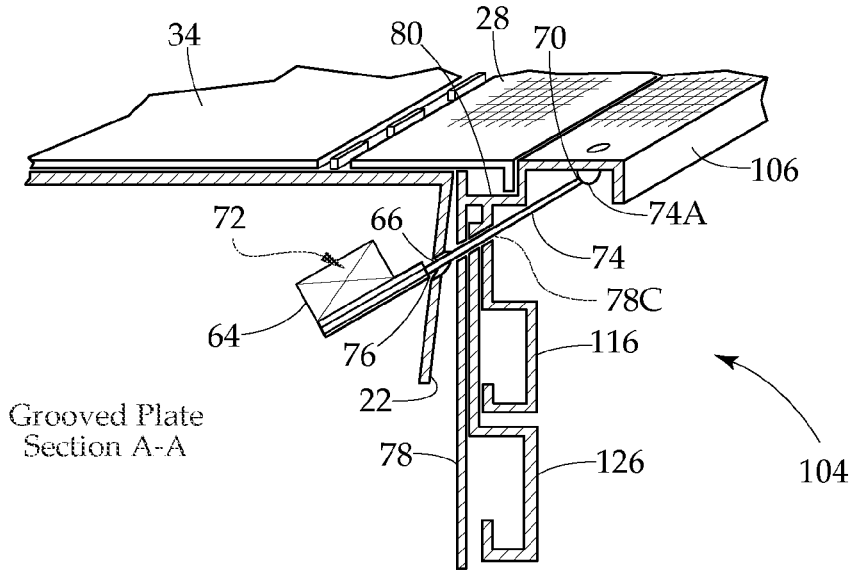
Figure 14:
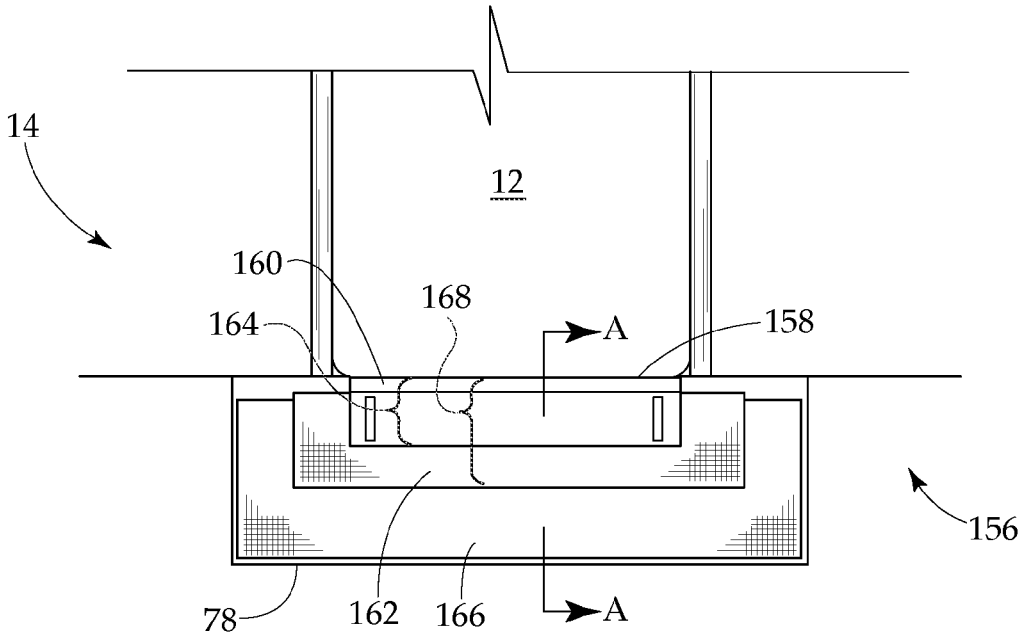
FIG. 14 is a fifth plate structure according to the present invention depicting front and exploded side perspective views of its interlocking plate structure, with hinge, mounting plate and mechanical motion device, showing first plate activated with second and third plates deactivated.
Figure 14:
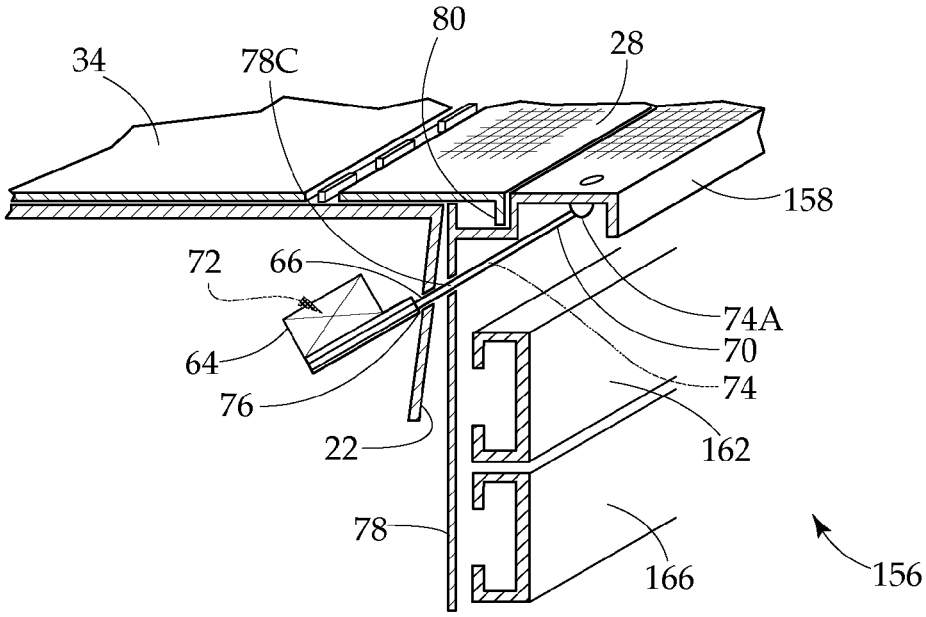

In some preferred embodiments, such as with plate structures first through sixth, as shown in FIGS. 7, 11, 14, hereinafter described, one end 66 of the mechanical motion device 64 shall be removably coupled by any known means, such as by bolts, screws or welding, to the exterior of the train car 10 below and/or adjacent to each of the train car doors 12 within the train set or within the train car's undercarriage 24.

Preferably, the mechanical motion device 64 has pivot mounting capability from standpoint of attaching same to plate component of the present invention thereby allowing the mechanical motion device 64 to move as a link in a dynamic assembly in coordination with the preferred movement of said plate component.

In some preferred embodiments, such as with plate structures first through sixth, as shown in FIGS. 7, 8, 11, 14, 15, hereinafter described, the corresponding other end 70 of the mechanical motion device 64 is removably coupled to the device of the present invention resulting from the following described interaction. Preferably, there is a motor housing component 72 to the mechanical motion device 64 containing a rod 74, commonly referred to as an "extender rod" or a "thrust rod", capable of extending outward therefrom and further capable of retracting into said housing component 72. The rod component 74 of the mechanical motion device 64 is preferably fitted through a singular or a plurality of predetermined slotted openings 76 in the train car's outer carriage 22 or, in the alternative, through said slotted openings 76 and correspondingly through a singular or a plurality of predetermined slotted openings 78C in a mounting plate 78 component, hereinafter described, of the present invention's device with said rod component 74, by means of said opening[s], to be removably coupled by any known means, such as by bolts, screws or welding, to the plate component of the present invention's device, or, in the alternative, by the use of a hinged bracket 74A to the underside of the plate component 98A.

Upon device activation signal having been received by the GDDC 62, as hereinabove described, the rod component 74 of the mechanical motion device 64, preferably an actuator, will customizedly extend outward from its housing 72 and its stroke, the distance traveled by the rod 74, is predetermined, in accordance with GDDC-LUT 60, to be the sufficient and necessary distance such that the plate component of the present invention's device as coupled to the mechanical motion device 64, as described above, is moved upward from its stowed deactivated position as part of a dynamic assembly action to its activated position which is hereinafter described.

Upon signal for device deactivation having been received by the GDDC 62, as hereinabove described, the rod component 74 will appropriately retract into its housing 72 correspondingly causing the plate coupled to the mechanical motion device 64 to move downward as part of a dynamic assembly action and return to its original stowed deactivated position.

In yet another preferred embodiment, such as with the seventh plate structure, hereinafter described, one end 68, as shown in FIGS. 20, 21, 22, 28, of said mechanical motion device 64, shall be removably coupled by any known means, such as by bolts, screws or welding, to the frame 194 itself, below described and referred to in FIGS. 19, 21-28, or, in the alternative, one end 68A of the mechanical motion device 64 shall be so removably coupled to the supporting framework of that part of the train car's undercarriage 24 below the vestibule floor 34 in an area adjacent to location of the frame 194 which shall house said plate structure.

Figure 28:
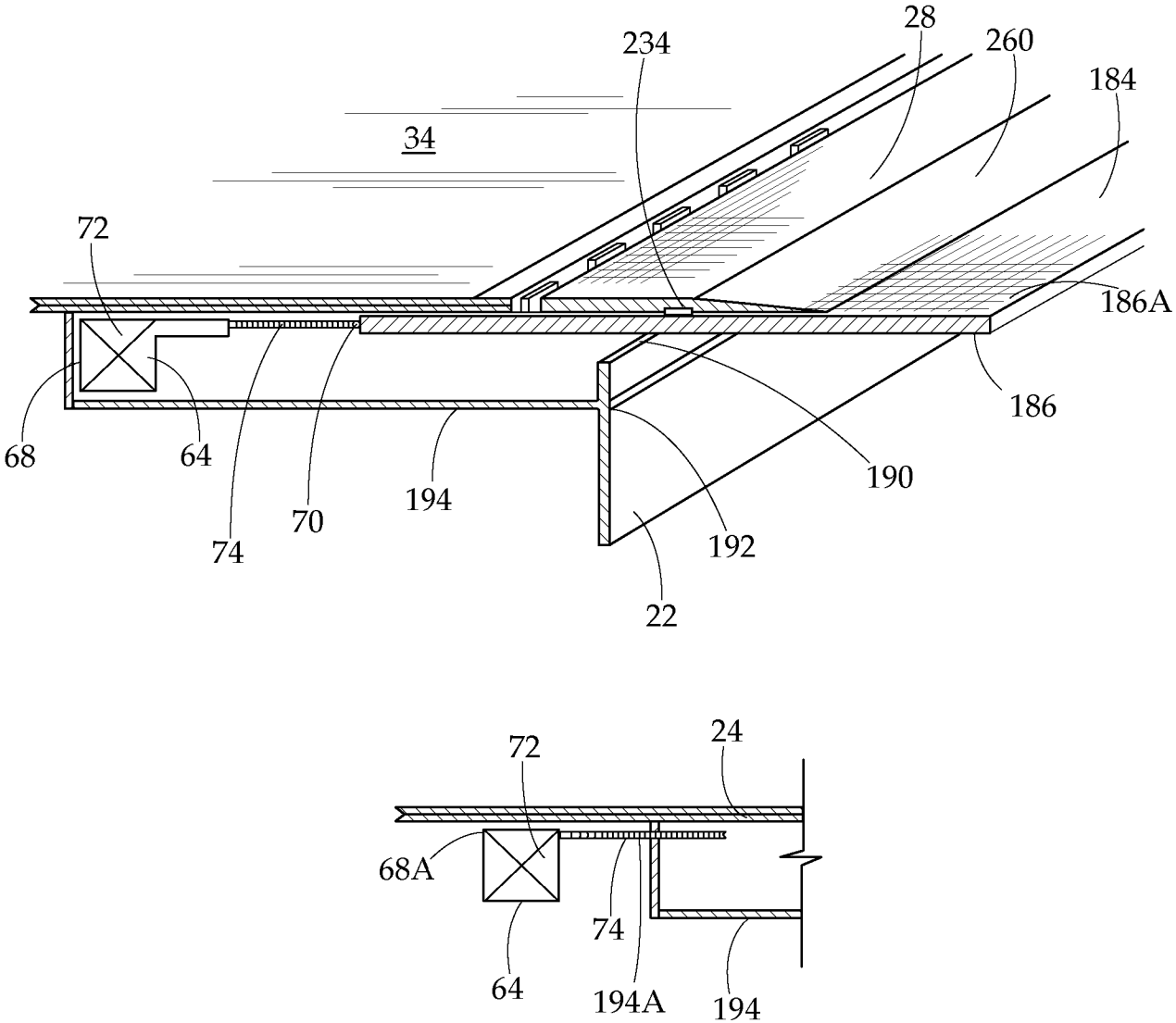
FIG. 28 is a seventh plate structure shown in FIG. 17 according to present invention depicting side perspective view with newly configured threshold plate design with intermediate structure attached to underside of plate component and exploded perspective view of mechanical motion device attached to train car undercarriage and frame of FIG. 19.

In this embodiment, such as with the seventh plate structure, as shown in FIGS. 20, 21, 22, 28, preferably, the corresponding other end 70 of the mechanical motion device 64 is removably coupled by any known means, such as by bolts, screws or welding, to the plate component of the present invention's device which, as aforementioned, is housed within the frame 194 or, in the alternative, to the plate component and the frame 194 (not shown in FIG. 28).

Preferably, the coupling of said mechanical motion device 64 to the plate component of the present invention as referred to in the immediately preceding paragraph is to be by use of a rigid mounting style for purposes of restricting motion to straight-line travel paths.

There is, preferably, a motor housing component 72 to the mechanical motion device 64 containing a rod 74 capable of extending outward therefrom and further capable of retracting into said housing component.

Preferably, the mechanical motion device 64 is to be housed within the frame 194 or to the frame's exterior at its rearward section and which section corresponds to the hereinafter described slotted opening 190 shown in FIGS. 17, 18, 20, 22 and 28.

Upon device activation signal having been received by the GDDC 62, as hereinabove described, the rod 74 component of the mechanical motion device 64, preferably an actuator, will customizedly extend outward from its housing 72 and its stroke, the distance traveled by the rod 74, is predetermined, in accordance with GDDC-LUT 60, to be the sufficient and necessary distance such that the plate component of the present invention's device as coupled to the mechanical motion device 64, as described above, is extended in a horizontal direction towards the edge of the station platform 20 in a manner as hereinafter described.

Preferably, the mechanical motion device 64 referred to hereinabove in said embodiment, such as with the seventh plate structure, is to be equipped with a form of position sensors, or other like devices, the purpose of which are to signal the appropriate components of the GDDC 62 that the rod 74 component of the mechanical motion device 64, and thereby the plate component of the present invention's device, is about to travel beyond its desired safe operating region and is nearing its predetermined physical end of stroke, in accordance with GDDC-LUT 60, with the GDDC 62 bringing the mechanical motion device 64 and the plate component to a stop at the desired gap minimization point thereby preventing physical contact of the present invention's device with the platform edge 20 and further avoiding damage to the mechanical motion device 64, the present invention's device and the platform edge 20.

9. Mounting of Plate Component of Present Invention's Device to Train's Outer Carriage or to a Mounting Plate In certain preferred embodiments, such as with plate structures first through sixth, the plate component of the present invention's device shall be removably and appropriately coupled to the exterior of the train car 10 by any known means, such as by the use of hinges to be affixed by bolts, screws or welding to the train's outer carriage 22 and to the device's plate component. The location of said hinged coupling is to be at such location on the train's outer carriage 22 so as not to interfere with or hinder plate activation or deactivation by use of the above described mechanical motion device 64.

In yet other preferred embodiments, such as with plate structures first through sixth, as shown in FIGS. 7, 8, 10-16, the plate component of the present invention's device shall be removably and appropriately coupled to the mounting plate 78, above mentioned, by any known means, such as by the use of a continuous hinged bracket 80 to be affixed by bolts, screws or welding to said mounting plate 78. The location of said continuous hinged bracket 80 is to be at such location on the mounting plate 78 so as not to interfere with or hinder plate activation or deactivation by use of the above described mechanical motion device 64.

Preferably, the mounting plate 78, as shown in is made of a hardened material, such as titanium or steel, and may be formed by casting or molding. In one preferred embodiment, the mounting plate 78 will be selectively sized and shaped and so coupled to the exterior of the train car 10 as to be coplanar with the outer carriage 22 of the train 10 with the mounting plate 78 being rearwardly tapered to follow the contour of said outer carriage 22 being consonant with the aerodynamics of the train 10. In another preferred embodiment, the mounting plate 78 can be selectively sized and shaped having a straight plate contour which is coplanar with the train's outer carriage 22.

The part of the mounting plate's 78 surface that is coplanar with the train's outer carriage 22 shall be referred to as its inner portion 78B. The corresponding other side of the mounting plate's 78 surface shall be referred to as its outer portion 78A.

The mounting plate 78 is utilized as a surface whereby the plate component of the device of the present invention, in some preferred embodiments, shall be attached to the outer portion 78A thereof with the plate component in its deactivated and stowed position being coplanar with the outer portion 78A of the mounting plate 78.

Preferably, the mounting plate 78 shall have a plurality of predetermined slotted openings 78C within the plate body to allow, as hereinabove described, for the rod component 74 of the mechanical motion device 64 to be preferably fitted through and thereby engage the plate component of the present invention.

Advantageously, the mounting plate 78 serves a multifaceted purpose, in that, not only does it allow for a preferred location for the plate component of the present invention to be attached, but, preferably, it provides further stability and support for the device of the present invention and permits a surface for attaching other components, such as the TCDC 56 and/or the GDDC 62, of the device of the present invention as hereinabove described.

Of course, it will be appreciated by one skilled in the art that the utilization of the surface of the plate, preferably herein being a mounting plate, for purposes of housing, as hereinabove described, the delineated support control systems device (GDDC 62) previously described or any other component of the device of the present invention is not to be deemed limited thereby and that various other support control systems devices and various other types of components may be attached to the same or different segments of the mounting plate 78 of the present invention to enable or facilitate device activation/deactivation of the present invention.

In addition, it will also be appreciated by one skilled in the art, that in lieu of a plate, such as a mounting plate 78 described above, being attached to the outer carriage 22 of the train car 10, any other device suitable to support and facilitate the proper workings of the plate component and all other components of the device of the present invention may be utilized.

Furthermore, it will be appreciated by one skilled in the art, that the utilization of the plate, preferably a mounting plate 78, as described above, does not at any time obstruct and/or encroach upon the transit line system's side clearance standard hereinbefore described.

10. Sensors and Other Apparatus Comprising Plate Component

It will be appreciated by one skilled in the art that the device of the present invention may comprise any one or plurality of sensor devices and/or apparatus to facilitate activation and deactivation of the plate component of the present invention's device.

In one preferred embodiment of the present invention, as shown in FIG. 9, the plate component 82 of the device comprises a load sensor 84 to monitor, in conjunction with the GDDC load sensor 62D shown in FIGS. 3B-3F and 5, the load on the plates after the boarding/alighting process has stopped and the train doors 12 are closed. Its purpose is to ascertain if plate deactivation can safely occur and, if not, train personnel to be alerted, by visual and/or audio means, to investigate.

In another preferred embodiment of the present invention, as shown in FIG. 9, the device comprises a proximity sensor 86 or other like device. This proximity sensor 86 will be programmed into the GDCP 40 application to monitor, in conjunction with the GDDC proximity sensor 62E shown in FIGS. 3B-3F and 5, the activation and deactivation procedures of the device of the present invention for any interferences or intrusions that interrupt said procedures. If an obstruction is located during the activation process, it will stop the device from further activation and bring the device back to its home stage. If an obstruction is located during the deactivation process, the proximity sensor 86 or other like device will minimize and/or prohibit further device movement with train personnel then to be alerted by visual and/or audio means to investigate.

In yet another preferred embodiment of the present invention as further shown in FIG. 9, the device comprises a plate sensor 88. This sensor will monitor, in conjunction with the GDDC plate sensor 62F shown in FIGS. 3B-3F and 5, plate status and the location of each plate at all times during activation and deactivation stages.

In a further preferred embodiment of the present invention additionally shown in FIG. 9, the device comprises a heat producing element 90, such as an electric coil, to be appropriately designed into the plate component of the present invention's device. It will supply a heat source to the plate component to further facilitate commuter safety during inclement weather while boarding/alighting the train 10. The heat generated will melt any ice or snow that has accumulated on the device of the present invention. A heat control sensor 62K, as shown in FIGS. 3B and 5, will be appropriately located in the GDDC 62 to monitor same.

In another preferred embodiment of the present invention as depicted in FIG. 9, the device comprises a light-emitting diode (LED) apparatus 92. The illumination provided by said apparatus will allow commuters to have visual perspective pertaining to the extended boarding area created by the plate component of the present invention's device as it is being activated and its corresponding relationship to the platform edge as commuters are boarding or alighting. Preferably, there will be a plurality of LED's 92 appropriately positioned within each plate component of the device such as to be coplanar with the upper surface thereof. The LED series 92 to be incorporated within the plate structure preferably will be of any known color or by use of a plurality of colors within the color spectrum, such as red, yellow, and/or green, consistent with priority of raising commuter awareness to the boarding area during the various stages of the activation and deactivation processes. A light control 62L, as shown in FIGS. 3B and 5, will be appropriately located in the GDDC 62 to monitor same. The transit line system operator must take into account any state and/or federal laws or regulations as to the degree of illumination, if any, required as result of extension of the threshold plate boarding area by the device of the present invention.

In an additional preferred embodiment of the present invention also shown in FIG. 9, the device comprises visual aid apparatus 94 with recording capabilities, such as a camera. To ensure commuter safety, this apparatus is to be appropriately positioned on the plate component device of the present invention or on the exterior of the train 10 for purposes of monitoring device activation/deactivation. The aforesaid apparatus preferably is to have direct communication with the TSDMC 50 thereby alerting train personnel, if necessary, to investigate.

11. First Plate Structure—Single Plate Device Symmetrical with Threshold Plate

A common type threshold plate 26 presently being utilized by transit line systems is depicted in FIG. 1. This plate configuration has no adjustment capability to respond to any gap minimization objectives sought by transit line system operators. Its very own design negates any attempt at gap mitigation. To merely enlarge the width of the threshold plate 26 immediately negatively impacts and hinders the aforesaid side clearance standard. A width enlargement design cannot be considered as a simple solution to a most complex problem facing every transit line system operator.

Referring to FIGS. 7 and 8, in one preferred embodiment, the device consists of a first plate structure 96 according to the present invention comprised of a single plate 98 separate and distinct from the standard threshold plate 26 of the train car 10.

The plate 98 shall be selectively sized and shaped consistent with the principles set for above. The width of the plate 98 of this embodiment shall be determined by the transit line system consistent with its gap minimization goals desired taking into specific account the TGI-LUT 48 for each of the train routes within its system. The length of the plate 98 shall preferably be the same as the length of the threshold plate exterior 28.

Said plate 98, when activated in accordance with the activation procedure above described, shall be raised upward from its stowed position until it is symmetrical to and horizontally coplanar with the threshold plate 26 thereby minimizing the gap 16 and forming an extended boarding area for passengers to board and alight the train 10 onto the station platform 18.

Advantageously, the utilization of this plate structure 96, being that it is a single plate 98 of a selected width, provides timing flexibility to transit line operator relative to commencing activation procedures prior to the train entering each station on its then route in lieu of said process completely taking place after train has come to a stop at each station; further, deactivation procedures can be commenced while the train is in the process of leaving each station in lieu of said process fully occurring prior to train accelerating from its stopped position.

It is to be understood that, if this first plate structure 96 is to be utilized, the plate's 98 width must be selected with complete cognizance of TGI 44 for the entire transit line system given that the train cars forming any particular trainset are standardly interchangeable for purposes of being utilized on any route within the transit line on any given day.

Further, advantageously, the width of the plate 98 to be selected must be coordinated so as to take into account the transit line's side clearance standards to ensure safe passage of the train 10 into and out of the station if transit line elects to have plate 98 activated before train comes to a stop and elects to deactivate while accelerating from its stopped position.

The device's activation procedure and deactivation procedure shall be as hereinabove described.

In yet other preferred embodiments, the threshold plate 26 and the first plate structure 96, above described, are prefabricated as a single device.

12. Second Plate Structure—Single Plate Device Circumscribing Threshold Plate

Figure 10:
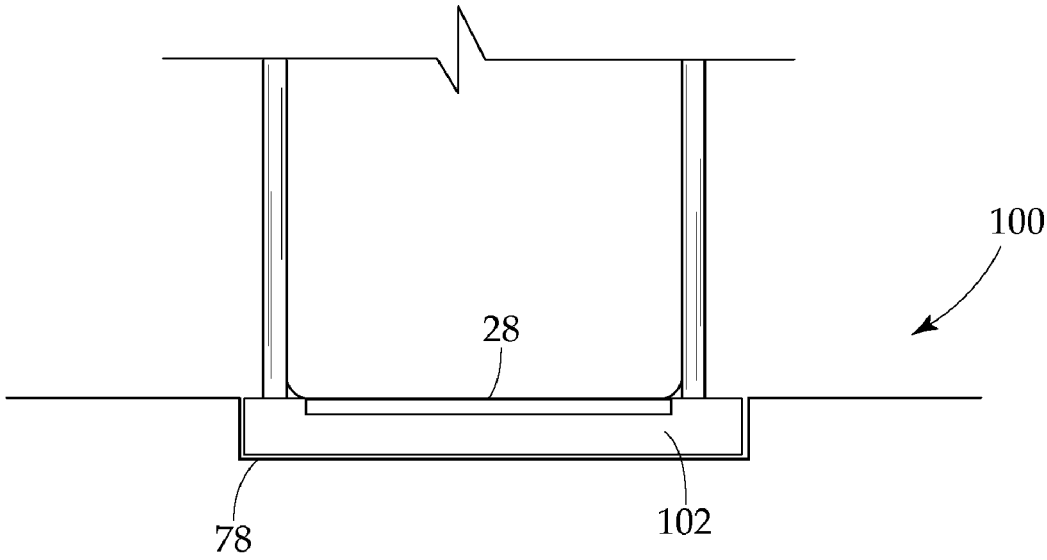
FIG. 10 is a second plate structure according to present invention depicting front and top perspective views of a single plate, which circumscribes threshold plate, in deactivated and activated positions including a mounting plate.
Figure 10:
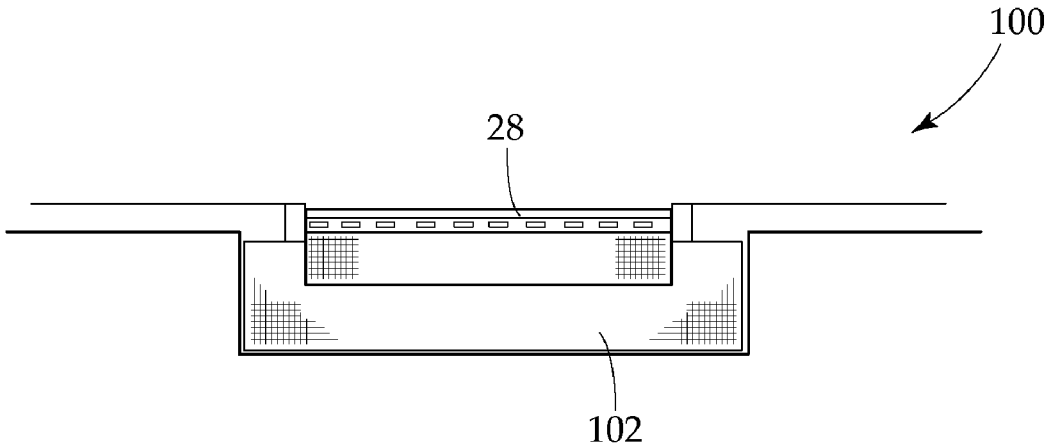

Referring to FIG. 10, in one preferred embodiment, the device consists of a second plate structure 100 according to the present invention comprised of a single plate 102 separate and distinct from the standard threshold plate 26 of the train car 10.

Unless specifically modified below, all information heretofore provided pertaining to the first plate structure 96, above described, is repeated as if more completely set forth at length herein for second plate structure.

Said plate structure 100 is to be selectively sized and shaped such that when activated, in accordance with the same activation procedure described hereinabove, this plate 102 shall be raised from its stowed position until it is horizontally coplanar with the threshold plate 26 and circumscribes the threshold plate exterior 28.

The device's activation procedure and deactivation procedure shall be as hereinabove described.

In yet other preferred embodiments, the threshold plate 26 and the second plate structure 100, above described, are prefabricated as a single device.

13. Third Plate Structure—Grooved Plates with Initial Plate Symmetrical with Threshold Plate Referring now to FIGS. 11 and 12, a device comprising the third plate structure 104 of the present invention consisting of a plurality of plates is disclosed each having a partially hollowed out section. These figures depict a device comprised of 3-plates; however, the number of plates shown is solely to illustrate the various embodiments of this design mode.

A feature of this design is the flexibility permitted to the transit system operator to be able to minimize gap widths of variable sizes at each car door opening for all train cars of a trainset at every station within its entire system.

Thus, the actual number of plates to be installed on a train car utilizing the design concept of this embodiment shall be selected by the transit system operator.

Further, as shall be described below, the actual number of plates on each device installed for each train car door selected to be activated when a train stops at a station shall be determined by choice of the transit system operator in accordance with the system's TGI-LUT 48.

Regardless of the number of plates selected to be used in this design, the effect shall be to minimize the gap 16 then existing between the train car 10 and platform 18 by providing an extended boarding area allowing passengers to board and alight the train 10.

The size of each plate[s] selected shall take into account the known size for the train car doorway 14 threshold plate 26 then in use for the particular train car 10 on which the device is desired to be used.

The first plate 106 of the device referred to in FIGS. 11 and 12 shall be selectively sized and shaped such that when activated, in accordance with the activation procedure described hereinabove, this plate 106 shall be raised upward from its stowed position until it is symmetrical to and horizontally coplanar with the threshold plate 26 and the length of the plate 106 shall preferably be the same as the length of the threshold plate exterior 28.

Said first plate 106 shall have a partially hollowed-out section 108. This partially hollowed out section 108 shall be comprised of an upper portion 110 whose surface has been grooved out and a lower portion 112 whose surface is substantially coplanar with the bottom surface of the remaining non-hollowed out section 114 of the first plate 106.

The dimensions of the hollowed out section 108 of the first plate 106 shall be equivalent to that required such that the threshold plate exterior 28 shall totally fit within the aforementioned grooved out upper surface area 110 of the first plate 106 thereby minimizing the gap 16 and advantageously forming an extended boarding area for passengers to board from and alight onto the station platform 18.

The second plate 116 referred to in FIGS. 11 and 12 shall be selectively sized and shaped such that when it is activated, in accordance with the same activation procedure described hereinabove, this plate shall be raised from its stowed position until it is horizontally coplanar with and circumscribes the threshold plate exterior 28 and the first plate 106.

Said second plate 116 shall have a partially hollowed-out section 118. This partially hollowed out section 118 shall be comprised of an upper portion 120 whose surface has been grooved out and a lower portion 122 whose surface is substantially coplanar with the bottom surface of the remaining non-hollowed out section 124 of the second plate 116.

The dimensions of the hollowed out section 118 of the second plate 116 shall be equivalent to that required such that the threshold plate exterior 28 and the first plate 106, as activated, shall totally fit within the aforementioned grooved out upper surface 120 area of the second plate 116 thereby minimizing the gap 16 and advantageously forming a further extended and now enlarged boarding area for passengers to board from and alight onto the station platform 18.

The third plate 126 referred to FIGS. 11 and 12 shall be selectively sized and shaped such that when it is activated, in accordance with the same activation procedure described hereinabove, this plate 126 shall be raised from its stowed position until it is horizontally coplanar with and completely circumscribes the second plate 116.

Said third plate 126 shall have a partially hollowed-out section 128. This partially hollowed out section 128 shall be comprised of an upper portion 130 whose surface has been grooved out and a lower portion 132 whose surface is substantially coplanar with the bottom surface of the remaining non-hollowed out section 134 of the third plate 126.

The dimensions of the hollowed out section 128 of the third plate 126 shall be equivalent to that required such that the threshold plate exterior 28, the first plate 106 and the second plate 116, as activated, shall totally fit within the aforementioned grooved out upper surface 130 area of the third plate 126 thereby minimizing the gap 16 and advantageously forming an even further extended and further enlarged boarding area for passengers to board from and alight onto the station platform 18.

The manner of deactivation of all plates which have been activated shall be as described hereinabove.

In yet other preferred embodiments, the threshold plate 26 and the third plate structure 104, above described, are prefabricated as a single device.

14. Fourth Plate Structure—Grooved Plates with Initial Plate Circumscribing Threshold Plate A fourth plate structure 136 is disclosed in FIG. 13 consisting of a plurality of plates each having a partially hollowed out section. The figure depicts a device comprised of 3-plates; however, as with FIGS. 11-12, the number of plates shown is solely to illustrate the various embodiments of this design mode.

Unless specifically modified below, all information heretofore provided pertaining to the third plate structure 104 is repeated and completely set forth at length herein for the fourth plate structure.

The first plate 138 of the device referred to in FIG. 13 shall be selectively sized and shaped such that when activated, in accordance with the same activation procedure described hereinabove, this plate 138 shall be raised from its stowed position until it is horizontally coplanar with the threshold plate 26 and circumscribes the threshold plate exterior 28.

Said first plate 138 shall have a partially hollowed-out section 140. This partially hollowed out section 140 shall be comprised of an upper portion 110 whose surface has been grooved out and a lower portion 112 whose surface is substantially coplanar with the bottom surface of the remaining non-hollowed out section 142 of the first plate 138.

The dimensions of the hollowed out section 140 of the first plate 138 shall be equivalent to that required such that the threshold plate exterior 28 shall totally fit within the aforementioned grooved out upper surface area 110 of the first plate 140 thereby minimizing the gap 16 and advantageously forming an extended and enlarged boarding area for passengers to board from and alight onto the station platform 18.

The second plate 144 referred to in FIG. 13 shall be selectively sized and shaped such that when it is activated, in accordance with the same activation procedure described hereinabove, this plate 144 shall be raised from its stowed position until it is horizontally coplanar with and circumscribes the first plate 138.

Said second plate 144 shall have a partially hollowed-out section 146. This partially hollowed out section 146 shall be comprised of an upper portion 120 whose surface has been grooved out and a lower portion 122 whose surface is substantially coplanar with the bottom surface of the remaining non-hollowed out section 148 of the second plate 144.

The dimensions of the hollowed out section 146 of the second plate 144 shall be equivalent to that required such that the threshold plate exterior 28 and the first plate 138, as activated, shall totally fit within the aforementioned grooved out upper surface area 120 of the second plate 144 thereby minimizing the gap 16 and advantageously forming a further extended and further enlarged boarding area for passengers to board from and alight onto the station platform 18.

The third plate 150 referred to in FIG. 13 shall be selectively sized and shaped such that when it is activated, in accordance with the same activation procedure described hereinabove, this plate 150 shall be raised from its stowed position until it is horizontally coplanar with and circumscribes the second plate 144.

Said third plate 150 shall have a partially hollowed-out section 152. This partially hollowed out section 152 shall be comprised of an upper portion 130 whose surface has been grooved out and a lower portion 132 whose surface is substantially coplanar with the bottom surface of the remaining non-hollowed out section 154 of the third plate 150.

The dimensions of the hollowed out section 152 of the third plate 150 shall be equivalent to that required such that the threshold plate exterior 28, the first plate 138 and the second plate 144, as activated, shall totally fit within the aforementioned grooved out upper surface area 130 of the third plate 150 thereby minimizing the gap 16 and advantageously forming an even further extended and an even further enlarged boarding area for passengers to board from and alight onto the station platform 18.

In yet other preferred embodiments, the threshold plate 26 and the fourth plate structure 136, above described, are prefabricated as a single device.

15. Specific and Additional Advantages of the Present Invention's Device Pertaining to Grooved Plates—Structure #3 and #4

Figure 12:
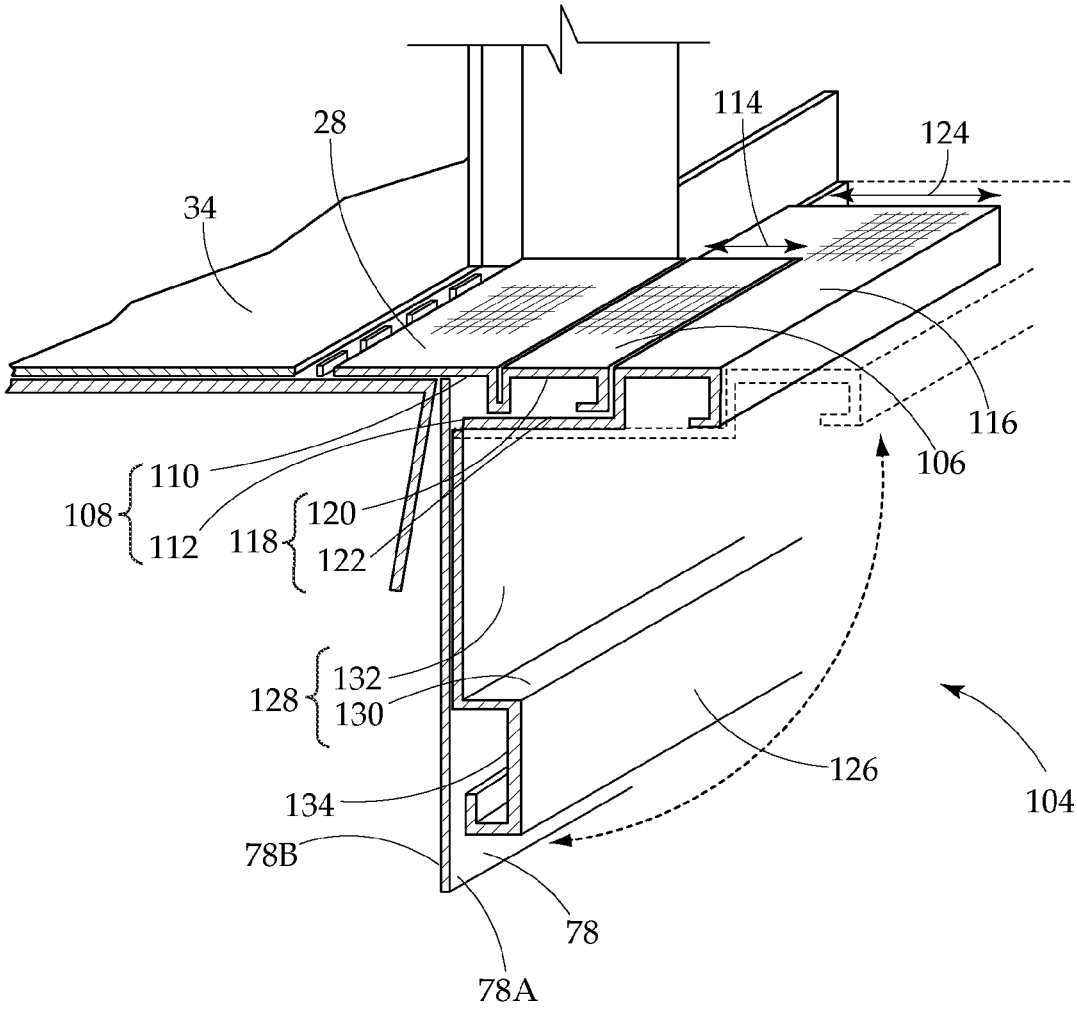
FIG. 12 is a third plate structure according to present invention depicting exploded side perspective view of grooved plate structure of FIG. 11 showing first and second plates activated with third plate in its deactivated and activated positions.
Figure 13:
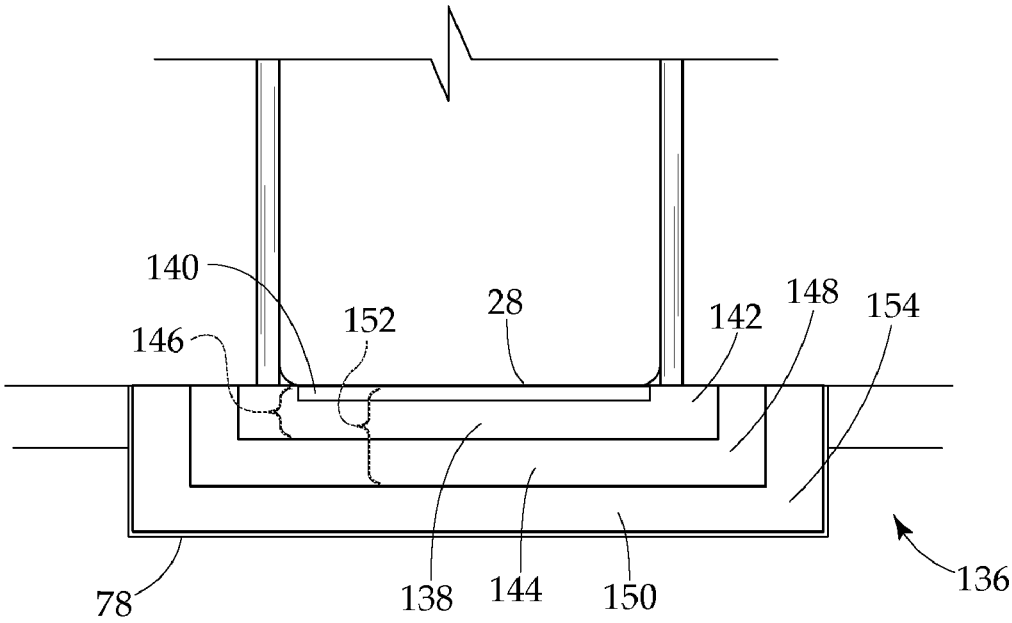
FIG. 13 is a fourth plate structure according to present invention depicting front and top views of its grooved plate structure showing first plate circumscribing threshold plate, second plate circumscribing first plate, third plate circumscribing second plate and showing all plates deactivated and activated respectively including a mounting plate.
Figure 13:
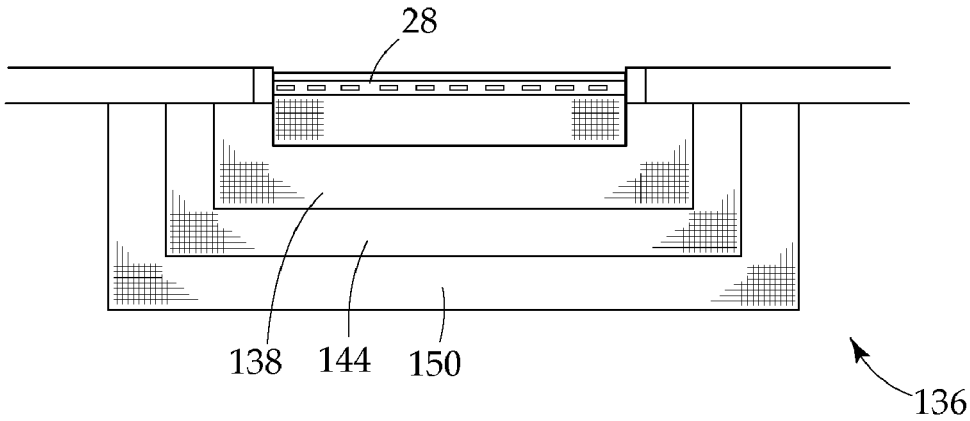

Of course, it will be appreciated by one skilled in the art that, regardless of the number of plates within a plate structure, as shown in FIGS. 11-13, consistent with TGI-LUT 48, being removably coupled to the exterior of the train car 10 in the area adjacent, coplanar with or below the train car doorway 14 opening, all plates can be so removably coupled to the exterior of the train car 10 without negatively effecting gap minimization and all resulting in an extended boarding area for passengers to board from and alight onto the station platform 18.

Obviously, it will be appreciated by one skilled in the art that any of the embodiments incorporated or suggested by the grooved plate device, that is, the third plate structure 104 and the fourth plate structure 136, hereinabove described, will allow for predetermined choices to be made by the train line system operator, based on TGI-LUT 48 and the width of each plate affixed below the train car doorway 14, as to the number of plates to be activated for each door of each train of the trainset at each station platform on that train's then particular route.

The embodiments included in this grooved plate device, that is, the third plate structure 104 and the fourth plate structure 136, above described, do not limit the transit line system operator to activate the same number of plates for all doors of the trainset at any one station.

Based on TGI-LUT 48 and the transit line system's GDCP 40, the embodiments of the grooved plate device, that is, the third plate structure 104 and the fourth plate structure 136, described hereinabove, permit flexibility of choice in plate activation to minimize different sized gaps 16 within any one particular train station platform 18 at which the train stops on its route to pickup and drop-off passengers.

Preferably, all transit line operators should use a "car marker" type system which consists of visual markers located within a station platform such that the train engineer can determine where the train should be stopped within the station based on the number of train cars in the trainset. The transit line system's TGI 44 must have incorporated, within its data, gap distance information to be taken at various intervals for all tracks within all its stations giving consideration to car marker train stopping locations on each track at each platform of every station within its system. Therefore, with this data, the transit line operator will be able to identify the stoppage location for each train car, depending on number of cars in a trainset, on each track at every platform of every station within its system and coordinate this stoppage location with TGI-LUT 48 to make a predetermination of its gap minimization objectives and thereby predetermine and input into the GDCP 40 which plate[s] of the grooved plate device referred to in the third plate structure 104 and the fourth plate structure 136, above described are to be deployed.

16. Fifth Plate Structure—Interlocking Plates with Initial Plate Symmetrical with Threshold Plate Referring now to FIGS. 14-15, another preferred embodiment is disclosed comprising a fifth plate structure 156 of the present invention consisting of a plurality of plates. These figures depict a device comprised of 3-plates; however, the number of plates shown is solely to illustrate the various embodiments of this design mode.

A feature of this design is the flexibility permitted to the transit system operator to be able to minimize gap widths of variable sizes at each car door opening for all train cars of a trainset at every station within its entire system.

Thus, the actual number of plates to be installed on a train car utilizing the design concept of this embodiment shall be selected by the transit system operator.

Further, as shall be described below, the actual number of plates on each device installed for each train car door selected to be activated when a train stops at a station shall be determined by choice of the transit system operator in accordance with the system's TGI-LUT 48.

Regardless of the number of plates selected to be used in this design, the effect shall be to minimize the gap 16 then existing between the train car and platform by providing an extended boarding area allowing passengers to board and alight the train 10.

The size of each plate[s] selected shall take into account the known size for the train car doorway 14 threshold plate 26 then in use for the particular train car on which the device is desired to be used.

The first plate 158 of the device referred to in FIGS. 14-15 shall be selectively sized and shaped such that when activated, in accordance with the activation procedure, described hereinabove, this plate shall be raised upward from its stowed position until it is symmetrical to and horizontally coplanar with the threshold plate 26 and the length of the plate 158 shall preferably be the same as the length of the threshold plate exterior 28.

Said first plate 158 shall have a hollowed out section 160 such that, when activated and coplanar with the threshold plate 26, the threshold plate exterior 28 shall totally fit within the footprint of the first plate 158 thereby minimizing the gap 16 and advantageously forming an extended boarding area allowing passengers to board from and alight onto the station platform 18.

The second plate 162 referred to in FIGS. 14-15 shall be selectively sized and shaped such that when it is activated, in accordance with the same activation procedure described hereinabove, this plate 162 shall be raised from its stowed position until it is horizontally coplanar with and circumscribes the threshold plate exterior 28 and the first plate 158.

Said second plate 162 shall have a hollowed out section 164 such that, when activated and coplanar with the first plate 158, the threshold plate exterior 28 and the first plate 158, as activated, shall totally fit within the footprint of the second plate 162 thereby minimizing the gap 16 and advantageously forming a further extended and now enlarged boarding area allowing passengers to board from and alight onto the station platform 18.

The third plate 166 referred to in FIGS. 14-15 shall be selectively sized and shaped such that when it is activated, in accordance with the same activation procedure described hereinabove, this plate 166 shall be raised from its stowed position until it is horizontally coplanar with and circumscribes the second plate 162.

Said third plate 166 shall have a hollowed out section 168 such that, when activated and coplanar with the second plate 162, the threshold plate exterior 28, the first plate 158 and the second plate 162, as activated, shall totally fit within the footprint of the third plate 166 thereby further minimizing the gap 16 and advantageously forming an even further extended and further enlarged boarding area allowing passengers to board from and alight onto the station platform 18.

The manner of deactivation of all plates which have been activated shall be as described hereinabove.

In yet other preferred embodiments, the threshold plate 26 and the fifth plate structure 156, above described, are prefabricated as a single device.

17. Sixth Plate Structure—Interlocking Plates with Initial Plate Circumscribing Threshold Plate A sixth plate structure 170 is disclosed in FIG. 16, consisting of a plurality of plates. The figure depicts a device comprised of 3-plates; however, as with FIGS. 14-15, the number of plates shown is solely to illustrate the various embodiments of this design mode.

Unless specifically modified below, all information heretofore provided pertaining to the fifth plate structure 156 is repeated and completely set forth at length herein for the sixth plate structure 170.

The first plate 172 of the device referred to in FIG. 16 shall be selectively sized and shaped such that when activated, in accordance with the same activation procedure described hereinabove, this plate 172 shall be raised from its stowed position until it is horizontally coplanar with the threshold plate 26 and circumscribes the threshold plate exterior 28.

Said first plate 172 shall have a hollowed out section 174 such that, when activated and coplanar with the threshold plate 26, the threshold plate exterior 28 shall totally fit within the footprint of the first plate 172 thereby minimizing the gap 16 and advantageously forming an extended and enlarged boarding area allowing passengers to board from and alight onto the station platform 18.

The second plate 176 referred to in FIG. 16 shall be selectively sized and shaped such that when it is activated, in accordance with the same activation procedure described hereinabove, this plate 176 shall be raised from its stowed position until it is horizontally coplanar with and circumscribes the first plate 172.

Said second plate 176 shall have hollowed out section 178 such that, when activated and coplanar with the first plate 172, the threshold plate exterior 28 and the first plate 172, as activated, shall totally fit within the footprint of the second plate 176 thereby further minimizing the gap 16 and advantageously forming a further extended and a further enlarged boarding area allowing passengers to board from and alight onto the station platform 18.

The third plate 180 referred to in FIG. 16 shall be selectively sized and shaped such that when it is activated, in accordance with the same activation procedure described hereinabove, this plate 180 shall be raised from its stowed position until it is horizontally coplanar with and circumscribes the second plate 176.

Said third plate 180 shall have a hollowed out section 182 such that, when activated and coplanar with the second plate 176, the threshold plate exterior 28, the first plate 172 and the second plate 176, as activated, shall totally fit within the footprint of the third plate 180 thereby further minimizing the gap 16 and advantageously forming an even further extended and an even further enlarged boarding area allowing passengers to board from and alight onto the station platform 18.

In yet other preferred embodiments, the threshold plate 26 and the sixth plate structure 170, above described, are prefabricated as a single device.

18. Specific and Additional Advantages of the Present Invention's Device Pertaining to Interlocking Plates—Structure #5 and #6

Figure 15:
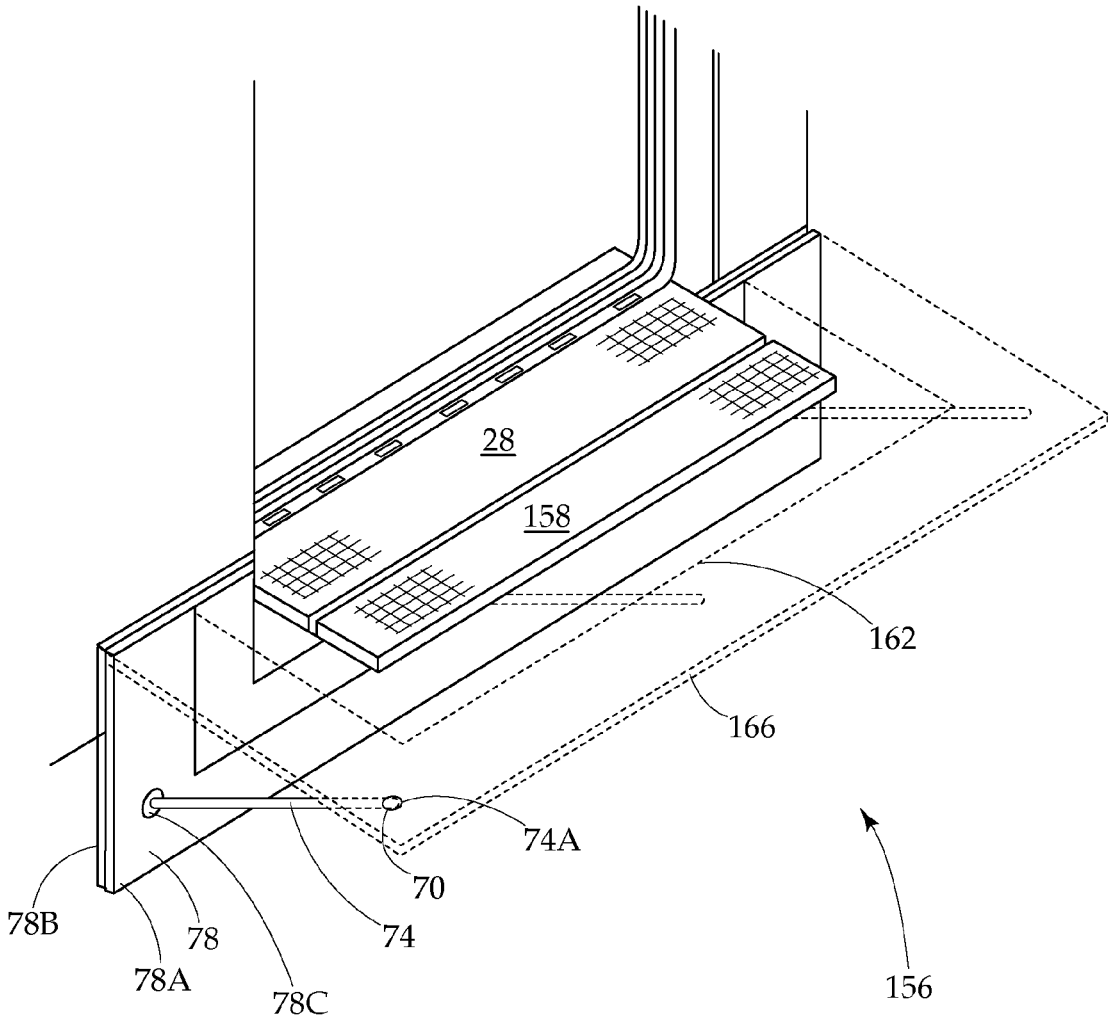
FIG. 15 is a fifth plate structure according to present invention depicting exploded side perspective view of interlocking plate structure of FIG. 15 showing first and second plates activated with third plate in its deactivated and activated positions.
Figure 16:
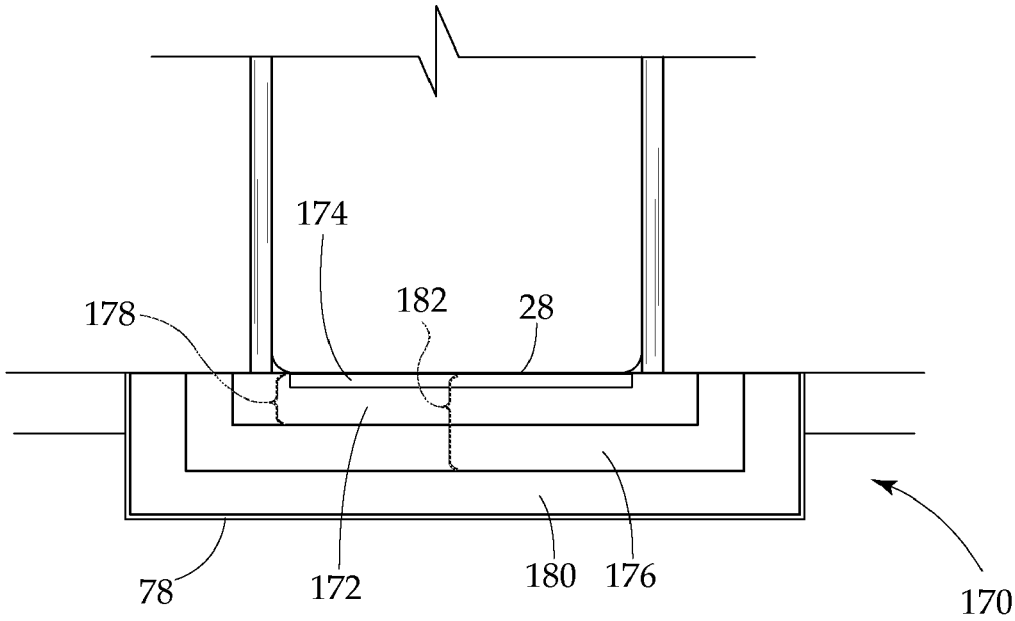
FIG. 16 is a sixth plate structure according to the present invention depicting front and top views of its interlocking plate structure showing first plate circumscribing threshold plate, second plate circumscribing first plate, third plate circumscribing second plate and showing all plates deactivated and activated respectively including a mounting plate.
Figure 16:
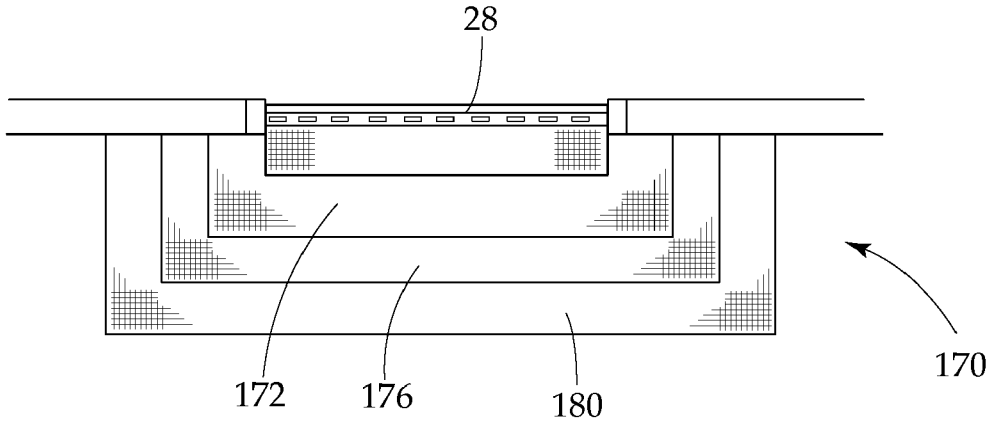

Of course, it will be appreciated by one skilled in the art that, regardless of the number of plates within a plate structure, as shown in FIGS. 14-16, consistent with TGI-LUT 48, being removably coupled to the exterior of the train car 10 in the area adjacent, coplanar with or below the train car doorway 14, all plates can be so removably coupled to the exterior of train car 10 without negatively effecting gap minimization and all resulting in an extended boarding area for passengers to board from and alight onto the station platform 18.

Obviously, it will be appreciated by one skilled in the art that any of the embodiments incorporated or suggested by the interlocking plate device, that is, the fifth plate structure 156 and sixth plate structure 170, hereinabove described, will allow for predetermined choices to be made by the train line system operator, based on TGI-LUT 48 and the width of each plate affixed below the train car doorway 14, as to the number of plates to be activated for each door of each train of the trainset at each station platform 18 on that train's then particular route.

The embodiments, included in this interlocking plate device, that is, the fifth plate structure 156 and sixth plate structure 170, above described, do not limit the transit line system operator to activate the same number of plates for all doors of the trainset at any one station.

Based on TGI-LUT 48 and the transit line system's GDCP 40, the embodiments of interlocking plate device, that is, the fifth plate structure 156 and sixth plate structure 170, described hereinabove, permit flexibility of choice in plate activation to minimize different sized gaps 16 within any one particular train station platform 18 at which the train stops on its route to pickup and drop-off passengers.

Preferably, all transit line operators should use a "car marker" type system which consists of visual markers located within a station platform such that the train engineer can determine where the train should be stopped within the station based on the number of train cars in the trainset. The transit line system's TGI 44 must have incorporated within its data gap distance information to be taken at various intervals for all tracks within all its stations giving consideration to car marker train stopping locations on each track at each platform of every station within its system. Therefore, with this data, the transit line operator will be able to identify the stoppage location for each train car, depending on number of cars in a trainset, on each track at every platform of every station within its system and coordinate this stoppage location with TGI-LUT 48 to make a predetermination of its gap minimization objectives and thereby predetermine and input into the GDCP 40 which plate[s] of the interlocking plate device referred to in the fifth plate structure 156 and sixth plate structure 170, above described are to be deployed.

19. Seventh Plate Structure—Plate Below Train Car Floor —Design Mode 1

Figure 17:
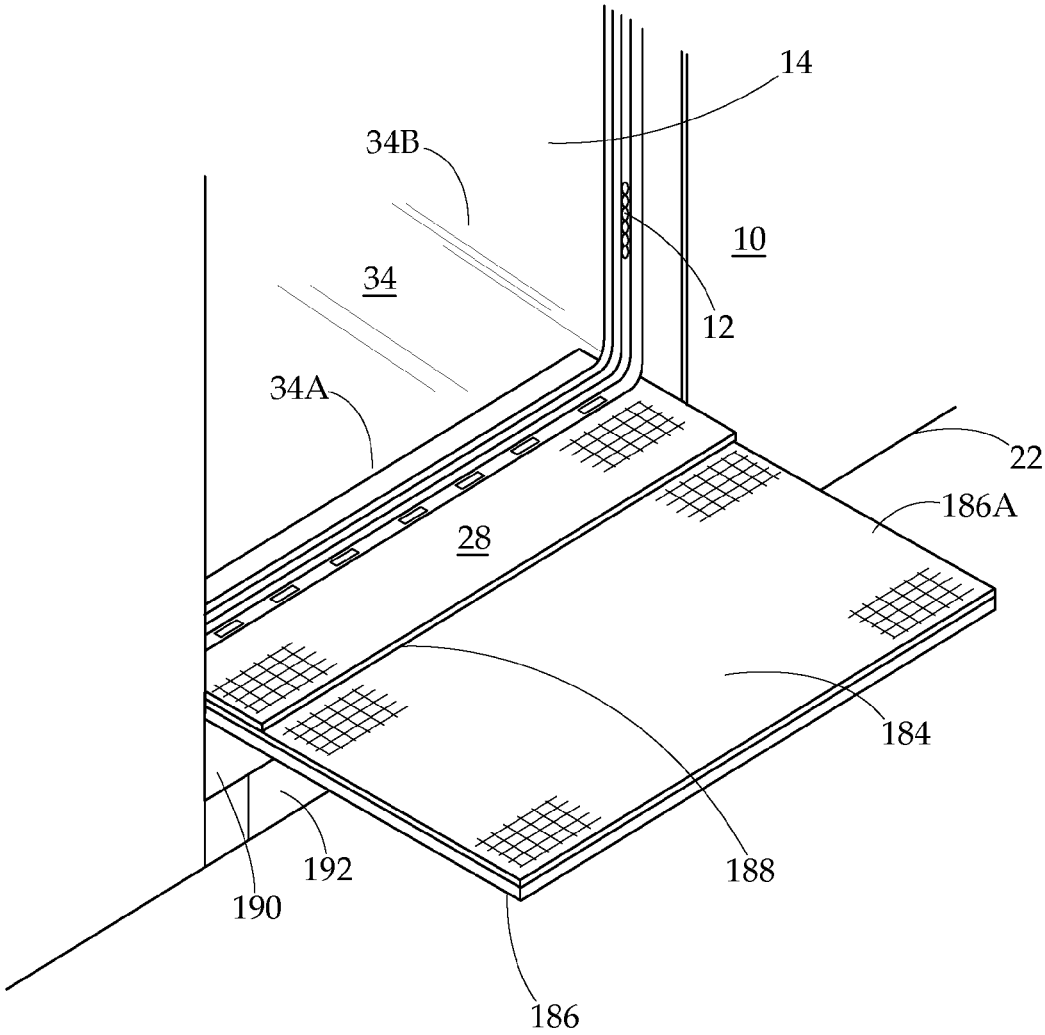
FIG. 17 is a seventh plate structure according to present invention depicting side perspective view of plate component underneath train car vestibule floor shown in its activated position including a malleable device and slotted opening under threshold plate in train car outer carriage.
Figure 18:
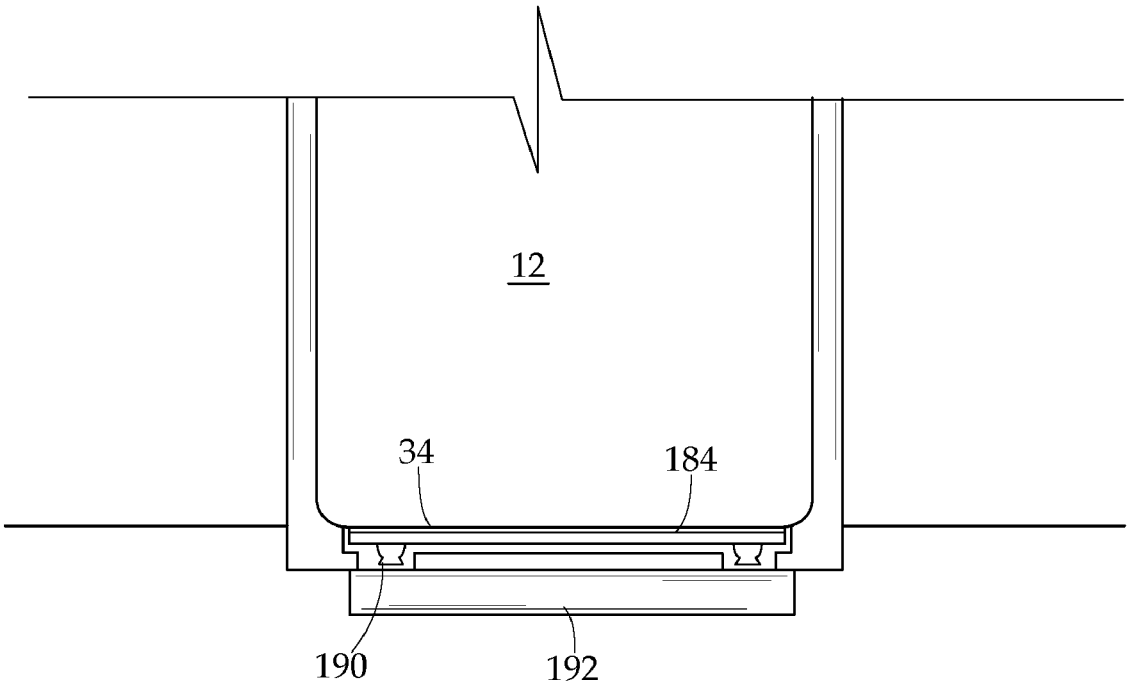
FIG. 18 is a seventh plate structure according to present invention depicting front perspective view of slotted opening including hinged cover under threshold plate allowing for movement of device of present invention according to FIG. 17.

As shown in FIG. 17, a seventh plate structure according to the device of the present invention, consisting of various embodiments hereinafter described, is disclosed comprising a single plate 184 which in its deactivated state is stowed below the train car vestibule floor 34.

Referring now to FIGS. 17, 18, 20, 22 and 28, a slotted opening 190 in the train car's outer carriage 22 directly below the threshold plate exterior 28 from which the plate 184 of FIG. 17, upon activation in accordance with the procedures above described, communicates from below the train car vestibule floor 34 into the gap 16 existing between the train car door 12 and the station platform edge 20 is disclosed.

The plate 184 component shall be appropriately positioned as shown in FIGS. 21-28 within a frame 194, as described below, and which frame 194 is to be situated below and horizontally coplanar with the train car vestibule floor 34.

The frame 194 is to be made of any hardened material, preferably a metal alloy.

Preferably, the frame 194, as shown in FIGS. 19, 21-28, is to be hexagonal in shape with 5-closed sides and 1-open side. The 1-open side is to be the side adjacent to the slotted opening 190, hereinafter described, under the threshold plate exterior 28. The frame 194 is to be mounted by any known means, such as by bolts or rivets, to the train car's undercarriage 24. Advantageously, immediate access should be granted to the frame 194 and all its internal components through the train car vestibule floor 34, through an access door 196A in the exterior top side of the frame 196, through an access door 202A in the exterior underside of the frame 202, and/or from the undercarriage of the train car 24.

The frame 194, which is to be located under the train car vestibule floor 34, is to be appropriately sized so that the plate component device 184 of the present invention and all other components required to facilitate device activation and deactivation are duly incorporated within it. If the mechanical motion device 64 being utilized as part of the activation/deactivation process of the plate component 184 is to be housed within the frame 194 itself, said frame 194 is to be appropriately sized to house such device.

Figure 19:
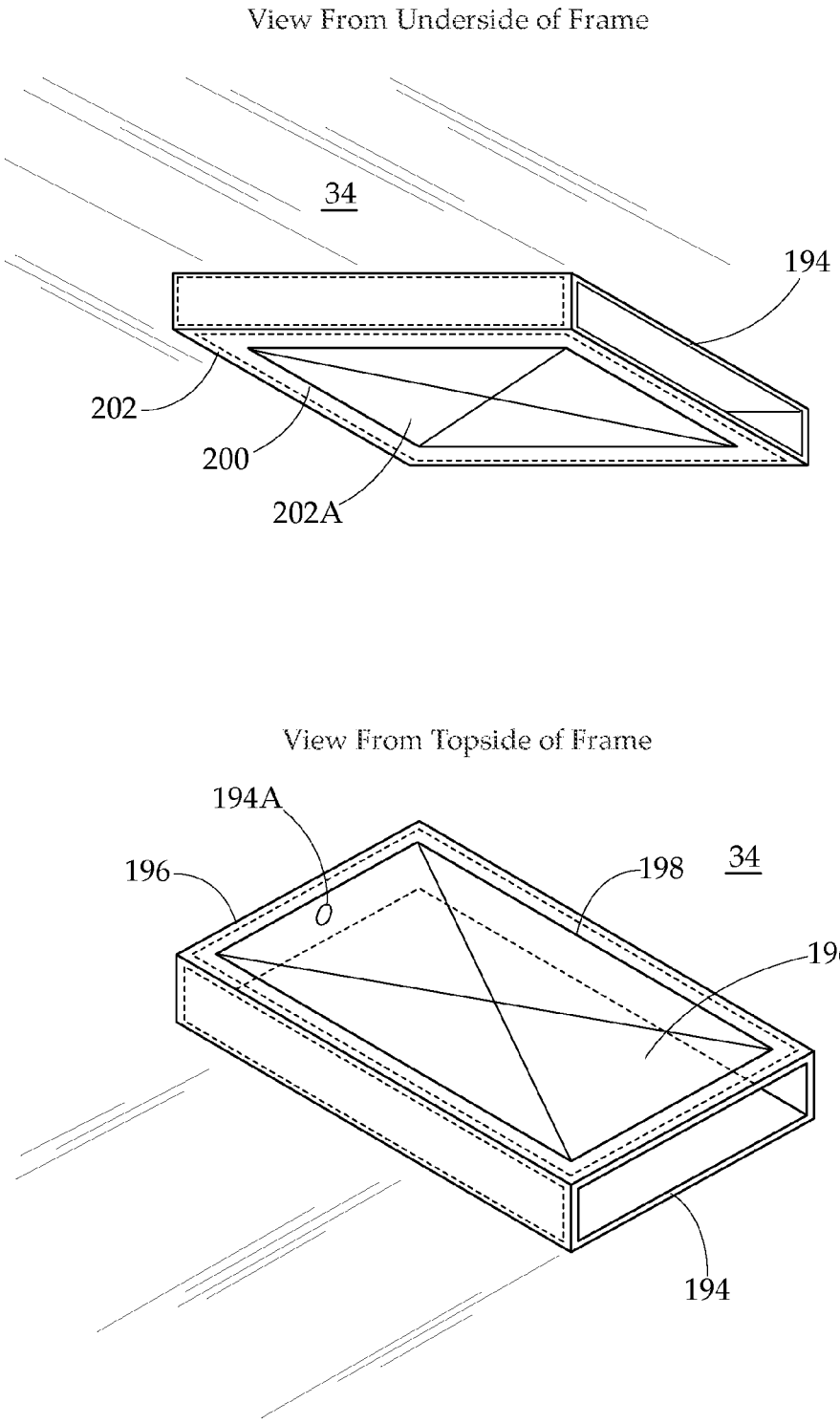
FIG. 19 shows the underside and top perspective views of frame according to present invention.

In the circumstance where the mechanical motion device 64 is housed to the exterior of said frame 194, that is, to the supporting framework of that part of the train car's undercarriage 24 below the vestibule floor 34, the frame 194 shall have a singular or a plurality of predetermined slotted openings 194A, as shown in FIGS. 19 and 28, at its rearward side for the rod component 74 of the mechanical motion device 64 to be preferably fitted through and thereby engage the plate component 184 of the present invention.

Figure 20:
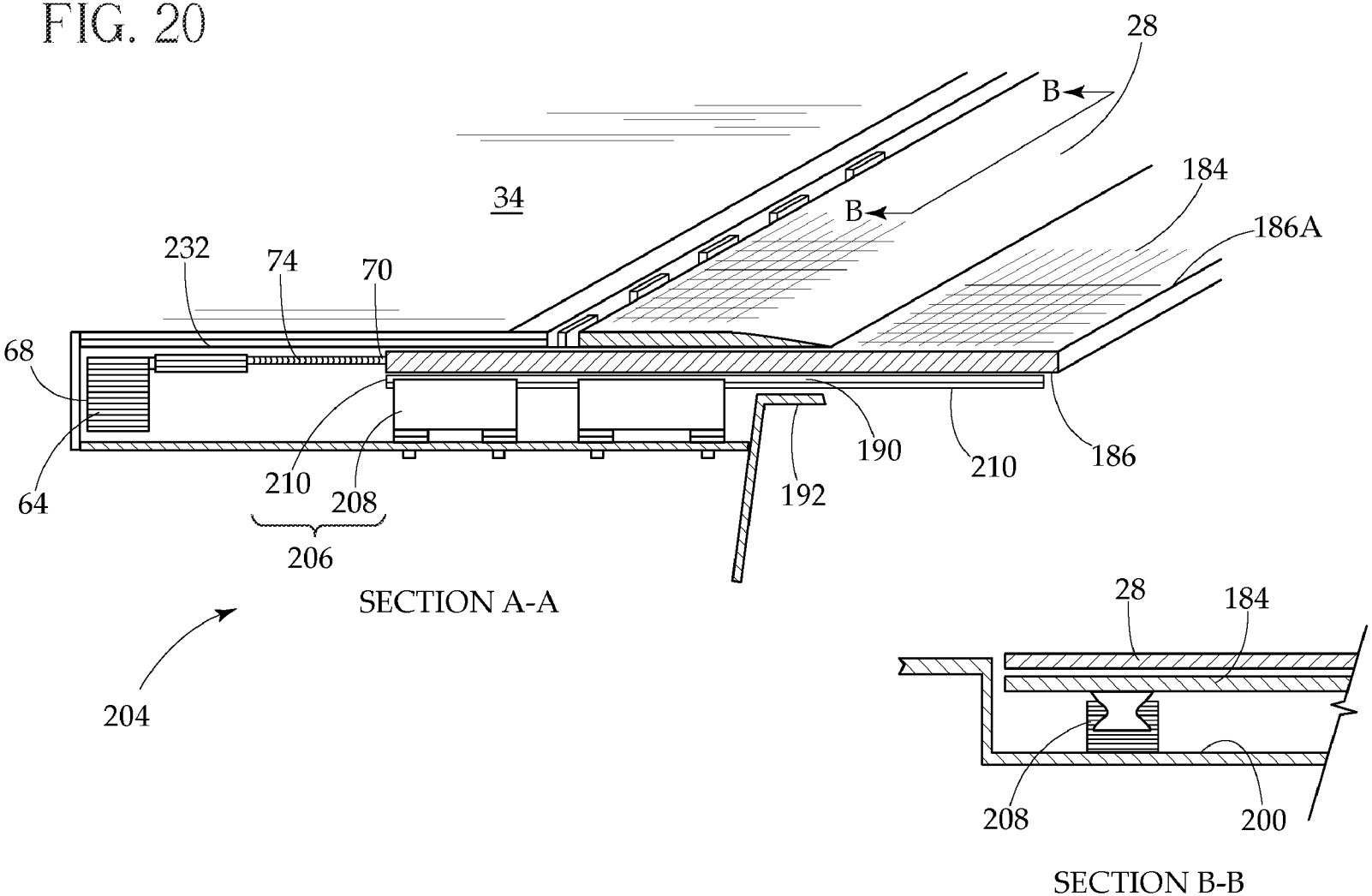
FIG. 20 is a seventh plate structure according to present invention depicting exploded side view of FIG. 17 including first alternative plate structure components with a first slidable member and a first slidable device.
Figure 21:
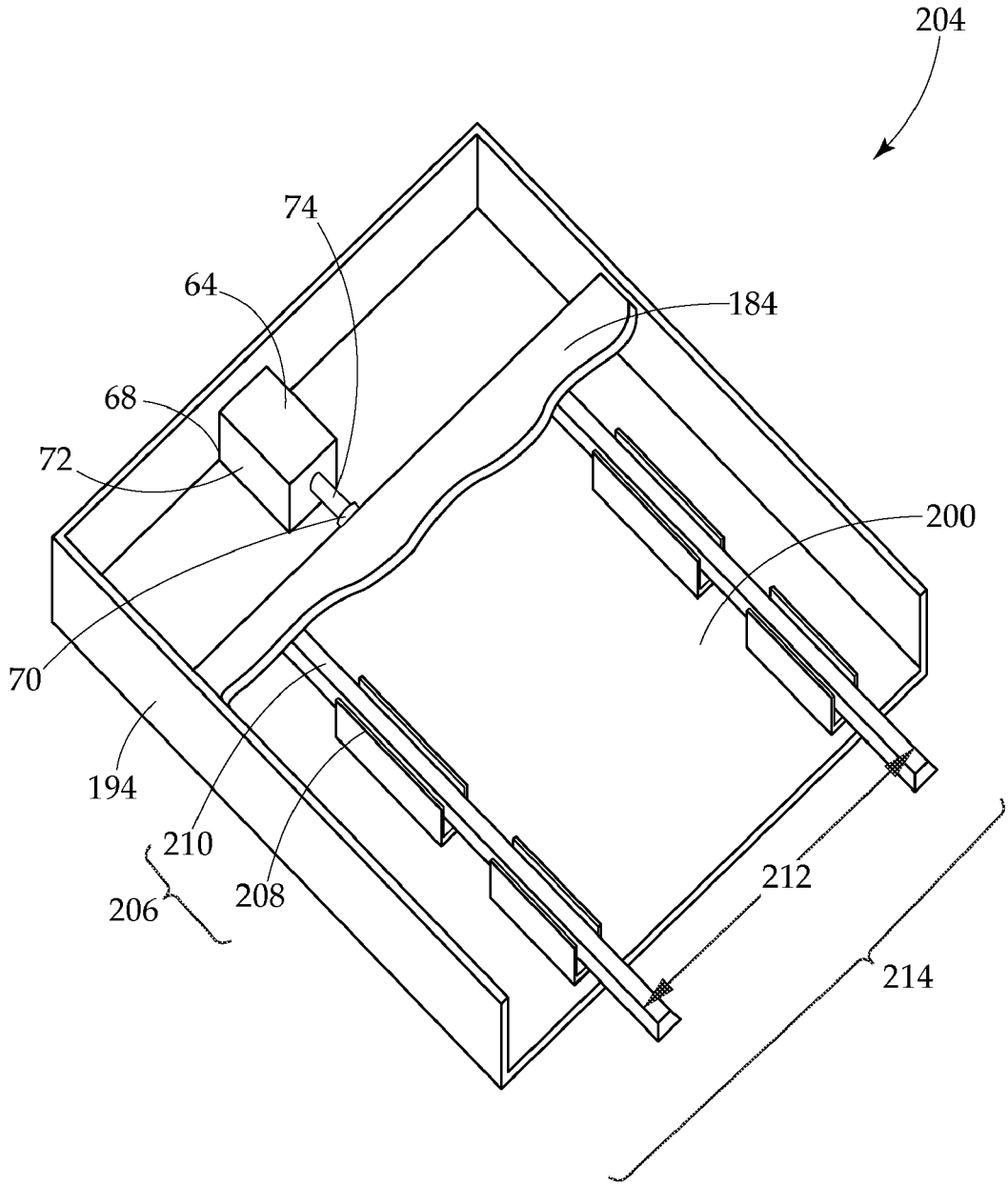
FIG. 21 is a top perspective view of first slidable member and first slidable device shown in FIG. 20 in a channel formed by guided roller track within frame of FIG. 19 according to the present invention.

In one preferred embodiment, as shown in FIGS. 20-21, that is, a seventh plate structure 204 comprising a first slidable member 206 with a first slidable device 208, positioned below the plate component 184 of the present invention's device and to work in conjunction with said plate component 184, and all to be incorporated within the frame 194 hereinabove described.

The first slidable member 206 is comprised of a lower portion 208, that is, a block shaped first slidable device, preferably a rolling element linear type bearing, such as a caged roller bearing, removably coupled to an upper portion 210, that is, a structure having the shape of a rail, preferably grooved.

Preferably, there shall be two above described first slidable members 206 to be incorporated within the frame 194.

Each such first slidable member 206 is to be located opposite one another and situated below and horizontally coplanar with the train car vestibule floor 34, and more particularly, each extending parallel to the inner perimeter of the vestibule car floor 34B.

Each first slidable member 206 is to extend preferably from an inner terminal point being a near mid-point location under the vestibule floor 34 towards its outer terminal point being the threshold plate interior 32.

Preferably, within each first slidable member 206 there is to be a plurality of first slidable devices 208.

Preferably, each of the block-like shaped first slidable device structures 208 forming a component of each first slidable member 206 is to be attached by any known means, such as by bolts or screws, to the interior lower portion of the frame 200 described above and which interior lower portion 200 corresponds with the frame's interior upper portion 198 which is attached to the train car's undercarriage 24.

Preferably, there is appropriately coupled to the aforesaid first slidable devices 208 forming a component of each first slidable member 206 a rail shaped component 210 such that said rail 210 is to be able to slide across said block shaped slidable devices 208 for the entire length of said rail 210.

Preferably, the rail shaped structure 210 is to be attached by any known means, such as by bolts or screws, to the underside of the plate component 186, as shown in FIG. 20, of the present invention's device.

The preferable dimensions of the plate component 184 are: its width is to be the same as the length of the threshold plate exterior 28; its length is to be equivalent to or less than the length of the rail component 210 of the first slidable member 206, above described, and shall be as selected by the transit line system operator in accordance with its TGI 44 and gap minimization objectives.

Preferably, the plate component 184, that is, the sides which are perpendicular to the threshold plate interior 32 and which are parallel to the inner perimeter of the vestibule floor 34B above, is situated within the above described frame 194 and in static position rests upon the upper portion 210 of the dual first slidable member 206 within said frame 194.

Advantageously, the plurality of each block shaped slidable device 208 is to be positioned on the interior lower portion of the frame 200, above described, to correspond with the dual rail shaped structure 210 to be positioned on the underside of the plate component 186 of the present invention's device and, in such manner, is to form a guided roller track 212.

Each rail shaped component 210 within the guided roller track 212 is to be made of a hardened material, preferably a metal alloy, capable of facilitating its dynamic sliding action movement over the first slidable device 208 for the entire length of the guided roller track 212 and further capable of facilitating the dynamic sliding action movement of the plate component 184 of the present invention's device for the entire length of the guided roller track 212. Further, each such rail shaped structure 210 must be made of such hardened material so as to accommodate the load of the plate component 184 and the reasonably anticipated load from commuters traversing the plate component 184.

Preferably, the first slidable device 208 as coupled to the rail shaped structure 210 is to make appropriate contact with the rail shaped structure 210 for the purposes as disclosed below.

Advantageously, as shown in FIG. 20, an intermediate structure 232, preferably made of a Teflon or other like material, is to form a desired barrier so as to prevent unwarranted communication between the topside of the plate component 186A and the interior upper portion of the frame 198 while in static position and while in dynamic motion. Said intermediate structure 232 is to be selectively sized and shaped and is to be adhered by any known means, such as by screws or bolts, to the interior upper portion of the frame 198.

In its static position, the underside of the plate component 186 of the present invention's device, as attached to the rail shaped structure 210, is disclosed to rest upon a plurality of the first slidable device components 208 of the guided roller track 212 and which plurality of slidable devices 208 are simultaneously at rest being attached to the interior lower portion of the frame 200 within the guided roller track 212.

Advantageously, the guided roller track 212, as positioned within the frame 194, shall form a continuous and uninterrupted channel 214 to facilitate, upon activation in conjunction with dynamic action of the mechanical motion device 64 as hereinabove described, precise and level horizontal movement of the plate component 184 from its deactivated and stowed position, as result of being attached to the rail shaped structure 210 as said rail shaped structure 210 slides along the plurality of first slidable devices 208 mounted to the interior lower portion of the frame 200 within of the guided roller track 212, and then through the slotted opening 190 below the threshold plate exterior 28, as hereinafter described, to desired distance in order to accomplish gap minimization objective in accordance with TGI-LUT 48 set forth by the transit line system operator.

Of course, it will be appreciated by one skilled in the art that the apparatus and mechanism described above to facilitate movement of the plate component 184 of the present invention's device from its deactivated and stowed position under the train car vestibule floor 34 is not limited to a block shaped first slidable device 208 and/or the use of a rail shaped structure 210 forming the components of the first slidable member 206 as previously described, and further is not limited to the use of any of the components of the first slidable member 206 forming the above described guided roller track 212, and all such devices may be otherwise selectively sized and shaped and have such other structure which may otherwise accomplish the due and proper movement and support of the plate component device 184 of the present invention in a horizontal direction such as required to accomplish gap minimization pursuant to the goals and objectives of the transit line system operator.

20. Seventh Plate Structure—Plate Below Train Car Floor —Design Mode 2

Figure 22:
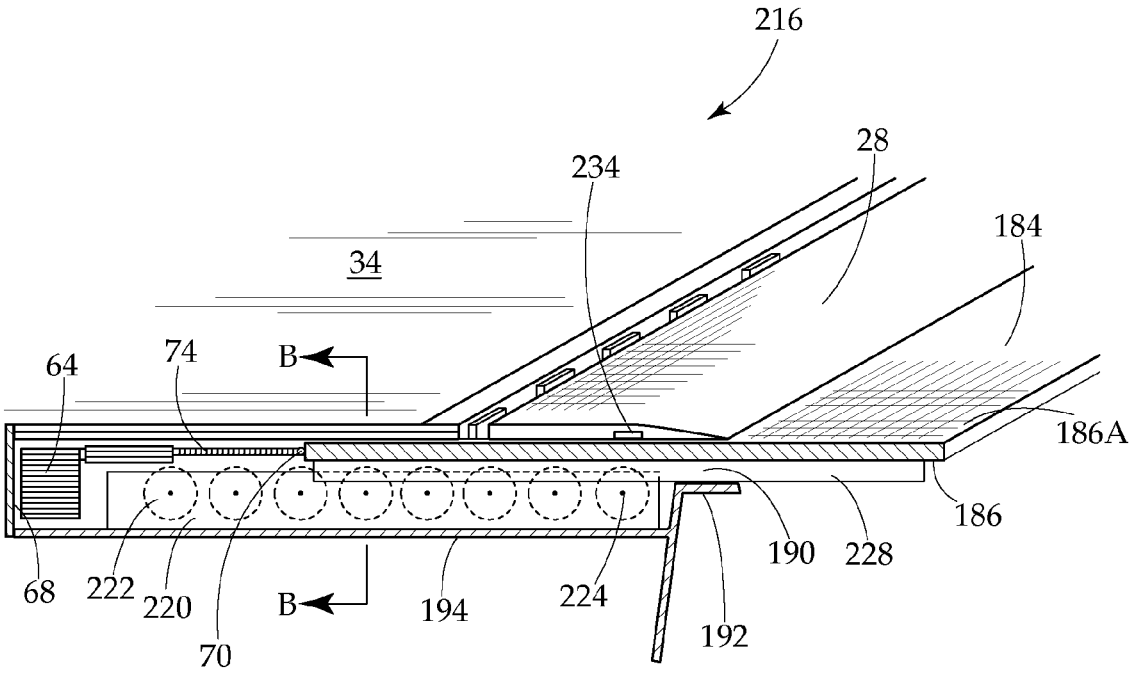
FIG. 22 is a seventh structure according to present invention depicting exploded side view of FIG. 17 including second alternative plate structure components with a second slidable member and a second slidable device.
Figure 22:
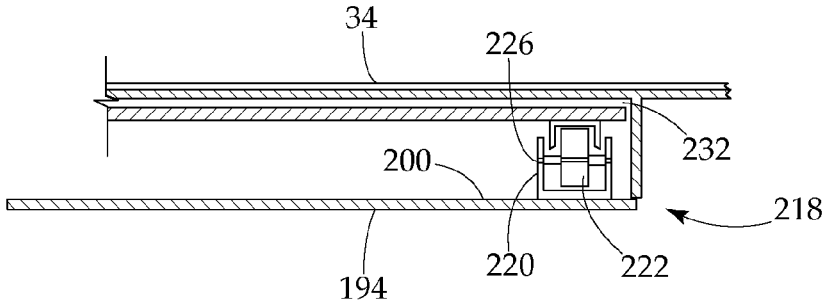
Figure 23:
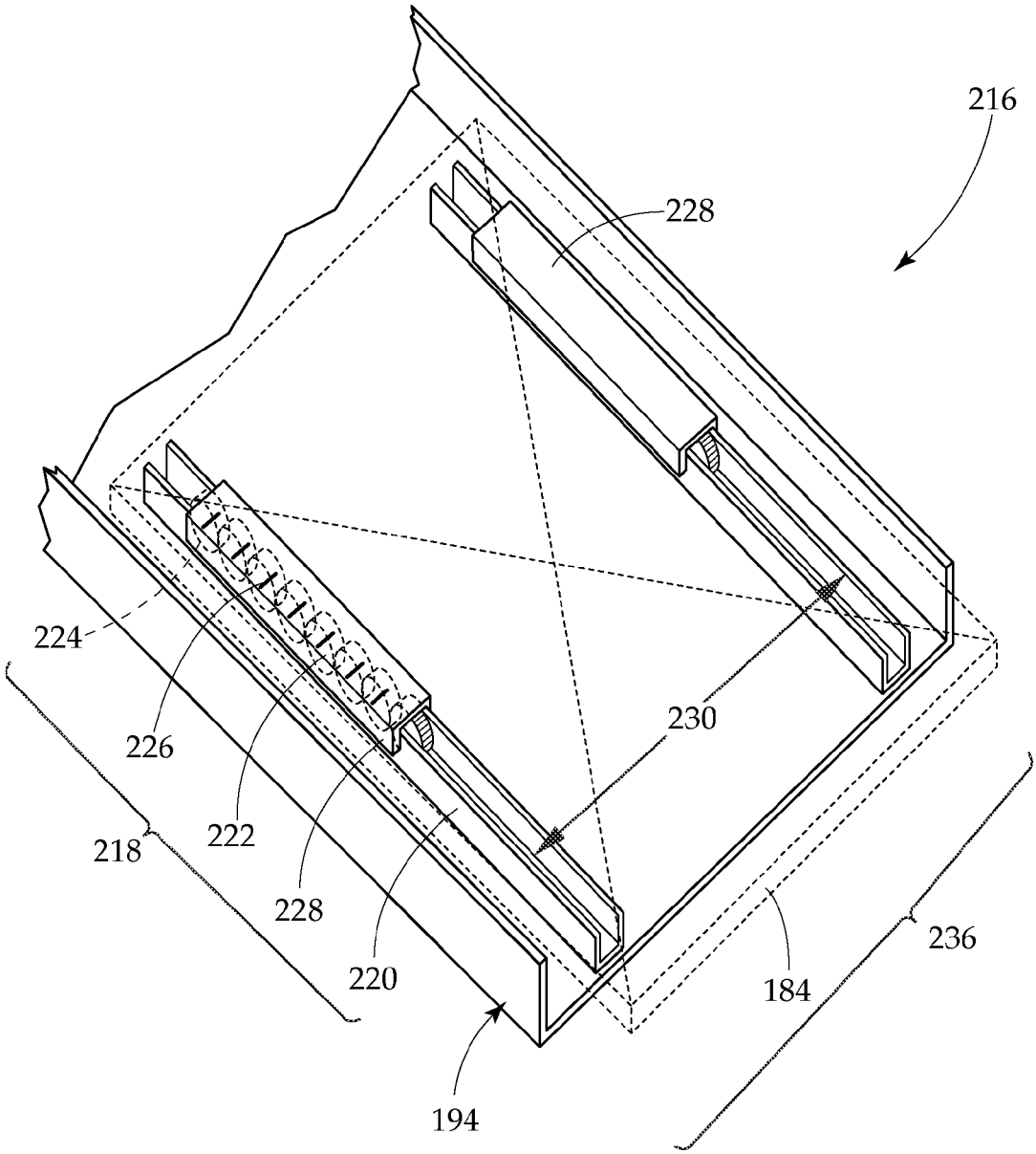
FIG. 23 is a top perspective view of second slidable member and second slidable device shown in FIG. 22 in a channel formed by a lower guided track within frame of FIG. 19 according to the present invention.

FIGS. 22-23 disclose another preferred embodiment 216, that is, a variation of the aforesaid seventh plate structure now comprising a second slidable member 218 with its second slidable device 222, positioned below the plate component 184 of the present invention's device and to work in conjunction with said plate component 184, and to be incorporated within the frame 194 hereinabove described.

A second slidable member 218 is disclosed comprised of the following components: a structure having generally a U-shape 220; a plurality of said second slidable devices 222; a connecting shaft 226 appropriately fitted through a slotted opening 224 of each said second slidable device 222, and a structure having generally an inverted U-shape 228.

Preferably, there shall be two structures having generally said U-shape 220 to be incorporated within the second slidable member 218.

Each of the dual U-shaped components 220 forming a part of the second slidable member 218 is located opposite one another and situated below and horizontally coplanar with the train car vestibule floor 34, and more particularly, each extending parallel to the inner perimeter of the vestibule car floor 34B.

Each U-shaped component 220 is to extend preferably from an inner terminal point being a near mid-point location under the vestibule floor 34 towards its outer terminal point being the threshold plate interior 32.

Preferably, each of the dual U-shaped structures 220 forming a component of the second slidable member 218 is to be attached by any known means, such as by bolts or screws, to the interior lower portion of the frame 200 described above and which interior lower portion 200 corresponds with the frame's interior upper portion 198 which is attached to the train car's undercarriage 24.

Within each U-shaped component 220 of the second slidable member 218, there is to be precisely fitted a second slidable device 222 comprising a number of hard ball running in grooves in the surface of two concentric rings one of which is mounted on a rotating or oscillating shape, such as a rolling bearing, to form a wheel-like shaped apparatus. Preferably, there is to be a plurality of such wheel-like shaped apparatus within the second slidable member 218.

Preferably, each of said second slidable devices 222, on its aforementioned connecting shaft 226, is to be attached by any known means, such as by bolts, screws or welding, to the sides of each U-shaped component 220 of the second slidable member 218.

The preferable dimensions of the plate component 184 are: its width is to be the same as the length of the threshold plate exterior 28; its length is to be equivalent to or less than the length of the U-shaped component 220 of the second slidable member 218, described above, and shall be as selected by the transit line system operator in accordance with its TGI 44 and gap minimization objectives.

Advantageously, as disclosed in FIGS. 22-23, the dual U-shaped structure 220 with the plurality of each wheel-like shaped apparatus slidable device 222 attached on its shaft 226 and precisely fitted within each such U-shaped component 220, is to be positioned on the interior lower portion of the frame 200, above described, to correspond with an inverted dual U-shaped structure 228 to be positioned on the underside of the plate component 186 of the present invention's device and, in such manner, is to form a lower guided track 230.

Preferably, the inverted U-shaped structure 228 is to be attached by any known means, such as by bolts or screws, to the underside of the plate component 186 of the present invention's device.

Each U-shaped component 220 is to be made of a hardened material, preferably a metal alloy, capable of facilitating, in its static position, the dynamic sliding action movement of the plate component 184 of the present invention's device for the entire length of the lower guided track 230. Further, each U-shaped component 220 and each second slidable device 222 must be made of such hardened material so as to accommodate the load of the plate component 184 and the reasonably anticipated load from commuters traversing the plate component 184.

Preferably, the second slidable device 222 apparatus within the U-shaped structure 220 is to make appropriate contact with the inverted U-shaped structure 228 for the purposes as disclosed below.

Each inverted U-shaped component 228 within the lower guided track 230 is to be made of a hardened material, preferably a metal alloy, capable of facilitating its dynamic sliding action movement over the second slidable device 222 for the entire length of the lower guided track 230 and further capable of facilitating the dynamic sliding action movement of the plate component 184 of the present invention's device for the entire length of the lower guided track 230. Further, each such inverted U-shaped structure 228 must be made of such hardened material so as to accommodate the load of the plate component 184 and the reasonably anticipated load from commuters traversing the plate component 184.

Advantageously, as shown in FIG. 22, an intermediate structure 232, preferably made of a Teflon or other like material, is to form a desired barrier so as to prevent unwarranted communication between the topside of the plate component 186A and the interior upper portion of the frame 198 while in static position and while in dynamic motion. Said intermediate structure 232 is to be selectively sized and shaped and is to be adhered by any known means, such as by screws or bolts, to the interior upper portion of the frame 198.

In its static position, the underside of the plate component 186 of the present invention's device, as attached to the inverted U-shaped structure 228, is disclosed to rest upon a plurality of the second slidable device components 222 of the lower guided track 230 and which plurality of slidable devices 222 are simultaneously at rest being fixed to the inner walls of each U-shaped component 220 of the second slidable member 218 within the lower guided track 230.

Advantageously, the lower guided track 230, as positioned within the frame 194, shall form a continuous and uninterrupted channel 236 to facilitate, upon activation in conjunction with dynamic action of the mechanical motion device 64 as hereinabove described, precise and level horizontal movement of the plate component 184 from its deactivated and stowed position, as result of being attached to the inverted U-shaped structure 228 as said inverted U-shaped structure 228 slides along the plurality of second slidable devices 222 located and fixed within the U-shaped structure 220 of the lower guided track 230 as said second slidable devices 222 rotate on their axis, and then through the slotted opening 190 below the threshold plate exterior 28, as hereinafter described, to desired distance in order to accomplish gap minimization objective in accordance with TGI-LUT 48 set forth by the transit line system operator.

Of course, it will be appreciated by one skilled in the art that the apparatus and mechanism described above to facilitate movement of the plate component 184 of the present invention's device from its deactivated and stowed position under the train car vestibule floor 34 is not limited to the use of a U-shaped structure 220 forming a component of the second slidable member 218 as previously described, and further is not limited to the use of a device having a rotating or oscillating shape forming the second slidable device 222 as previously described, and further is not limited to the use of an inverted U-shaped structure 228, and further is not limited to the use of any of the components of the second slidable member 218 forming the above described lower guided track 230, and all such devices may be otherwise selectively sized and shaped and have such other structure which may otherwise accomplish the due and proper movement and support of the plate component device 184 of the present invention in a horizontal direction such as required to accomplish gap minimization pursuant to the goals and objectives of the transit line system operator.

21. Seventh Plate Structure—Plate Below Train Car Floor —Design Mode 3

FIGS. 24-27 disclose another preferred embodiment 238, that is, a further variation of the aforesaid seventh plate structure now comprising a third slidable member 240 with its third slidable device 244, positioned below the plate component 184 of the present invention's device and to work in conjunction with said plate component 184, and a separate structure 254 positioned above said plate 184, and all to be incorporated within the frame 194 hereinabove described.

A third slidable member 240 is disclosed comprised of the following components: a structure having generally a U-shape 242; a plurality of said third slidable devices 244; a connecting shaft 248 appropriately fitted through a slotted opening 246 of each said third slidable device 244, and a structure having generally an inverted U-shape 250.

Preferably, there shall be two structures having generally said U-shape 242 to be incorporated within the third slidable member 240.

Each of the dual U-shaped components 242 forming a part of the third slidable member 240 is located opposite one another and situated below and horizontally coplanar with the train car vestibule floor 34, and more particularly, each extending parallel to the inner perimeter of the vestibule car floor 34B.

Each U-shaped component 242 is to extend preferably from an inner terminal point being a near mid-point location under the vestibule floor 34 towards its outer terminal point being the threshold plate interior 32.

Preferably, each of the dual U-shaped structures 242 forming a component of the third slidable member 240 is to be attached by any known means, such as by bolts or screws, to the interior lower portion of the frame 200 described above and which interior lower portion 200 corresponds with the frame's interior upper portion 198 which is attached to the train car's undercarriage 24.

Within each U-shaped component 242 of the third slidable member 240, there is to be precisely fitted a third slidable device 244 comprising a number of hard ball running in grooves in the surface of two concentric rings one of which is mounted on a rotating or oscillating shape, such as a rolling bearing, to form a wheel-like shaped apparatus. Preferably, there is to be a plurality of such wheel-like shaped apparatus within the third slidable member 240.

Preferably, each of said third slidable devices 244, on its aforementioned connecting shaft 248, is to be attached by any known means, such as by bolts, screws or welding, to the sides of each U-shaped component 242 of the third slidable member 240.

The preferable dimensions of the plate component 184 are: its width is to be the same as the length of the threshold plate exterior 28; its length is to be equivalent to or less than the length of the U-shaped component 242 of the third slidable member 240, described above, and shall be as selected by the transit line system operator in accordance with its TGI 44 and gap minimization objectives.

Figure 24:
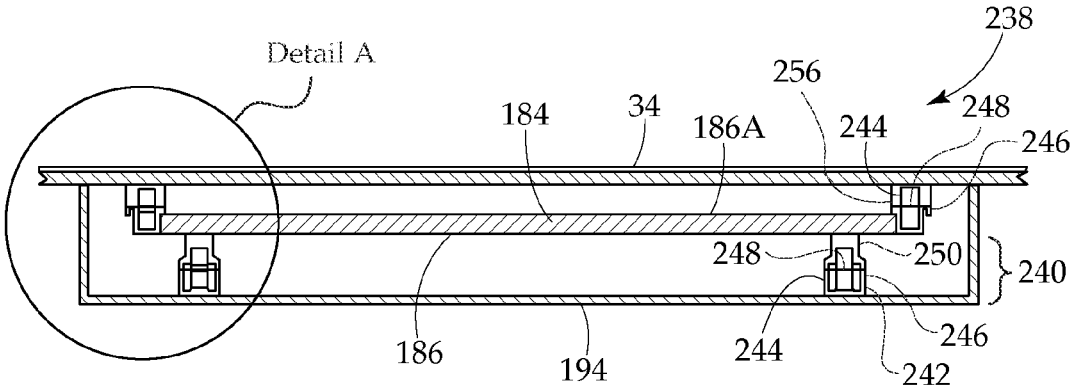
FIG. 24 is a seventh plate structure according to the present invention depicting exploded front view of FIG. 17 including third alternative plate structure components with a third slidable member and a third slidable device below plate component with an additional structure including third slidable device above plate component.
Figure 25:
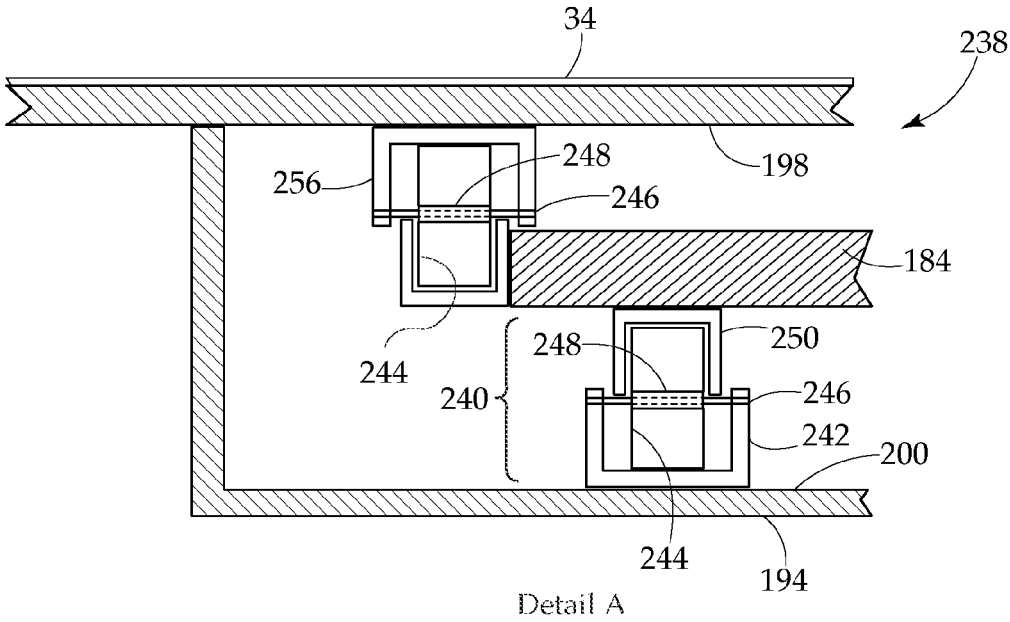
FIG. 25 is an exploded front view of FIG. 24 according to the present invention.
Figure 26:
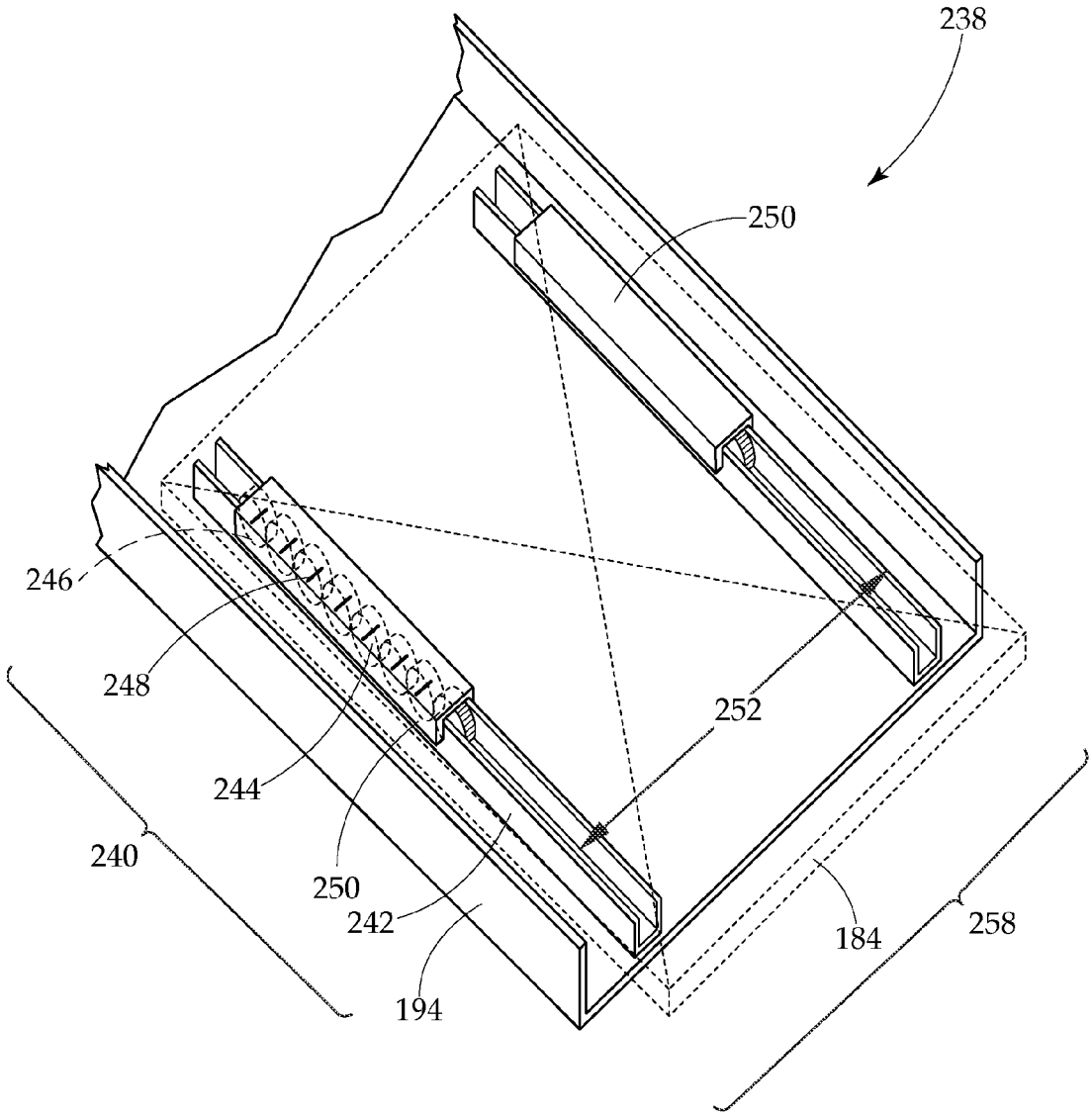
FIG. 26 is a top perspective view of third slidable member and third slidable device shown in FIG. 24 in a channel formed by a lower guided track within frame of FIG. 19 according to the present invention.

Advantageously, as disclosed in FIGS. 24-26, the dual U-shaped structure 242 with the plurality of each wheel-like shaped apparatus slidable device 244 attached on its shaft 248 and precisely fitted within each such U-shaped component 242, is to be positioned on the interior lower portion of the frame 200, above described, to correspond with an inverted dual U-shaped structure 250 to be positioned on the underside of the plate component 186 of the present invention's device and, in such manner, is to form a lower guided track 252.

Preferably, the inverted U-shaped structure 250 is to be attached by any known means, such as by bolts or screws, to the underside of the plate component 186 of the present invention's device.

Each U-shaped component 242 is to be made of a hardened material, preferably a metal alloy, capable of facilitating, in its static position, the dynamic sliding action movement of the plate component 184 of the present invention's device for the entire length of the lower guided track 252. Further, each U-shaped component 242 and each third slidable device 244 must be made of such hardened material so as to accommodate the load of the plate component 184 and the reasonably anticipated load from commuters traversing the plate component 184.

Preferably, the third slidable device 244 apparatus within the U-shaped structure 242 is to make appropriate contact with the inverted U-shaped structure 250 for the purposes as disclosed below.

Each inverted U-shaped component 250 within the lower guided track 252 is to be made of a hardened material, preferably a metal alloy, capable of facilitating its dynamic sliding action movement over the third slidable device 244 for the entire length of the lower guided track 252 and further capable of facilitating the dynamic sliding action movement of the plate component 184 of the present invention's device for the entire length of the lower guided track 252. Further, each such inverted U-shaped structure 250 must be made of such hardened material so as to accommodate the load of the plate component 184 and the reasonably anticipated load from commuters traversing the plate component 184.

Figure 27:
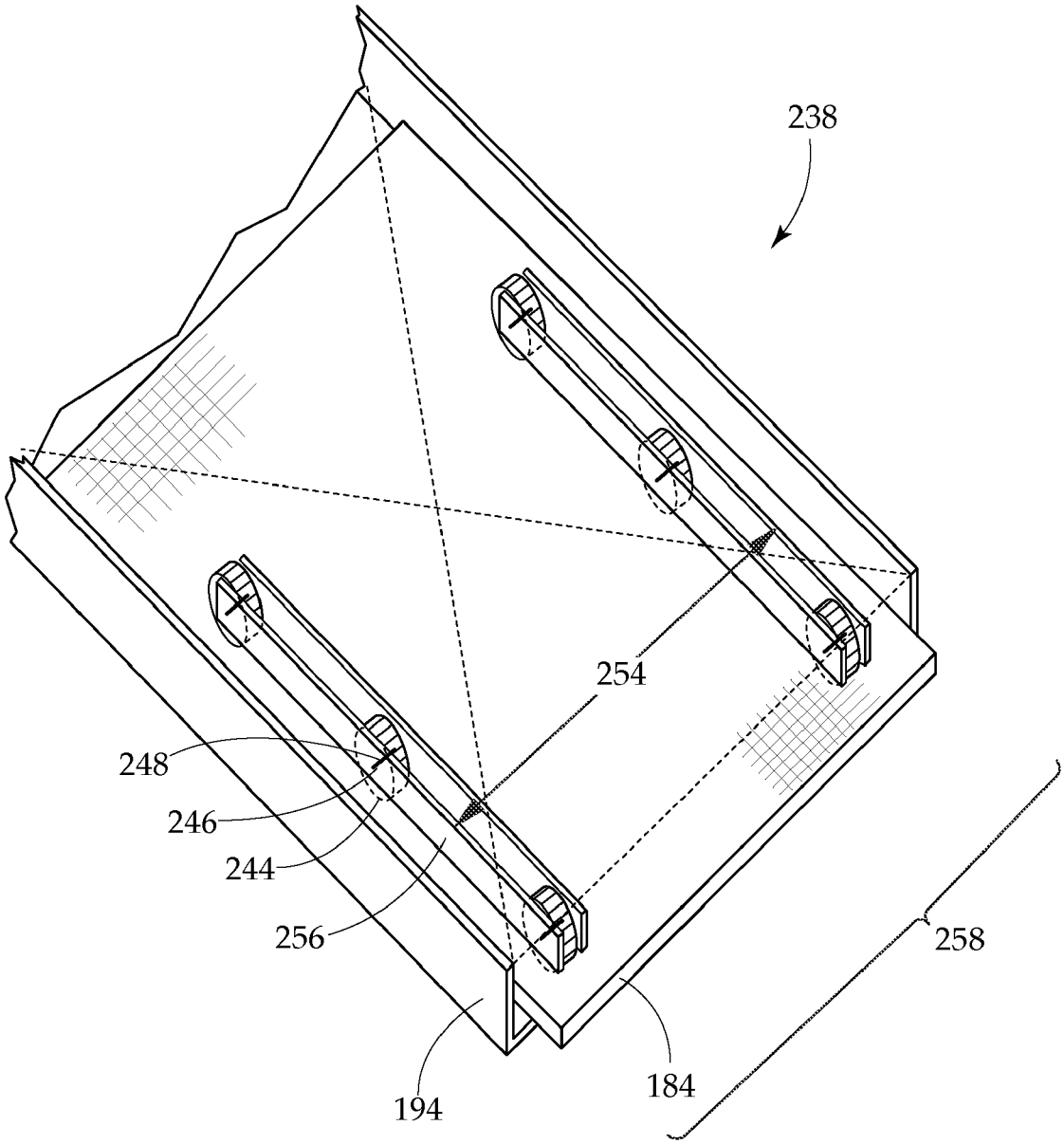
FIG. 27 is a top perspective view of the additional structure including third slidable device above plate component shown in FIG. 24 in a channel formed by an upper guided track within frame of FIG. 19 according to the present invention.

As shown in FIG. 27, an upper guided track 254 is disclosed comprised of the following: preferably, a dual set of rectangular shaped flat bars 256, a plurality of the above described third slidable devices 244, and a connecting shaft 248 appropriately fitted through a slotted opening 246 within each of said third slidable devices 244 and attached by any known means, such as by bolts, screws or welding, to each set of said rectangular shaped flat bars 256.

Each such rectangular shaped flat bar 256 is to be made of a hardened material, preferably a metal alloy. Preferably, each set of rectangular shaped flat bars 256 shall be comprised of two such bars which sets are to be located opposite one another in such positioning as to correspond with the lower guided track 252.

Each set of rectangular shaped flat bars 256 is to be attached by any known means, such as by bolts or screws, to the interior upper portion of the frame 198.

Preferably, the length of each such rectangular shaped flat bar 256 is to be equal to the length of its corresponding third slidable member 240 above described.

Preferably, the distance between each rectangular shaped flat bar 256 forming each set shall be such distance as to accommodate each such third slidable device 244 to appropriately rotate on its axis on the aforesaid shaft 248.

Each such shaft 248 is to be made of a hardened material, preferably a metal alloy, sufficient to facilitate the rotation of the third slidable device 244 on its axis.

Preferably, the positioning of the lower guided track 252 on the frame 194, as described above, and the upper guided track 254 on the frame 194, as described above, is to be such that each track corresponds with the other.

In its static position, the underside of the plate component 186 of the present invention's device, as attached to the inverted U-shaped structure 250, is disclosed to rest upon a plurality of the third slidable device components 244 of the lower guided track 252 and which plurality of slidable devices 244 are simultaneously at rest being fixed to the inner walls of each U-shaped component 242 of the third slidable member 240 within the lower guided track 252. Simultaneously, and while in said described static position, the plurality of third slidable devices 244, located and fixed within the upper guided track 254 shall appropriately make contact with the top side of aforesaid plate component 186A.

Advantageously, the lower guided track 252 and the upper guided track 254 shall form a continuous and uninterrupted channel 258 to facilitate, upon activation in conjunction with dynamic action of the mechanical motion device 64 as hereinabove described, precise and level horizontal movement of the plate component 184 from its deactivated and stowed position, as result of being attached to the inverted U-shaped structure 250 as said inverted U-shaped structure 250 slides along the plurality of third slidable devices 244 located and fixed within the U-shaped structure 242 of the lower guided track 252 as said third slidable devices 244 rotate on their axis and, simultaneously, as result of its desired interaction with the upper guided track's 254 third slidable device 244, as said device rotates on its axis while fixed to the set of rectangular shaped flat bars 256 thereof, and then through the slotted opening 190 below the threshold plate exterior 28, as hereinafter described, to desired distance in order to accomplish gap minimization objective in accordance with TGI-LUT 48 set forth by the transit line system operator.

Of course, it will be appreciated by one skilled in the art that the apparatus and mechanism described above to facilitate movement of the plate component 184 of the present invention's device from its deactivated and stowed position under the train car vestibule floor 34 is not limited to the use of a U-shaped structure 242 forming a component of the third slidable member 240 as previously described, and further is not limited to the use of a device having a rotating or oscillating shape forming the third slidable device 244 as previously described, and further is not limited to the use of an inverted U-shaped structure 250, and further is not limited to the use of any of the components of the third slidable member 240 forming the above described lower guided track 252, and further is not limited to the use of a rectangular shaped flat bar component forming the above described upper guided track 254, and further is not limited to the use of any of the components forming the above described upper guided track 254, and all such devices may be otherwise selectively sized and shaped and have such other structure which may otherwise accomplish the due and proper movement and support of the plate component device 184 of the present invention in a horizontal direction such as required to accomplish gap minimization pursuant to the goals and objectives of the transit line system operator.

22. Seventh Plate Structure—Plate Below Train Car Floor Common Elements to all Design Modes There is to be a slotted opening 190, as hereinabove referenced in FIGS. 17, 18, 20, 22 and 28, directly through the train car's outer carriage 22 located below the train car doorway 14 and adjacent to, and to directly correspond with, the above described open side of the hexagonal frame 194, as disclosed in FIG. 19.

The dimensions of this slotted opening 190 preferably are to be such as to permit the plate 184 of the device of the present invention to be moved, upon activation, from below the vestibule floor 34 and be extended in a horizontal direction towards the edge of the station platform 20.

Preferably, the slotted opening 190 may have an apparatus hinged 192, as shown in FIGS. 17, 18, 20, 22, 28, by any known means such as by bolts or screws, to its perimeter surface to be made of a hardened material, such as a metal alloy, which is to cover said entire opening 190. Upon activation of the plate component 184 from its stowed position such that it shall extend forward horizontally and desired contact with said apparatus is made, said apparatus 192 shall move downward until coplanar with underside of said plate 186 thereby exposing the entire slotted opening 190 and thus permitting the plate 184 to horizontally move as desired. The said apparatus 192 is to remain in its opened position while said plate 184 is activated. Upon deactivation of the plate component 184 and with the full return of said plate 184 to its original stowed position, said apparatus 192 shall retract to its original position with the slotted opening 190 again fully covered.

Additionally, a further selectively sized and shaped intermediate structure 234, as shown in FIGS. 22, 28, is advantageously to be adhered by any known means, such as by screws or bolts, to the underside of the threshold plate exterior 28 so as to prevent unwarranted communication between the top side of the plate component 186A and the underside of the threshold plate exterior 28 during the process of activation and deactivation of the plate component 184 through the slotted opening 190, as described below, for purposes of gap minimization.

The device described in each of the embodiments 204, 216, 238 of the seventh plate structure above discussed shall be activated in accordance with the device activation procedure hereinabove described.

Upon activation of the device described in each of the above embodiments of the seventh plate structure, the plate 184 shall move outward in the horizontal plane from under the vestibule floor 34 through the slotted opening 190 passing under and beyond the threshold plate exterior 28 into the existing gap 16 between the threshold plate exterior 28 and the platform edge 20.

The area to be covered by the plate 184, as now activated, shall be predetermined by the transit line system's TGI-LUT 48 and the gap minimization objectives of the transit line system operator.

In yet another preferred embodiment, in lieu of the transit line system operator predetermining, in accordance with TGI-LUT 48, the distance the plate component 184 is to extend forward in the horizontal plane, said distance is to be determined as result of a singular proximity sensor 86, such as an optical sensor, radio frequency sensor, or a plurality of the same or differing proximity sensors, attached to or adjacent to the plate component 184 or otherwise to the device of the present invention communicating with the platform edge 20 corresponding to the train car doorway 14 and its threshold plate exterior 28.

In other preferred embodiments, the proximity sensor 86 aforementioned is to work as a redundant system to that embodiment above described where, in accordance with TGI-LUT 48, the transit line system operator predetermines the distance the plate component 184 is to extend forward in the horizontal plane towards the platform edge 20. In the case of malfunction or failure of said system, the proximity sensor 86 is to act as a backup system thereto.

In another preferred embodiment, the proximity sensor 86 works in conjunction with a corresponding receiver 36, disclosed in FIG. 1, such as a reflector or other like device to be removably coupled to the platform edge 20 by any known means, such as by bolts or screws, and positioned along the entire platform edge 20 or, in the alternative, opposite the corresponding train car door 12 and its threshold plate exterior 28. There shall be appropriate communication of signal from the proximity sensor 86 to its aforementioned corresponding receiver 36 and which receiver 36 shall accept and return said appropriate signal from the proximity sensor 86 thereby communicating the distance the plate component 184 is to extend forward in the horizontal plane towards the platform edge 20 thereby minimizing the existing gap 16.

Of course, it will be appreciated by one skilled in the art that the site placement of the corresponding receiver 36 for the signal being transmitted from the proximity sensor 86 to be located on the device of the present invention need not be on the train station platform edge 20 but can be otherwise appropriately located within the field of transmission of whatever proximity sensor or other like device is selectively utilized by the transit line system operator.

Further, of course, it will be appreciated by one skilled in the art that the aforementioned selectively sized and shaped intermediate structure 234 is not limited to placement to the underside of the threshold plate exterior 28 solely relative to that variation 216 of the seventh plate structure in which it is disclosed and can be advantageously utilized on any of the other variations of the seventh plate structure hereinabove referenced 204, 238.

Advantageously, as shown in FIG. 17, and in order to facilitate a level boarding area, in some preferred embodiments concerning the plate component 184 being extended from under the vestibule floor 34, a malleable device 188, preferably made of rubber or other like substance, is to be encased, by any known means, around the exposed perimeter of the threshold plate exterior 28 at its junction with the aforesaid plate component 184 after it has been activated as desired by the transit line operator.

In one preferred embodiment, as shown in FIG. 28, concerning the plate component 184 being extended from under the vestibule floor 34, the threshold plate 26, at the junction of the threshold plate exterior 28 with the plate component device 184 of the present invention, is to have a beveled edge 260 so as to form a smooth transitional communication with the plate component 184 in its activated position.

Further, regardless of the embodiment, whichever device of the present invention is utilized, the effect shall be to minimize the gap 16 existing between the train car doorway 14 and platform edge 20 by providing an extended boarding area allowing passengers to board from and alight onto the train station platform 18.

The manner of deactivation of the plate within the device of the present invention, regardless of the embodiment utilized, shall be as previously described.

23. Achievement of Dual Goal of Gap Minimization and Commuter Safety

Upon consideration of the flexibility offered by the various embodiments of the device of the present invention, the transit line system operator is able to advantageously achieve the goal, heretofore believed to be both unattainable and unrealistic, of mitigating every gap, regardless of size, on every train route within its entire transit line system while maintaining adherence to the system's own side clearance standards, rail industry standards or recommendations and applicable laws.

Figure 29:
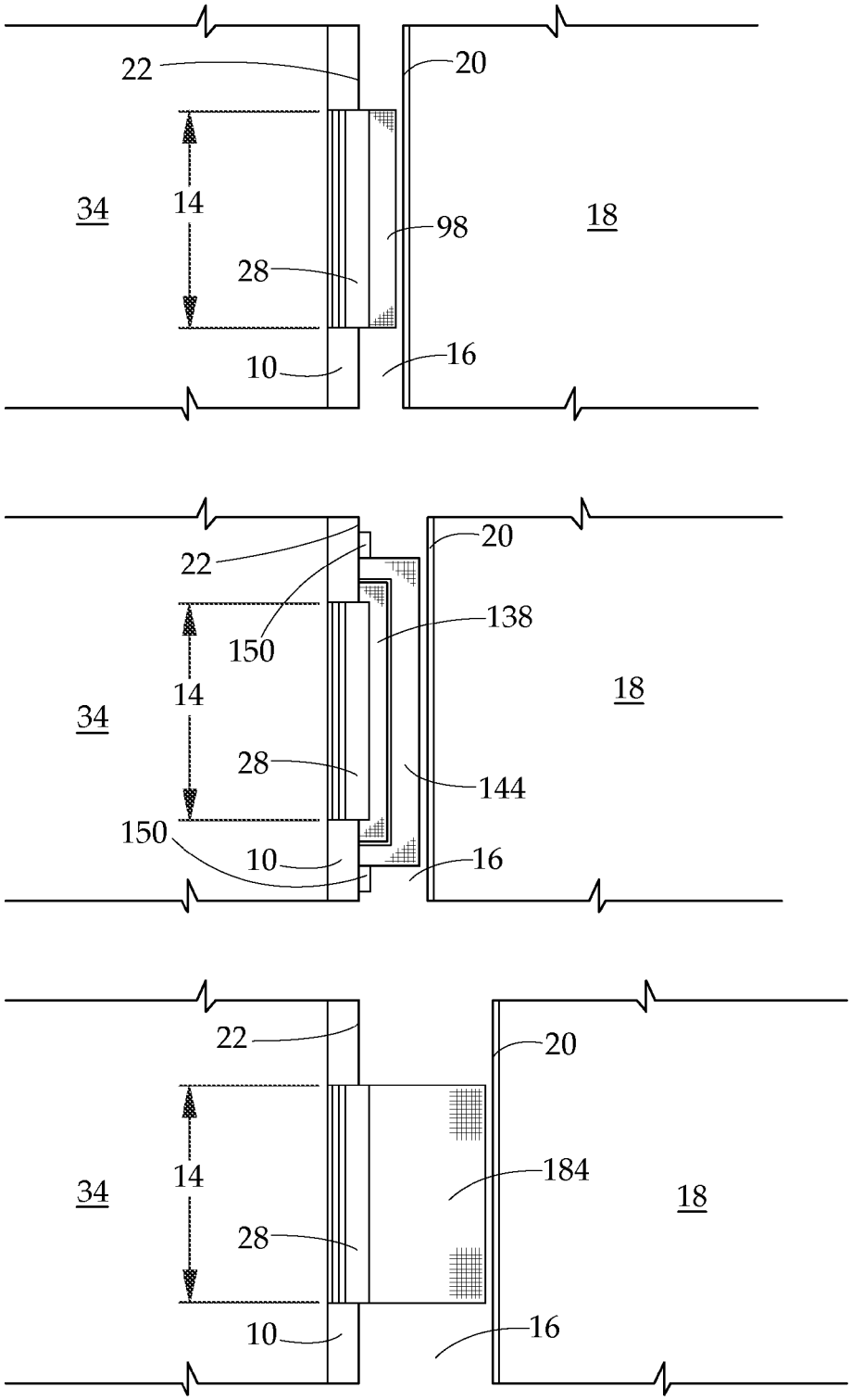
FIG. 29 is a top perspective view of plate component of device according to present invention in its activated position relative to gap between train car doorway and train station platform.

Referring now to FIG. 29, the aforementioned flexibility afforded and available to the transit line system operator is disclosed, regardless of the plate structure selected to be utilized, to mitigate all gaps 16 at every station platform 18 throughout its entire system between every train car doorway 14 of every train 10 in every trainset and its corresponding train station platform edge 20.

It will be appreciated by one skilled in the art that FIG. 29 for illustrative purposes discloses various embodiments of the device of the present invention instructive of gap minimization results upon device utilization. The first image shown within FIG. 29, as previously disclosed in FIGS. 7-8, refers to the heretofore disclosed first plate structure 96. The second image shown within FIG. 29, as previously disclosed in FIG. 13, refers to the heretofore disclosed fourth plate structure 136. The third image shown within FIG. 29, as previously disclosed in FIG. 17, refers to the heretofore disclosed seventh plate structure with plate component 184. Any plate structure selected will achieve the desired results of gap minimization and passenger safety.

All plate structures of the device of the present invention, and more particularly first plate structure 96, second plate structure 100, third plate structure 104, fourth plate structure 136, fifth plate structure 156 and sixth plate structure 170, can be retrofitted to the passenger train rail cars contained within the fleet of all transit line systems as may be selected by the transit line system operator.

All rail cars to be manufactured can be designed to incorporate those embodiments of the device of the present invention as selected by the transit line system operator, including the aforementioned first, second, third, fourth, fifth and sixth plate structures, and further all embodiments of the seventh plate structure 204, 216, 238 hereinabove disclosed.

The invention having been thus described, it will be apparent to those skilled in the art that the same may be varied in many ways without departing from the spirit of the invention. Any and all such modifications as would be obvious to those skilled in the art are intended to be covered within the scope of the following claims. Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A device to mitigate the gap existent between a train car door and a train station platform, comprising:

a plate assembly communicating with a threshold of a train car door, said plate assembly providing a continuous support structure for passage between a train car door and a train station platform edge, said plate assembly moveable between a first state wherein at least one plate of said assembly is positioned away from said train station platform edge and a second state wherein said at least one plate is positioned toward said train station platform edge to form at least a portion of said continuous support structure and mitigate said gap, a controller retrieving a predetermined distance from storage and controlling said plate assembly to extend said continuous support structure from said train car by the predetermined distance in said second state, the predetermined distance being based on a width of said gap so that said plate assembly accommodates different sized gaps.

2. The device of claim 1, wherein said plate assembly comprises a single plate fixedly mounted to train car exterior.

3. The device of claim 2, further comprising a mounting plate fixedly mounted to a train car exterior and to which the device is affixed.

4. The device of claim 1, wherein said plate assembly is formed from a single shape comprising that of a threshold plate mounted to said vestibule floor adjacent to the train car door with said single plate mounted to train car exterior.

5. The device of claim 4, further comprising a mounting plate fixedly mounted to a train car exterior and to which the device is affixed.

6. The device of claim 1, wherein said plate assembly comprises a plurality of grooved plates each with an upper and lower portion to work in a predetermined progression.

7. The device of claim 6, further comprising a mounting plate fixedly mounted to a train car exterior and to which the device is affixed.

8. The device of claim 1, wherein said plate assembly is formed from a single shape comprising that of a threshold plate mounted to said vestibule floor adjacent to train car door and that of a plurality of grooved plates each with an upper and lower portion to work in a predetermined progression.

9. The device of claim 8, further comprising a mounting plate fixedly mounted to a train car exterior and to which the device is affixed.

10. The device of claim 1, wherein said plate assembly comprises a plurality of interlocking plates to work in a predetermined progression.

11. The device of claim 10, further comprising a mounting plate fixedly mounted to a train car exterior and to which the device is affixed.

12. The device of claim 1, wherein said plate assembly is formed from a single shape comprising that of a threshold plate mounted to said vestibule floor adjacent to train car door and that of a plurality of interlocking plates to work in a predetermined progression.

13. The device of claim 12, further comprising a mounting plate fixedly mounted to a train car exterior and to which the device is affixed.

14. The device of claim 1, wherein said plate assembly is a single plate stowed under train car vestibule floor.

15. The device of claim 14, further comprising a series of corresponding receivers and/or transmitters located within train station to facilitate appropriate plate activation.

16. The device of claim 14, further comprising a slidable member for moving said plate through a continuous channel from stowed to activated position, said slidable member including a rail and a rolling-element linear bearing.

17. The device of claim 14, further comprising a slidable member for moving said plate from stowed to activated position through a continuous channel formed from a lower portion including said slidable member having a U-shape, a rolling bearing and a shaft and from an upper portion having an inverted U-shape.

18. The device of claim 14, further comprising a slidable member for moving said plate from stowed to activated position through a continuous channel formed from a lower portion, including said slidable member comprising a U-shape, a rolling bearing, a shaft, and an inverted U-shape, and from an upper portion having a rectangular shape including a rolling bearing and a shaft.

19. The device of claim 14, further comprising a threshold plate with a beveled edge.

20. The device of claim 14, further comprising a threshold plate with malleable device.

21. The device of claim 14, further comprising a frame with a slotted opening fixedly mounted to an undercarriage of train car within which the device is affixed.

22. The device of claim 1, wherein said device comprises a proprietary computer application program.

23. The device of claim 1, wherein said device comprises heating elements.

24. The device of claim 1, wherein said device comprises light-emitting diode.

25. The device of claim 1, wherein said device comprises a load sensor.

26. The device of claim 1, wherein said device comprises a proximity sensor.

27. The device of claim 1, wherein said device comprises a plate sensor.

28. The device of claim 1, wherein said device comprises a visual sensor.

29. The device of claim 1, wherein said device comprises a series of corresponding signal devices acting as receivers and/or transmitters located along train route to facilitate appropriate plate activation.

30. The device of claim 1, wherein said device comprises a mechanical motion device.

* * * * *